US007144694B2

(12) United States Patent
Kashiwagi et al.

(10) Patent No.: US 7,144,694 B2
(45) Date of Patent: Dec. 5, 2006

(54) PHOTOTHERMOGRAPHIC IMAGING MATERIAL AND METHOD FOR FORMING IMAGE

(75) Inventors: Hiroshi Kashiwagi, Hino (JP); Narito Goto, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 29 days.

(21) Appl. No.: 11/262,161

(22) Filed: Oct. 28, 2005

(65) Prior Publication Data

US 2006/0084016 A1 Apr. 20, 2006

Related U.S. Application Data

(62) Division of application No. 10/727,313, filed on Dec. 2, 2003.

(30) Foreign Application Priority Data

Dec. 9, 2002 (JP) ..... 2002-356615
Jan. 14, 2003 (JP) ..... 2003-005526

(51) Int. Cl.

| | |
|---|---|
| ***G03C 1/00*** | (2006.01) |
| ***G03C 5/16*** | (2006.01) |
| ***G03C 8/00*** | (2006.01) |
| ***G03C 1/005*** | (2006.01) |
| ***G03C 1/494*** | (2006.01) |

(52) U.S. Cl. ..... 430/617; 430/618; 430/619; 430/620; 430/350; 430/336; 430/224; 430/567; 430/551; 430/598; 430/600

(58) Field of Classification Search ..... 430/617–620, 430/336, 224, 350, 567, 551, 598, 600
See application file for complete search history.

(56) References Cited

U.S. PATENT DOCUMENTS 5,330,864 A * 7/1994 Biavasco et al. ..... 430/619
2003/0190565 A1* 10/2003 Fujiwara et al. ..... 430/610

* cited by examiner

*Primary Examiner*—Geraldine Letscher
(74) *Attorney, Agent, or Firm*—Lucas & Mercanti, LLP

(57) ABSTRACT

A photothermographic imaging material including a support; an image forming layer containing an organic silver salt, a photosensitive silver halide, a binder and a silver ion reducing agent, the image forming layer being provided on the support; and a cyan coloring leuco dye. The photosensitive silver halide contains silver halide grains having a mean particle size of 10 to 50 nm, and the silver ion reducing agent is a compound represented by the following Formula (A-3)

(A-3)

9 Claims, 1 Drawing Sheet

PHOTOTHERMOGRAPHIC IMAGING MATERIAL AND METHOD FOR FORMING IMAGE

CROSS REFERENCE TO RELATED APPLICATIONS

This Application is a Divisional of U.S. patent application Ser. No. 10/727,313 filed Dec. 2, 2003 which, in turn, claims the priority of Japanese Patent Application Nos. JP2002-356615 filed Dec. 9, 2002 and 2003-005526 filed Jan. 14, 2003, the priority of which are all claimed.

BACKGROUND OF THE INVENTION

1. Field of the Invention

The present invention relates to a photothermographic imaging material, and particularly to a photothermographic imaging material with high density which is excellent in light radiated image stability, silver color tone and the like, and to a method for forming an image by using the same.

2. Description of Related Art

Recently, in the fields of medical care and print plate making, waste solutions involved in wet processings of image formation materials have been problematic in terms of working property, and reduction of processing waste solutions has been strongly desired in the light of environmental preservation and saving space. Thus, technology concerning photothermal photographic materials for photographic technology use such as laser imagers and laser image setters where efficient exposure is possible and clear black images with high resolution can be formed has been required.

As the technology according to the above photothermal photographic materials, for example, known are silver salt photothermographic dry imaging materials (hereinafter, also referred to as photothermographic imaging materials or simply imaging materials) containing an organic silver salt, photosensitive silver halide and a reducing agent on a support (e.g., U.S. Pat. No. 3,152,904 specification, U.S. Pat. No. 3,487,075 specification, D. H. Klosterboer, "Dry Silver Photographic Materials", (Handbook of Imaging Materials, page 48, 1991, Marcel Dekker Inc.)). This silver salt photothermographic dry imaging material has an advantage capable of providing users with a system which is simpler and does not impair the environment because no solution type processing chemical is used at all.

This photothermographic material is processed by a thermal development apparatus which adds stable heat to the photothermographic material to form the image, typically called a thermal developing apparatus. As mentioned above, in conjunction with the recent rapid prevalence, this thermal developing apparatus has been supplied in the market in large quantities. In the meanwhile, there has been problematic in that slipping property between the imaging material and a transport roller or processing members of the thermal developing apparatus changes, and transport failure and density unevenness occur. Also there has been problematic in that the density of the photothermographic imaging material varies with time. It has been found that these phenomena noticeably occur in the photothermographic imaging materials where image exposure is performed by laser light and subsequently the image is formed by thermal development.

Also recently, downsizing of laser imagers and acceleration of processings have been required. Therefore property improvement of the photothermographic imaging materials becomes essential. For downsizing the thermal development processing apparatus, it is more advantageous to use a heat drum mode than to use a horizontal transport mode, but there has been problematic in that powder drop off, density unevenness and roller mark easily occur at the thermal development processing. Also, even when the rapid processing is carried out, to obtain sufficient density of the photothermographic imaging material, it is effective to enhance covering power by increasing coloring point numbers using silver halide with smaller average particle size as shown in JP-A-11-295844 and JP-A-11-352627, to use reducing agents with high activity having secondary or tertiary alkyl groups (see JP-A-2001-209145), and to use development accelerators such as hydrazine compounds and vinyl compounds.

However, when these technologies were used, there was problematic in that density changes (printout property) with time after the thermal development processing became large and the silver color tone became extremely different (took on a yellow tinge) compared to wet type-X-ray films in earlier technology. Additionally, a new problem where the color tone takes on a red tinge at high density areas with density of 2.0 or more has occurred when those with smaller average particle size are used as the silver halide.

On the other hand, in image diagnosis by imaging materials for the medical use, silver color tone formed by development is an important factor which determines good or poor image quality. A silver ion reducing agent, a compound which forms a complex with the silver ions, a compound which bleaches fine silver nuclei which become sources of photographic fog which produces on surfaces of silver halide grains, and the like are contained in the silver salt photothermographic dry imaging material, and thus it is not easy to control developed silver shapes and retain images after the thermal development. That is, color tone changes must be reduced not only immediately after the thermal development of the imaging material but also in a long term storage before the thermal development and in image storage after the development. For example, disclosed is the method for reducing the ingredient having reducibility contained in the silver salt photothermographic dry imaging material (e.g., see JP-A-2002-328442). However, the color tone in the image storage is improved, but the color tone immediately after the thermal development is not improved. In earlier technology, these improvements have been attempted by controlling developed silver shapes. For example, disclosed is the method where the "color tone" changes under an atmosphere with high moisture is reduced by reducing particle sizes of silver halide grains and fatty acid silver salt crystals and controlling a "potency range" at the thermal development to the certain range (e.g., see JP-A-10-282601). Also, proposed are the improvement methods by activating photothermographic property by contrivance of fatty acid silver salt crystal structures (e.g., see JP-A-2002-23303 and JP-A-2002-49119), but it can not help being said that all the methods are at insufficient levels in terms of realizing the stable silver color tone. Also disclosed is the method using leuco compounds which imagewisely produce yellow compounds by oxidation-reduction reaction at the thermal development, in combination with the certain silver ion reducing agent (e.g., see JP-A-2002-169249). However, the technology described in JP-A-2002-169249 is more excellent in improvement level of the color tone compared to the above technology which controls the developed silver shape, but has disadvantages that the photographic fog and deterioration of the color tone changes frequently occur in the long term storage and in the image storage probably because produced dyestuffs are unstable and further adversely affect the silver halide.

Also, in the light of effectively utilizing the silver which is a valuable resource, efforts to increase the maximum density on the imaging materials at an identical amount of the silver must be continued. A basic technical concept for this is to make individual developed silver small at the identical silver amount and make the particle sizes of photosensitive silver halide grains small. That is, the combination with so-called sensitization technology becomes essential. But when the individual developed silvers are made small, extents of optical scattering and absorption are changed and thus the silver color tone is changed. Further, when the chemical sensitization is given with a Te sensitizer and a gold sensitizer, the photographic fog is increased. Thus, a new technology where the increase of maximum density, sensitization, low photographic fog and color tone are compatible has been required.

SUMMARY OF THE INVENTION

The present invention has been made in view of the above problems.

That is, an object of the present invention is to provide a photothermographic imaging material with high density which is excellent in light radiated image stability and silver color tone, and to a method for forming an image. Also, the object of the present invention is to further provide a photothermographic imaging material which is excellent in image storage stability in storage at high temperature or excellent in film transportability and environmental suitability if necessary.

Further, another object of the present invention is to provide a silver salt photothermographic dry imaging material with low photographic fog, high sensitivity and high maximum density, which is excellent in image color tone and excellent in rapid thermal development suitability, as well as to an image recording method and an image forming method using the same.

In order to achieve the above-described objects, according to a first aspect of the present invention, the photothermographic imaging material of the present invention comprises a support; an image forming layer containing an organic silver salt, a photosensitive silver halide, a binder and a silver ion reducing agent, the image forming layer being provided on the support; and a cyan coloring leuco dye, wherein the photosensitive silver halide contains silver halide grains having a mean particle size of 10 to 50 nm, and the silver ion reducing agent is a compound represented by the following Formula (A-3), (A-3)

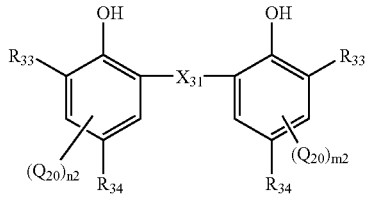

wherein the $X_{31}$ represents a chalcogen atom or a CHR, the R representing a hydrogen atom, a halogen atom, an alkyl group or an alkenyl group; each $R_{33}$ represents an alkyl group, at least one $R_{33}$ being a secondary or tertiary alkyl group; the each $R_{34}$ represents a hydrogen atom or a group capable of being substituted on a benzene ring; each $Q_{20}$ represents a group capable of being substituted on a benzene ring; and each of the m2 and the n2 represents an integer of 0 to 2.

Here, in the photothermographic imaging material, and the $R_{33}$s may be the same or different.

Further, preferably, the compound represented by the Formula (A-3) comprises an alkyl group having a hydroxyl group or a precursor of the hydroxyl group.

Further, preferably, the material further comprises a compound represented by the following Formula (YA) on a side of a face having the image forming layer, (YA)

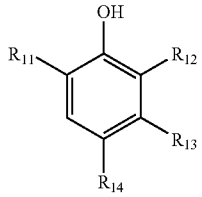

wherein the $R_{11}$ represents a substituted or non-substituted alkyl group; the $R_{12}$ represents a hydrogen atom, a substituted or non-substituted alkyl group or a substituted or non-substituted acylamino group, the $R_{11}$ and the $R_{12}$ being substantially free from 2-hydroxyphenylmethyl group; the $R_{13}$ represents a hydrogen atom or a substituted or non-substituted alkyl group; and the $R_{14}$ represents a substituent capable of being substituted on a benzene ring.

Further, preferably, an average gradation is from 2.0 to 4.0 at an optical density of 0.25 to 2.5 in diffused light on a characteristic curve shown on rectangular coordinates where unit lengths of diffuse density (Y axis) and common logarithm exposure amount (X axis) are equal on an image obtained by thermally developing at a development temperature of 123° C. for a development time of 13.5 sec.

Further, preferably, the material comprises at least one silver saving agent selected from a vinyl compound, a hydrazine derivative, a silane compound and a quaternary onium salt in a side of a face having the image forming layer.

Further, preferably, a glass transition temperature (Tg) of the binder is from 70° C. to 150° C.

Further, preferably, the material comprises a compound represented by the following Formula (SF), $$(Rf—(L_5)_{n1}—)_p—(Y)_{m1}—(A)_q \quad \text{(SF)}$$

wherein the Rf represents a substituent containing a fluorine atom; the $L_5$ represents a bivalent linkage group substantially free from a fluorine atom; the Y represents a bivalent to quadrivalent linkage group substantially free from a fluorine atom; the A represents an anion group or a base of the anion group; each of the m1 and n1 represents an integer of 0 or 1; each of the p and the q represents an integer of 1 to 3; and when the q is 1, the n1 and m1 are not simultaneously 0.

Further, preferably, the photosensitive silver halide further contains silver halide grains having a means particle size of 55 to 100 nm.

Further, preferably, the photosensitive silver halide further contains silver halide grains which are chemically sensitized with a chalcogen compound.

Further, preferably, an amount of silver contained in the image forming layer is from 0.3 to 1.5 g/m$^2$.

Further, according to a second aspect of the present invention, the method for forming an image of the present invention comprises thermally developing the material of the above-described first aspect by using a thermal development apparatus having a thermal development portion, an imaging material supplying portion and an image exposure section, wherein a transport velocity of the material at the thermal development portion is from 10 to 200 mm/sec, a transport velocity of the material between the imaging material supplying portion and the image exposure portion is from 10 to 200 mm/sec, and a transport velocity of the material at the image exposure portion is from 10 to 200 mm/sec.

According to a third aspect of the present invention, the silver salt photothermographic dry imaging material of the present invention comprises a photosensitive layer having an organic silver salt, a photosensitive silver halide, a silver ion reducing agent and a binder, the organic silver salt containing aliphatic silver carboxylate; and a cyan coloring leuco dye, wherein 50 mol % or more and less than 100 mol % of the aliphatic silver carboxylate in the organic silver salt is silver behenate.

According to a fourth aspect of the present invention, the silver salt photothermographic dry imaging material of the present invention comprises a photosensitive layer having an organic silver salt, a photosensitive silver halide, a silver ion reducing agent and a binder; and a cyan coloring leuco dye, wherein an average iodine content in the photosensitive silver halide is 2.0 mol % or more and 7.0 mol % or less.

In the silver salt photothermographic dry imaging material, preferably, the organic silver salt containing aliphatic silver carboxylate, and 70 mol % or more and less than 100 mol % of the aliphatic silver carboxylate in the organic silver salt is silver behenate.

Further, according to a fifth aspect of the present invention, the silver salt photothermographic dry imaging material of the present invention comprises a photosensitive layer having an organic silver salt, a photosensitive silver halide, a silver ion reducing agent and a binder; a cyan coloring leuco dye; and at least one crosslinker selected from a group consisting of a vinylsulfone group, an isocyanate group and a carbodiimide group.

Preferably, the silver salt photothermographic dry imaging material further comprises at least one crosslinker selected from a group consisting of a vinylsulfone group, an is cyanate group and a carbodiimide group.

Further, preferably, in the silver salt photothermographic dry imaging material, coefficient of determination (multiple determination) $R^2$ of a linear regression straight line is 0.998 or more and 1.000 or less, the $R^2$ being made by measuring each density at optical density of 0.5, 1.0, 1.5 and minimum optical density on a silver image obtained after thermal development processing of the silver salt photothermographic dry imaging material and by disposing u* and v* at the above each optical density on two dimensional coordinates where a horizontal and vertical axes in CIE 1976 (L*u*v*) color space are made u* and v*, respectively; and v* value of an intersection point with the vertical axis of the linear regression straight line is −5 or more and 5 or less; and a slope (v*/u*) is 0.7 or more and 2.5 or less.

According to a sixth aspect of the present invention, the method for recording an image on the materials of the above-described third to fifth aspects of the present invention comprises performing image exposure according to a vertical multiple mode laser scanning exposure apparatus when recording the image on the material.

According to a seventh aspect of the present invention, the method for forming an image after performing image recording on the materials of the above-described third to fifth aspects of the present invention comprises thermal developing in a state containing 40 to 4500 ppm of organic solvent when forming the image on the material.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

PREFERRED EMBODIMENT OF THE INVENTION

Figure 1:
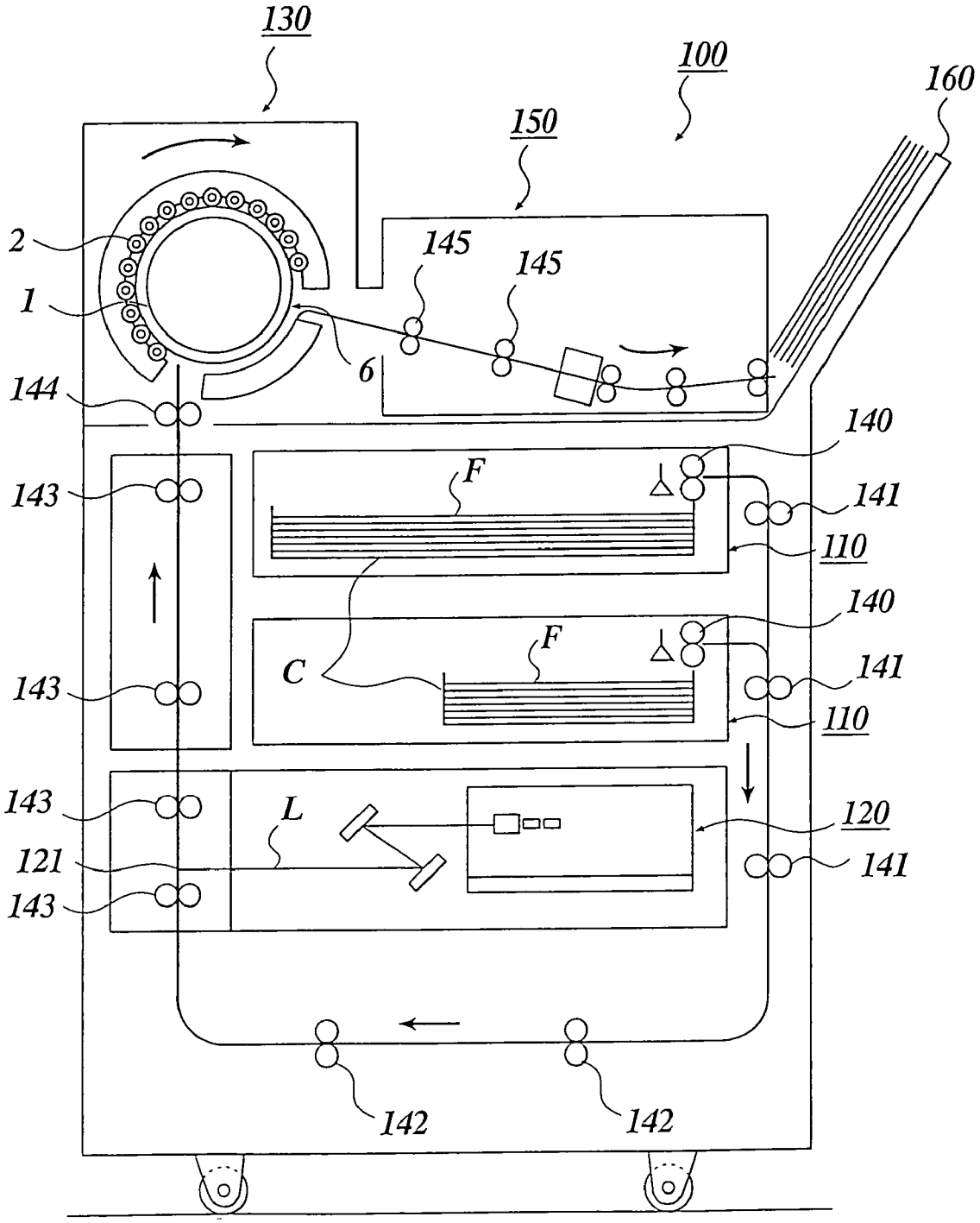
FIG. 1 is a view showing an example of a thermal development apparatus for processing a photothermographic imaging material of the present invention.

Hereinafter, the present invention will be described in detail.

The photothermographic imaging material and silver salt photothermographic dry imaging material of the present invention comprises organic silver salt, photosensitive silver halide, binder, silver ion reducing agent, and further, cyan coloring leuco dye.

[Organic Silver Salts]

In the invention, as organic silver salts as silver ion supplying source for silver image formation, preferred are silver salts of organic acids and hetero organic acids, especially in these salts, silver salts of long chain (from 10 to 30, preferably from 15 to 25 carbons) aliphatic carboxylic acids, and silver salts of nitrogen-containing heterocyclic compounds. Also preferred are organic or inorganic complexes described in Research Disclosure (hereinafter, also referred to as RD) 17029 and 29963 such as those where ligands have values of 4.0 to 10.0 as a total stability constant for silver ions.

Examples of these suitable silver salts include the followings.

Silver salts of organic acids, e.g., silver salts of gallic acid, oxalic acid, behenic acid, stearic acid, arachidic acid, palmitic acid, lauric acid, etc.; carboxyalkylthio urea salts of silver, e.g., silver salts of 1-(3-carboxypropyl) thiourea, 1-(3-carboxypropyl)-3,3-dimethyl thiourea; silver salts or silver complexes of polymer reaction product of aldehyde with hydroxy-substituted aromatic carboxylic acid, e.g., silver salts or silver complexes of the reaction product of aldehydes (formaldehyde, acetaldehyde, butylaldehyde, etc.) with hydroxy-substituted acids (e.g., salicylic acid, benzoic acid, 3,5-hydroxybenzoic acid); silver salts or silver complexes of thiones, e.g., silver salts or silver complexes of 3(2-carboxyethyl)-4-hydroxymethyl-4-thiazoline-2-thione, and 3-carboxymethyl-4-thiazoline-2-thione, etc.; complexes or salts of silver with nitrogen acid selected from imidazole, pyrazole, urazole, 1,2,4-thiazole and 1H-tetrazole, 3-amino-5-benzylthio-1,2,4-triazole and benzotriazole; silver salts of saccharine, 5-chlorosalicylaldoxime, and the like; silver mercaptides and the like.

In the photothermographic imaging material of a first embodiment, especially preferable silver salts include the silver salts of long chain (from 10 to 30, preferably from 15 to 25 carbons) aliphatic carboxylic acids such as silver behenate, silver arachidate and silver stearate.

Also, in the embodiment, it is preferred that two or more organic silver salts are mixed in terms of increasing development performance and forming silver images with high density and high contrast, and for example, it is preferable to prepare by mixing a silver ion solution to a mixture of two or more organic acids.

An organic silver salt can be obtained by mixing a water soluble silver compound and a compound which forms complex with the silver, and preferably used are a normal mixing method, a reverse mixing method, a simultaneous mixing method, a controlled double jet method as described in JP-A-9-127643, and the like. For example, an alkali metallic salt (e.g., sodium hydroxide, potassium hydroxide, etc.) is added to an organic acid to make an organic acid alkali metallic salt soap (e.g., sodium behenate, sodium arachidate, etc.), and subsequently crystal of an organic silver salt is made by mixing silver nitrate with the soap. At that time, silver halide grains may be mixed.

It is possible to use various shapes of the above organic silver salt according to the present invention, but tabular particles are preferable. Especially, preferred are the particles which are tabular organic silver salt particles with an aspect ratio of 3 or more and where the average value of an acicular ratio of the tabular organic silver salt particles measured from a major plane direction is from 1.1 or more and less than 10.0 in order to increase a filling rate in a photosensitive layer by reducing shape anisotropy of nearly parallel opposed two faces (major planes) having maximum area. Besides, more preferable acicular ratio is from 1.1 or more and less than 5.0.

Also, tabular organic silver salt particles with the aspect ratio of 3 or more represents that the tabular organic silver salt particles occupy 50% or more of the number of whole organic silver salt particles. Further, in the organic silver salt according to the present invention, the tabular organic silver salt particles with the aspect ratio of 3 or more occupy preferably 60% or more, more preferably 70% or more (number), and especially preferably 80% or more (number) of the number of whole organic silver salt particles.

Tabular particles with the aspect ratio of 3 or more are the particles where a ratio of a particle size to a thickness, so-called the aspect ratio (abbreviated as AR) represented by the following formula is 3 or more.

$$AR = \text{Particle size } (\mu m)/\text{Thickness } (\mu m)$$

The aspect ratio of the tabular organic silver salt particles is preferably from 3 to 20, and more preferably from 3 to 10. The reasons are that the organic silver salt particles are easily close-packed when the aspect ratio is too low whereas when the aspect ratio is too high, then the organic silver salt particles are easily overlapped and light scattering and the like easily occur because the particles are easily dispersed in a clung state, resulting in reduction of clear feeling of imaging materials. Thus, the range described above is preferable.

The average values of particle sizes, average thickness, and acicular rates can be obtained by the methods described in the paragraphs [0031] to [0047] of JP-A-2002-287299.

The method where the organic silver salt particles having the above shape are obtained is not especially limited, but effective are that a mixing state at the formation of the organic acid alkali metallic salt soap and/or a mixing state at the addition of silver nitrate to the soap are kept well and that a rate of silver nitrate which reacts with the soap is made optical.

It is preferred that the tabular organic silver salt particles according to the present invention are predispersed with a binder and surfactants if necessary and subsequently dispersed/pulverized by a media dispersing machine or a high pressure homogenizer. For the above predispersion, it is possible to use common mixers such as anchor type and propeller type, a high-speed rotation centrifuging radiation type mixer (dissolver) and a high-speed rotation shearing type mixer (homo mixer).

Also, as the above media dispersing machine, it is possible to use rolling mills such as a ball mill, planetary ball mill and vibrating ball mill, media mixing mills such as a bead mill and attritor, and the others such as a basket mill, and as high pressure homogenizers, it is possible to use various types such as a type of conflicting to walls and plugs, a type where a liquid is divided into two and then the liquids are crashed at a high-speed and a type of passing through thin orifices.

As ceramics used for ceramics beads used upon media dispersion, preferred are those described in the paragraph [0051] of the above JP-A-2002-287299. Yttrium stabilized zirconia and zirconia toughened alumina (hereinafter these zirconia-containing ceramics are abbreviated as zirconia) are especially preferably used from the reason that impurity production due to friction with beads and a dispersing machine upon the dispersion is low.

In the apparatuses used upon dispersing the tabular organic silver salt particles, as materials of members to which the organic silver salt particles contact, it is preferable to use ceramics such as zirconia, alumina, silicon nitride and boron nitride, or diamond, and among others it is preferable to use zirconia.

When the above dispersion is carried out, it is preferred that the binder is added at a concentration of 0.1 to 10% of the organic silver salt by mass, and it is preferred that liquid temperature is less than 45° C. throughout from predispersion to main dispersion. A preferable operating condition of the main dispersion includes the condition of 29.42 MPa to 98.06 MPa and two times or more of operations when the high pressure homogenizer is used as the dispersion means as the preferable operating condition. Also when the media dispersing machine is used as the dispersing means, the condition where a peripheral velocity is from 6 m/second to 13 m/second is included as the preferable condition.

Also, the preferable mode in the photothermographic imaging materials in the embodiment is made by coating the organic silver salt having the characteristics that the rate of the organic silver salt particles which exhibit a projected area of less than 0.025 $\mu m^2$ when a sectional face perpendicular to the support face of the material is observed by the electron microscope is 70% or more of whole projected areas and the rate of the particles which exhibit the projected area of 0.2 $\mu m^2$ or more is 10% or less of whole projected areas of the organic silver salt particles, and further a photosensitive emulsion containing the photosensitive silver halide. In such a case, it is possible to obtain the state where agglomeration of the organic silver salt particles is low and the particles are distributed evenly in the photosensitive emulsion.

The conditions to make the photosensitive emulsion having such characteristics are not especially limited, but include that the mixing state at the formation of organic acid alkali metallic salt soap and/or the mixing state at the addition of silver nitrate to the soap are kept well, that the rate of silver nitrate which reacts to the soap is made optical, dispersing by the media dispersing machine or the high pressure homogenizer for dispersion/pulverization, that the use amount of binder (concentration) is made from 0.1 to 10% of the organic silver salt by mass at that time, agitating at the peripheral velocity of 2.0 m/second or more using the dissolver at the preparation of solution, in addition to that the temperature is less than 45° C. throughout from dry to the termination of main dispersion as the preferable conditions.

For the projected area of the organic silver salt particle having the certain projected area value as the above and a percentage thereof occupying in the whole projected area, as is described in the description to obtain the average thickness of the tabular particles described above, places corresponding to the organic silver salt particles are extracted by the method using TEM (transmission electron microscope). Specifically, they can be obtained by the method described in the paragraphs of [0057] to [0059] of JP-A2002-287299.

It is preferred that the organic silver salt particles used in the embodiment are monodisperse particles, preferable monodisperse degree is from 1 to 30%, and the image with high density is obtained by making the monodisperse particles in this range. The monodisperse degree herein is defined by the following formula.

$$\text{Monodisperse degree}=\{(\text{Standard deviation of particle sizes})/(\text{Mean value of particle sizes})\}\times 100$$

The mean particle size (circle corresponding diameter) of the organic silver salt described above is preferably from 0.01 to 0.3 μm, and more preferably from 0.02 to 0.2 μm. Besides, the mean particle size (diameter of corresponding circle) represents the diameter of a circle which has the same area as each particle image observed by the electron microscope.

To prevent devitrification of the imaging materials in the present invention, it is preferred that the total amount of silver halide and organic silver salt is from 0.3 g to 1.5 g per 1 $m^2$ in terms of the silver amount. The preferable images are obtained when used as medical images by making this range. When it is less than 0.3 g per 1 $m^2$, the image density is reduced in some cases. Also when it is more than 1.5 g per 1 $m^2$, sensitivity reduction occurs at printing to PS plates in some cases.

On the other hand, in the silver salt photothermographic dry imaging material of a second embodiment, the higher the percentage of behenic acid is, moist storage fog and image storage fog are further improved. The percentage of silver behenate occupying in the organic silver salt is 50 mol % or more and less than 100 mol %, preferably, 70 mol % or more and less than 100 mol %, more preferably, 80 mol % or more and 99.9 mol % or less, and further preferably, 90 mol % or more and 99.9 mol % or less. On the other hand, when the percentage of the silver behenate becomes high, the melting point becomes high and it becomes difficult that silver ions are released, and thus the photothermographic property is deteriorated. As a means to improve this, it is preferable to combine a reducing agent described below. The other examples include the organic silver salts described in the paragraph number [0193] of JP-A-2001-83659. Also, concerning the methods for manufacturing the organic silver salts and the particle sizes of the organic silver salts, it i possible to refer to the description in the paragraph numbers of [0194] to [0197] of the same patent. Also, as the organic silver salts according to the invention, it is possible to use the technologies described in the paragraph numbers of [0028] to [0033] of JP-A-2001-48902 and in the paragraph numbers of [0025] to [0041] of JP-A-2000-72777. Also in the invention, it is desirable to manufacture silver salt particles under the condition where the compound which works as a crystal growth inhibitor or a dispersant for the silver salt particles is made coexist, in a process for manufacturing the silver salt particles. Such compounds are referred to the compounds having functions or effects to make the particle sizes smaller and/or to make more monodisperse compared to when manufactured under the condition where such a compound does not coexist. Specific examples include tertiary alcohols with 10 or less carbons, and are especially preferably tert-butanol. The preferable addition amount is from 10 to 200% by mass based on the aliphatic silver carboxylate.

[Silver Halide]

Described is photosensitive silver halide according to the present invention (hereinafter also referred to as silver halide, photosensitive silver halide grains or silver halide grains). Besides, the silver halide according to the present invention is referred to the silver halide crystalline particles treated and manufactured to be capable of originally absorbing light as an inherent nature of the silver halide crystal or capable of absorbing visual light or infrared light by artificial physicochemical methods, and such that physicochemical changes occur in the silver halide crystal or on the surface of the crystal when light is absorbed in any area of the light wavelength range from the ultraviolet light area to the infrared light area.

The silver halide grains per se used for the present invention can be prepared as the silver halide particle emulsion (also referred to as silver halide emulsion) using the well-known methods. For example, the photosensitive silver halide can be prepared as the silver halide particle emulsion using the methods described in P. Glafkides, Chimie et Physique Photographique (published by Paul Montel, 1967); G. F. Duffin, Photographic Emulsion Chemistry (published by The Focal Press, 1966); and V. L. Zelikman et al., Making and Coating Photographic Emulsion (published by The Focal Press, 1964).

That is, any of an acid method, neutral method, ammonia method and the like may be used, and also as the method to react a soluble silver salt with a soluble halogen salt, any of an one side mixing method, a simultaneous mixing method and the combination thereof may be used, but among the above methods, so-called controlled double jet method is preferable where the silver halide grains are prepared with controlling the formation condition.

A halogen composition of the photosensitive silver halide used in the first embodiment is not especially limited, and may be any of silver chloride, silver chloride bromide, silver chloride iodide bromide, silver bromide, silver iodide bromide and silver iodide.

On the other hand, the halogen composition of the photosensitive silver halide use in the second embodiment may be any of silver chloride iodide bromide, silver iodide bromide and silver iodide. In the embodiment, the iodine content is 2.0 mol % or more and 7.0 mol % or less, preferably, 2.5 mol % or more and 7.0 mol % or less, further preferably, 2.0 mol % or more and 6.0 mol % or less, more preferably, 2.5 mol % or more and 6.0 mol % or less, furthermore preferably, 2.5 mol % or more and 5.0 mol % or less, and most preferably, 3.0 mol % or more and 5.0 mol % or less. Physical phenomena are substantially given to the silver salt photothermographic dry imaging material of the invention, and within the iodine content of the invention, development fog can be reduced as desensitization is minimally inhibited. Also, the other effect can include accomplishment of high covering power. That is, when the particle sizes of the photosensitive silver halide which can become development initiation points are reduced to accomplish the high covering power, the particles are easily agglomerated, but when the appropriate iodine content of the invention is present, this agglomeration can be reduced.

The particle formation is typically divided into two stages, silver halide seed particle (nucleus) generation and particle growth, may be performed by the method where they are performed simultaneously and continuously or the method where the nucleus (seed particle) formation and the particle growth are separated, and it is possible to use the technology described in the paragraph number [0063] of JP-A-2001-83659.

The controlled double jet method where the particle formation is carried out by controlling pAg, pH which are the particle formation condition is preferable because the particle shape and size can be controlled. For example, when the method where the nucleus generation and the particle growth are separately carried out is performed, first a silver salt aqueous solution and a halide aqueous solution are mixed evenly and rapidly in a gelatin aqueous solution to generate the nucleus (seed particle) (nucleus generation step), and subsequently the silver halide grains are prepared by a particle growth step where the particles are grown with supplying the silver salt aqueous solution and the halide aqueous solution under controlled pAg and pH. The desired silver halide photographic emulsion can be obtained by eliminating unnecessary salts by a desalting step such as the desalting method known in the art such as a noodle method, flocculation method, ultrafiltration method and electric dialysis method after the particle formation.

Here, in the embodiment as the photothermographic imaging material, it is necessary that the average particle size of the silver halide is from 10 to 50 nm, but preferably it is from 10 to 35 nm. When the average particle size of the silver halide is less than 10 nm, the image density is sometimes reduced and light radiated image stability is sometimes deteriorated. When it is more than 50 nm, the image density is sometimes reduced.

The average particle size in both embodiments is referred to a length of an arris of the silver halide particle when the silver halide particle is in normal crystal shape such as cubic or octahedral shape. Also, when the silver halide particle is a tabular particle, it is referred to a diameter at the time when the particle is converted into a circle with the same area as a projected area of a major surface of the particle. When the particle is in the other shape which is not the normal crystal, such as spherical particle and bar particle, the diameter at the time when a sphere with the same volume as that of the silver halide particle is thought is calculated as the particle size. The measurement was carried out using electron microscopy, and the average particle size was obtained by averaging the measured values of 300 particle sizes.

Further, by combining the silver halide with average particle size of 55 to 100 nm and the silver halide with average particle size of 10 to 50 nm, it is possible to enhance the image density and improve (reduce) the decrease of image density with time. A ratio (mass ratio) of the silver halide grains with the average particle size of 10 to 50 nm to the silver halide grains with the average particle size of 55 to 100 nm is preferably from 95:5 to 50:50, and more preferably from 90:10 to 60:40.

On the other hand, in the embodiment as the silver salt photothermographic dry imaging material, the photosensitive silver halide according to the invention preferably have the smaller mean particle size in order to keep white turbidity after the image formation low and obtain good image quality. The average particle size is 0.2 μm or less, more preferably from 0.01 μm to 0.17 μm, and especially preferably from 0.02 μm to 0.14 μm.

It is preferred that particle sizes of the silver halide grains are monodisperse. The monodisperse herein is referred to those where a coefficient of variation of the particle sizes obtained by the following formula is 30% or less. Preferably it is 20% or less and more preferably 15% or less.

Coefficient of variation of particle sizes %=(Standard deviation of particle sizes/Mean value of particle sizes)×100

Shapes of the silver halide grains can include a regular hexahedron, octahedron, 14-hedron particles, tabular particles, spherical particles, stick particles, potato-shaped particles and the like, but in these, preferred are regular hexahedron, octahedron, 14-hedron, and tabular silver halide grains.

When the tabular silver halide grains are used, the average aspect ratio is preferably 1.5 to 100, and more preferably 2 to 50. These are described in U.S. Pat. Nos. 5,264,337, 5,314,798 and 5,320,958, and the target tabular particles can be readily obtained. Additionally, particles where corners of the silver halide grains uproll can be preferably used.

Crystal habits of external surfaces of the silver halide grains are not especially limited, but it is preferred to use the silver halide grains having the crystal habit compatible for the selectivity at a high rate when a sensitizing dye having the crystal habit (face) selectivity is used in absorption reaction of the sensitizing dye onto the surface of the silver halide grains. For example, when the sensitizing dye which is selectively absorbed to crystal face with mirror index [100] is used, it is preferred that a occupying rate of the [100] face is high on the external surface of the silver halide grains, and this rate is preferably 50% or more, more preferably 70% or more, and especially preferably 80% or more. Besides, the rate of mirror index [100] face can be obtained by T. Tani, J. Imaging Sci., 29, 165 (1985) where absorption dependency of [111] face and [100] face is utilized in the absorption of sensitizing dye.

It is preferred that the silver halide grains are prepared by using low molecular weight gelatin with the average molecular weight of 50,000 or less at the formation of the particles, and in particular it is preferable to use at the nucleus formation of the silver halide grains. The low molecular weight gelatin is preferably one with the average molecular weight of 50,000 or less, preferably from 2,000 to 40,000, and especially preferably from 5,000 to 25,000. The average molecular weight of gelatin can be measured by gel filtration chromatography. The low molecular weight gelatin can be obtained by enzymatically decomposing by adding gelatinase to an aqueous solution of gelatin with the average molecular weight of about 100,000 usually used, by hydrolyzing by adding an acid or an alkali to the solution, by thermally decomposing by heating in air or under pressure, by decomposing by sonication or by combining these methods.

A concentration of dispersion medium at the nucleus formation is preferably 5% by mass, and it is preferable to perform at the low concentration of 0.05 to 3.0% by mass.

Further, it is preferred that the compound represented by the following Formula is used for the silver halide grains at the particle formation.

$$YO(CH_2CH_2O)_m(CH(CH_3)CH_2O)_p(CH_2CH_2O)_nY$$

In the formula, Y represents a hydrogen atom, —$SO_3M$ or —CO—B—COOM, M represents a hydrogen atom, an alkali metal atom, an ammonium group or an ammonium group substituted with an alkyl group of 5 or less carbon atoms, B represents a chain or a cyclic group which forms an organic dibasic acid, m and n represent from 0 to 50, respectively, and p represents from 1 to 100.

The polyethyleneoxide compound represented by the above Formula is preferably used as a defoaming agent for remarkable effervescence when photographic emulsion raw materials are stirred and moved such as a step where a gelatin aqueous solution is produced, a step where a water soluble halide and a water soluble silver salt are added to the gelatin solution and a step where the photographic emulsion is coated on the support, upon producing the materials in both embodiments, and the technology using as the defoaming agent is described, for example, in JP-A-44-9497. The polyethyleneoxide compound represented by the above Formula also works as the defoaming agent at the nucleus formation.

The compound represented by the above Formula is preferably used at 1% or less by mass based on the silver, and more preferably is used at from 0.01 to 0.1% by mass.

For the condition at the nucleus formation, it is possible to refer to the method described in the paragraphs of [0079] to [0082] of JP-A-2002-287299.

The silver halide grains used for the present invention may be added to an image formation layer by any methods, and at that time, it is preferred that the silver halide grains are positioned to come close to reducible silver source (organic silver salt).

It is preferred that the silver halide grains are precedently prepared and added to a solution for the preparation of organic silver salt particles in terms of production control because the preparation step of silver halide and the preparation step of organic silver salt particles can be separately treated. But, as described in British Patent No. 1,447,454, the silver halide grains can be produced nearly simultaneously with the production of organic silver salt particles by coexisting a halogen ingredient such as halide ions with the organic silver salt formation ingredients and inpouring the silver ions thereto when the organic silver salt particles are prepared.

Also, it is possible to prepare the silver halide grains by making a halogen-containing compound act to the organic silver salt and by conversion of the organic silver salt. That is, it is possible to make the silver halide forming ingredients act to a solution or dispersion of precedently prepared organic silver salt or a sheet material comprising the organic silver salt and to convert a part of the organic silver salt into photosensitive silver halide.

As silver halide forming ingredients, there are inorganic halogen compounds, onium halides, halogenated hydrocarbons, N-halogen compounds and the other halogen-containing compounds, and specific examples thereof are described in the paragraph [0086] of JP-A-2002-287299.

This way, the silver halide can be also prepared by converting a part of or whole silver in the organic acid silver salt into the silver halide by the reaction of the organic acid silver salt with halogen ions. And, the silver halide grains manufactured by converting a part of these organic silver salts may be combined with the separately prepared silver halide.

For these silver halide grains, both the silver halide grains separately prepared and the silver halide grains by the conversion of organic silver salt are preferably used at from 0.001 to 0.7 mol for 1 mol of the organic silver salt, and more preferably used at from 0.03 to 0.5 mol.

It is preferred that the photosensitive silver halide contains ions of transition metal belonging to 6 to 11 Groups in the periodic table of elements for improving illuminance disobedience. As the above metals, preferred are W, Fe, Co, Ni, Cu, Ru, Rh, Pd, Re, Os, Ir, Pt and Au. These may be used alone, or two or more of the same type or different type metallic complexes may be combined. These metallic ions may be obtained by introducing the metallic salt in the silver halide, and can be introduced into the silver halide in a metallic complex or complex ion form. A content is preferably in the range of $1\times10^{-9}$ mol to $1\times10^{-2}$ mol, and more preferably from $1\times10^{-8}$ to $1\times10^{-4}$. In the present invention, the transit metallic complex or complex ion is preferably one represented by the following Formula.

$$[ML_6]^m$$

In the formula, M represents a transit metal selected from the elements of Groups 6 to 11 in the periodic table of elements, L represents a ligand, and m represents 0, -, 2-, 3- or 4-. Specific examples of the ligand represented by L include halogen ion (fluorine ion, chlorine ion, bromine ion and iodine ion), cyanide, cyanate, thiocyanate, selenocyanate, tellurocyanate, ligands of azide and aquo, nitrosyl, thionitrosyl and the like, and preferably are aquo, nitrosyl and thionitrosyl. When the aquo ligand is present, it is preferable to occupy one or two of the ligands. L may be the same or different.

It is preferred that the compound which provides these metallic ions or complex ions is added at the silver halide particle formation and incorporated in the silver halide grains, and it may be added at any stage of the preparation of silver halide grains, i.e., before and after the nucleus formation, growth, physical maturation, and chemical sensitization, but it is preferable to add at the stage of nucleus formation, growth or physical maturation, it is more preferable to add at the stage of nucleus formation or growth, and in particular preferably it is added at the stage of nucleus formation. When added, the compound may be added by dividing in several times; can be evenly contained in the silver halide grains; and can be contained by possessing a distribution in the particle as described in JP-A-63-29603, JP-A-2-306236, JP-A-3-167545, JP-A-4-76534, JP-A-6-110146 and JP-A-5-273683.

These metallic compounds can be added by dissolving in water or an appropriate solvent (e.g., alcohols, ethers, glycols, ketones, esters, amides). For example, there are the method where an aqueous solution of powder of the metallic compound or an aqueous solution in which the metallic compound and sodium chloride, potassium chloride are dissolved together has been added in a water soluble silver salt solution during the particle formation or a water soluble halide solution, or the method where the metallic compound is added as the third aqueous solution when the silver salt aqueous solution and the halide aqueous solution are simultaneously mixed to prepare the silver halide particle by a three solution simultaneous mixing method, the method where an aqueous solution of a required amount of the metallic compound is put in a reactor during the particle formation, or the method where the other silver halide grains in which the metallic ions or complex ions have been precedently doped are added to dissolve at the preparation of the silver halide. Especially, the method where the aqueous solution of powder of the metallic compound or the aqueous solution in which the metallic compound and sodium chloride, potassium chloride are dissolved together is added to the halide aqueous solution is preferable. When added on the particle surface, the aqueous solution of the required amount of metallic compound can be put in the reactor immediately after the particle formation, during or at the end of the physical maturation, or at the chemical maturation.

Separately prepared photosensitive silver halide grains can be desalted by the desalting methods known in the art such as the noodle method, flocculation method, ultrafiltration method and electric dialysis method, but can be also used without desalting in the photothermographic imaging materials.

Chemical sensitization can be given to the silver halide grains. For example, by the methods disclosed in JP-A-2001-249428, JP-A-2001-249426 and JP-A-2000-112057, a chemical sensitization center (chemical sensitization nucleus) can be formed and imparted using the compound having chalcogen atoms such as sulfur or the noble metal compound which releases noble metal ions such as gold ions. In the present invention, it is especially preferred that the chemical sensitization by the above compound having the chalcogen atom and the chemical sensitization using the noble metal compound are combined.

Also, the photosensitive silver halide is preferred to be chemically sensitized by the compound having the chalcogen atom shown below. It is preferred that these compounds having the chalcogen atom useful as an organic sensitizer are the compounds having a group capable of being absorbed to the silver halide and an unstable chalcogen atomic site.

As these organic sensitizer, it is possible to use the organic sensitizers having various structures disclosed in JP-A-60-150046, JP-A-4-109240 and JP-A-11-218874, and among them, it is preferred that the sensitizer is at least one type of the compounds having the structure where the chalcogen atom is bound to a carbon atom or phosphorus atom by a double bond. Especially preferred are the compounds of the Formula (1-1) and the Formula (1-2) disclosed in JP-A-2002-250984.

An use amount of the chalcogen atom-containing compound as the organic sensitizer varies depending on the chalcogen compound used, the silver halide grains used and a reaction environment upon giving the chemical sensitization, is preferably from $1\times10^{-8}$ to $1\times10^{-2}$ mol, and more preferably from $1\times10^{-7}$ to $1\times10^{-3}$ mol. The chemical sensitization environment of the present invention is not especially limited, but it is preferred that chalcogen sensitization is given using the organic sensitizer having the chalcogen atom in the presence of the compound capable of vanishing or reducing in size chalcogenated silver or silver nucleus on the photosensitive silver halide grains, or in coexistence of an oxidizing agent capable of oxidizing the silver nucleus. As the sensitization condition, pAg is preferably from 6 to 11 (more preferably from 7 to 10), pH is preferably from 4 to 10 (more preferably from 5 to 8), and it is preferred that the sensitization is given at the temperature of 30° C. or below.

Therefore, it is preferred that the chemical sensitization is given to the photosensitive silver halide at the temperature of 30° C. or below using the chalcogen atom-containing organic sensitizer in the coexistence of the oxidizing agent capable of oxidizing silver nuclei on the particles, ant that used is a photosensitive silver halide emulsion which is mixed with the organic silver salt, dispersed, dehydrated and dried.

Also, it is preferred that the chemical sensitization using these organic sensitizers is carried out in the presence of a spectral sensitizing dye or a heteroatom-containing compound having absorbability to the silver halide grains. Dispersion of chemical sensitization center nuclei can be prevented, and high sensitivity and low photographic fog can be achieved by performing the chemical sensitization in the presence of the compound having the absorbability to the silver halide. The spectral sensitizing dye used in the present invention is described below, but the heteroatom-containing compounds having the absorbability to the silver halide include nitrogen-containing heterocyclic compounds described in JP-A-3-24537.

In the nitrogen-containing heterocyclic compounds used for the present invention, heterocyclic rings can include pyrazole ring, pyrimidine ring, 1,2,4-triazole ring, 1,2,3-triazole ring, 1,3,4-thiaziazole ring, 1,2,3-thiaziazole ring, 1,2,4-thiaziazole ring, 1,2,5-thiaziazole ring, 1,2,3,4-tetrazole ring, pyridazine ring, 1,2,3-triazine ring, rings where two to three of these rings are bound, e.g., triazolotriazole ring, diazaindene ring, triazaindene ring, pentaazaindene ring and the like. It is possible to apply the heterocyclic rings where a monocyclic heterocyclic ring and an aromatic ring is condensed, such as phthalazine ring, benzimidazole ring, indazole ring, and benzothiazole ring. Among them, preferred are azaindene rings, and more preferable are azaindene compounds having a hydroxyl group as a substituent, e.g., hydroxytriazaindene, hydroxytetraazaindene, hydroxypentaazaindene compounds and the like.

The heterocyclic ring may have substituents other than the hydroxyl group. It may have, for example, alkyl, alkylthio, amino, hydroxyamino, alkylamino, dialkylamino, arylamino, carboxyl, alkoxycarbonyl groups, halogen atoms, cyano group and the like as the substituents.

The addition amount of the heterocyclic compound containing them varies in the wide range depending on the sizes and composition of silver halide grains and the other conditions, and the approximate amount is in the range of $1\times10^{-6}$ mol to 1 mol as the amount per mol of the silver halide, and preferably in the range of $1\times10^{-4}$ mol to $1\times10^{-1}$ mol.

The noble metal sensitization can be given to the silver halide grains by utilizing the compound which releases noble metal ions such as gold ions as described above. For example, as the gold sensitizer, it is possible to use aurichloride salts and organic gold compounds.

Also, reducing sensitization methods can be used in addition to the above sensitization methods. As specific compounds for the reducing sensitization, it is possible to use ascorbic acid, thiourea dioxide, stannous chloride, hydrazine derivatives, boron compounds, silane compounds, polyamine compounds and the like. Also, the reducing sensitization can be carried out by maturing with retaining pH of the photographic emulsion to 7 or more or pAg of the same to 8.2 or less, respectively.

The silver halide given the chemical sensitization in the embodiment may be those formed in the presence of the organic silver salt, those formed in the absence of the organic silver salt, or those where both are mixed.

It is preferred that the spectral sensitization is given to the photosensitive silver halide grains by making spectral sensitizing dye absorb. As the spectral sensitizing dye, it is possible to use cyanine dye, merocyanine dye, complex cyanine dye, complex-merocyanine dye, holopolar cyanine dye, styryl dye, hemicyanine dye, oxonol dye, hemioxonol dye and the like. For example, it is possible to use the sensitizing dyes described in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175, 4,835,096 and JP-A-2001-83659. The useful sensitizing dyes used for the present invention are for example described in the references described or cited in RD17643IV-A section (December in 1978, page 23) and RD18431 X section (August in 1978, page 437). Especially it is preferable to use the sensitizing dye having spectral sensitivity suitable for spectral property of various laser imager and scanner light sources. For example, preferably used are the compounds described in JP-A-9-34078, JP-A-9-54409 and JP-A-9-80679.

Useful cyanine dyes are, for example, the cyanine dyes having basic nuclei such as thiazoline nucleus, oxazoline nucleus, pyrroline nucleus, pyridine nucleus, oxazole nucleus, thiazole nucleus, selenazole nucleus and imidazole nucleus. Useful merocyanine dyes and preferable ones include acidic nuclei such as thiohydantoin nucleus, rhodanine nucleus, oxazolidine dione nucleus, thiazolinedione nucleus, barbituric acid nucleus, thiazolinone nucleus, malononitrile nucleus and pyrazolone nucleus in addition to the above basic nuclei.

In the embodiment, it is preferable to use the sensitizing dye especially having spectral responsivity in an infrared area. In the present invention, infrared spectral sensitizing dyes preferably used include the infrared spectral sensitizing dyes disclosed, for example, in U.S. Pat. Nos. 4,536,473, 4,515,888 and 4,959,294.

Concerning the infrared spectral sensitizing dyes used in the embodiment, especially preferred are long chain polymethine dyes characterized in that a sulfinyl group is substituted on a benzene ring of a benzazole ring. The above infrared spectral sensitizing dyes can be readily synthesized by the method, for example, described in F. M. Harmer, The Chemistry of Heterocyclic Compounds, Vol. 18, The Cyanine Dyes and Related Compounds (edited by A. Weissberger, published by Interscience, New York, 1964).

An addition time of these infrared spectral sensitizing dyes may be anytime after the preparation of the silver halide, and for example, they can be added by adding in a solvent or in so-called solid dispersion state by dispersing in a particulate form, to the photosensitive photographic emulsion containing the silver halide grains or the silver halide grains/organic silver salt particles. Also, as is the case with the heteroatom-containing compound having the absorbability to the silver halide grains, prior to the chemical sensitization, after adding to the silver halide grains and making absorb thereto, the chemical sensitization can be also given. This can prevent the dispersion of chemical sensitization center nuclei and can achieve high sensitivity and low photographic fog.

The above infrared spectral sensitizing dyes may be used alone or in combination thereof, and the combination of sensitizing dyes is often used especially for the purpose of strong color sensitization.

In the photographic emulsion containing the silver halide grains or the organic silver salt particles used in the embodiment, along with the sensitizing dye, a dye which per se has no spectral sensitizing action or a substance which does not substantially absorb visible light and which expresses a strong color sensitizing effect is included in the photographic emulsion, and this may perform strong color sensitization of the silver halide grains.

Useful sensitizing dyes, the combination of dyes which exhibit the strong color sensitization and the substance exhibiting the strong color sensitization are described in RD 17643 (issued in December, 1978) page 23 IV J section, or JP-B-9-2550, JP-B-43-4933, JP-A-59-19032, JP-A-59-192242, JP-A-5-341432 and JP-A-2001-83659. In the present invention, as the Supersensitizers, preferred are heterocyclic aromatic mercapto compounds represented by the following Formula or mercapto derivative compounds.

Ar—SM

In the formula, M is a hydrogen atom or an alkali metal atom, Ar is a heterocyclic aromatic ring or condensed aromatic ring having one or more nitrogen, oxygen, selenium, or tellurium atoms. Preferable heterocyclic aromatic rings or condensed aromatic rings include benzimidazole, naphthimidazole, benzothiazole, naphthothiazole, benzoxazole, naphthoxazole, benzoselenazole, benzotellurazole, imidazole, oxazole, pyrazole, triazole, triazine, pyrimidine, pyridazine, pyrazine, pyridine, purine, quinoline, or quinazoline or the like. However, the other heterocyclic aromatic rings are included.

Besides, the present invention also includes mercapto derivative compounds which substantially produce the above mercapto compounds when contained in the dispersion of the organic acid silver salt or silver halide particle emulsion. Especially, preferable examples include the mercapto derivative compounds represented by the following Formula.

Ar—S—S—Ar

In the formula, Ar is the same as defined in the case of the mercapto compounds represented by the above Formula.

The above heterocyclic aromatic ring or condensed aromatic ring, for example, can have a substituent selected from the group consisting of halogen atoms (e.g., chloride, bromine, iodine), hydroxyl, amino, carboxyl, alkyl groups (e.g., those having one or more carbon atoms, preferably from 1 to 4 carbon atoms), and alkoxy groups (e.g., those having one or more carbon atoms, preferably from 1 to 4 carbon atoms).

Furthermore, the Antifoggant may be included. The effective Antifoggants include, for example, the compounds described in U.S. Pat. Nos. 3,589,903, 3,874,946, 4,546,075, 4,452,885, 4,756,999, JP-A-59-57234, JP-A-9-288328, and JP-A-9-90550. Additionally, as the other Antifoggants, included are the compounds disclosed in U.S. Pat. No. 5,028,523, Europe Patents Nos. 600,587, 605,981 and 631,176.

Also, the heterocyclic aromatic mercapto compound and the heterocyclic aromatic disulfide compound which are the above-mentioned Supersensitizers also exert the effect as the Antifoggant.

In both embodiments, as the Supersensitizer, it is possible to use macrocyclic compounds comprising the compound represented by the Formula (1) disclosed in JP-A-2001-330918 and heteroatoms, in addition to the above Supersensitizers.

It is preferable to use the Supersensitizer at the range of 0.001 to 1.0 mol per 1 mol of the silver in a photographic emulsion layer comprising the organic silver salt and silver halide grains. It is especially preferable to use at the range of 0.01 to 0.5 mol per 1 mol of the silver.

[Reducing Agent]

Hereinafter, described are reducing agents which can be preferably used in the invention.

Examples of the suitable silver reducing agents built-in the material of the embodiment are described in U.S. Pat. Nos. 3,770,448, 3,773,512, 3,593,863, Research Disclosure (hereinafter, sometimes abbreviated as RD) No. 17029 and RD No. 29963, and can be used by appropriately selecting from the silver reducing agents known in the art. When the aliphatic silver carboxylate is used for the organic silver salt, it is possible to use polyphenols where two or more phenol groups are linked via alkylene group or sulfur, especially bisphenols where two or more phenol groups where alkyl (e.g., methyl, ethyl, propyl, t-butyl, cyclohexyl groups, etc) or acyl group (e.g., acetyl, propionyl groups, etc.) substitutes to at least one position adjacent to hydroxy substitution position of the phenol group are linked via alkylene group or sulfur.

As the reducing agents preferably used for the present invention, used are the reducing agent of the Formula (A-1), more preferably a reducing agent represented by the following Formula (A-2), the compound of a Formula (A-4) or a Formula (A-5) and the compound of a Formula (A-3).

(A-1)

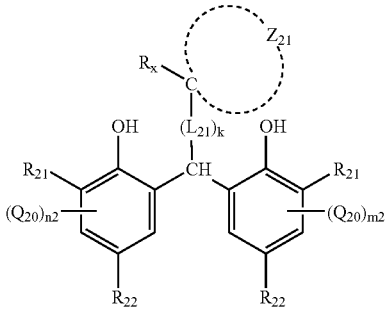

(A-2)

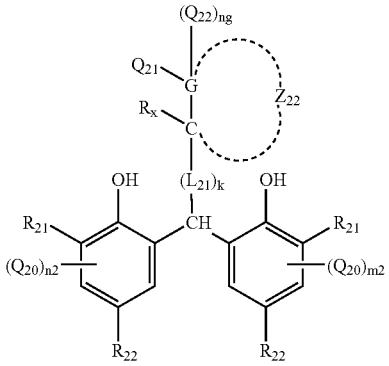

(A-4)

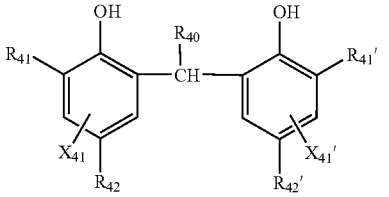

(A-5)

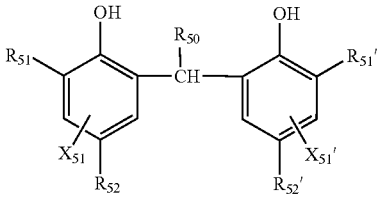

(A-6)

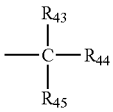

(A-3)

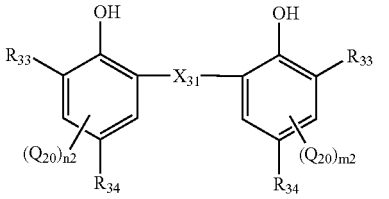

In the Formula (A-1), $Z_{21}$ represents an atomic group required to configure a 3- to 10-membered ring with carbon atoms, and $Z_{21}$ is preferably a 3- to 10-membered non-aromatic ring or a 5- to 6-membered aromatic ring and more preferably a 3- to 10-membered non-aromatic ring. As the rings, specifically, the 3-membered rings include cyclopropyl, aziridil, oxyranyl, the 4-membered rings include cyclobutyl, cyclobutenyl, oxetanyl, and azetidinyl, the 5-membered rings include cyclopentyl, cyclopentenyl, cyclopentadienyl, tetrahydrofuranyl, pyrolidinyl, and tetrahydrothienyl, the 6-membered rings include cyclohexane, cyclohexenyl, cyclohexadienyl, tetrahydropyranyl, pyranyl, piperidinyl, dioxanyl, tetrahydrothiopyranyl, norcaranyl, norpinanyl and norbornyl, the 7-membered rings include cycloheptyl, cycloheptinyl and cycloheptadienyl, the 8-membered rings include cycloctanyl, cyclooctenyl, cyclooctadienyl and cyclooctatrienyl, the 9-membered rings include cyclononanyl, cyclononenyl, cyclononadienyl and cyclononatrienyl, and the 10-membered rings include cyclodecanyl, cyclodecenyl, cyclodecadienyl, cyclodecatrienyl, and the like.

The 3- to 6-membered rings are preferable, the 5- to 6-membered rings are more preferable, the 6-membered rings are most preferable, and among them, hydrocarbon rings containing no heteroatom are preferable. The ring may form a spiro bond with the other ring via spiro atoms, or may be condensed with the other ring including the aromatic rings in any way. Also, the ring can have any substituents on the ring. It is especially preferred that the hydrocarbon ring is the hydrocarbon ring comprising alkenyl or alkynyl structure including —C═C— and —C≡C—.

The substituents specifically include halogen atoms (e.g., fluorine, chlorine, bromine atoms), alkyl groups (e.g., methyl, ethyl, propyl, butyl, pentyl, iso-pentyl, 2-ethylhexyl, octyl, decyl groups, etc.), cycloalkyl groups (e.g., cyclohexyl, cycloheptyl groups, etc.), alkenyl groups (e.g., etenyl-2-propenyl, 3-butenyl, 1-methyl-3-propenyl, 1-methyl-3-butenyl groups, etc.), cycloalkenyl groups (e.g., 1-cycloalkenyl, 2-cycloalkenyl groups, etc.), alkynyl groups (e.g., ethynyl, 1-propinyl groups, etc.), alkoxy groups (e.g., methoxy, ethoxy, propoxy groups, etc.), alkylcarbonyloxy groups (e.g., acetyloxy group, etc.), alkylthio groups (e.g., methylthio, trifluoromethylthio groups, etc.), carboxyl groups, alkylcarbonylamino groups (e.g., acetylamino group, etc.), ureide groups (e.g., methylaminocarbonylamino group, etc.), alkylsulfonylamino groups (e.g., methanesulfonylamino group, etc.), alkylsulfonyl groups (e.g., methanesulfonyl, trifluoromethanesulfonyl groups, etc.), carbamoyl groups (e.g., carbamoyl, N,N-dimethylcarbamoyl, N-morpholinocarbonyl groups, etc.), sulfamoyl groups (e.g., sulfamoyl, N,N-dimethylsulfamoyl, morpholinosulfamoyl groups, etc.), trifluoromethyl, hydroxyl, nitro, cyano groups, alkylsulfoneamide groups (e.g., methanesulfoneamide, butanesulfoneamide groups, etc.), alkylamino groups (e.g., amino, N,N-dimethylamino, N,N-diethylamino groups, etc.), sulfo, phosphono, sulfite, sulfino groups, alkylsulfonylaminocarbonyl groups (e.g., methanesulfonylaminocarbonyl, ethanesulfonylaminocarbonyl groups, etc.), alkylcarbonylaminosulfonyl groups (e.g., acetoamidesulfonyl, methoxyacetoamidesulfonyl groups, etc.), alkynylaminocarbonyl groups (e.g., acetoamidecarbonyl, methoxyacetoamidecarbonyl groups, etc.), alkylsulfinylaminocarbonyl groups (e.g., methanesulfinylaminocarbonyl, ethanesulfinylaminocarbonyl groups, etc.), and the like. When there are two or more substituents, they may be the same or different.

Especially preferable substituents are alkyl groups.

Next, the case where $Z_{21}$ is a 5- to 6-membered aromatic cyclic group is described. The aromatic carbocyclic ring may be monocyclic or condensed cyclic, preferably includes monocyclic or bicyclic aromatic carbocyclic rings with 6 to 30 carbons (e.g., benzene ring, naphthalene ring, etc.), and preferably used is benzene ring. Also, aromatic heterocyclic rings are preferably 5- to 6-membered aromatic heterocyclic rings which may have condensed rings. More preferably they are 5-membered aromatic heterocyclic rings which may have condensed rings. Such heterocyclic rings are preferably imidazole, pyrazole, thiophene, furan, pyrrole, pyridine, pyrimidine, pyrazine, pyridazine, triazole, triazine, indole, indazole, purine, thiadiazole, oxadiazole, quinoline, phthalazine, naphthylidine, quinoxaline, quinazoline, cinnoline, pteridine, acridine, fenantrone, fenadine, tetrazole, thiazole, oxazole, benzimidazole, benzoxazole, benzothiazole, indolenine and tetrazaindene, more preferably imidazole, pyrazole, thiophene, furan, pyrrole, triazole, thiadiazole, tetrazole, thiazole, benzimidazole and benzothiazole, and especially preferably thiophene, furan and thiazole. The above ring may be condensed with the other ring including the aromatic ring in any manner. The ring can have the given substituents on it. The substituents can include the same substituents as the substituents on the 3- to 10-membered non-aromatic cyclic groups mentioned above. When $Z_{21}$ is the 5- to 6-membered aromatic cyclic group, the most preferable is that $Z_{20}$ is the 5-membered aromatic heterocyclic group.

$R_{21}$ and $R_{22}$ represent hydrogen atoms, alkyl, alkenyl, alkynyl, aryl or heterocyclic groups, and it is preferred that the alkyl groups are specifically the alkyl groups with 1 to 10 carbons. Specific examples include methyl, ethyl, propyl, isopropyl, butyl, t-butyl, pentyl, is pentyl, 2-ethyl-hexyl, octyl, decyl, cyclohexyl, cycloheptyl, 1-methylcyclohexyl groups and the like. The alkenyl groups include ethenyl-2-propenyl, 3-butenyl, 1-methyl-3-propenyl, 3-pentenyl, 1-methyl-3-butenyl, 1-cycloalkenyl, 2-cycloalkenyl groups and the like, and the alkynyl groups include ethynyl, 1-propinyl groups and the like. $R_{21}$ includes preferably methyl, ethyl, isopropyl, t-butyl, cyclohexyl, 1-methylcyclohexyl groups and the like, are more preferably methyl, t-butyl and 1-methylcyclohexyl groups, and most preferably t-butyl and 1-methylcyclohexyl groups. $R_{22}$ includes preferably methyl, ethyl, isopropyl, t-butyl, cyclohexyl, 1-methylcyclohexyl, 2-hydroxyethyl groups and the like, and are more preferably methyl and 2-hydroxyethyl. The aryl groups represented by $R_{21}$ and $R_{22}$ include specifically phenyl, naphthyl, anthranil groups and the like. The heterocyclic groups represented by $R_{21}$ and $R_{22}$ include specifically aromatic heterocyclic groups such as pyridine, quinoline, isoquinoline, imidazole, pyrazole, triazole, oxazole, thiazole, oxadiazole, thiadiazole and tetrazole groups, and non-aromatic heterocyclic groups such as pyperidino, morpholino, tetrahydrofuryl, tetrahydrothienyl and tetrahydropyranyl groups. These groups may further have substituents. The substituents can include the substituents on the rings mentioned above.

In the most preferable combination of $R_{21}$ and $R_{22}$, $R_{21}$ is a tertiary alkyl group (e.g., t-butyl, 1-methylcyclohexyl, etc.) and $R_{22}$ is a primary alkyl group (e.g., methyl, 2-hydroxyethyl, etc.).

$R_x$ represents a hydrogen atom or an alkyl group, and as the alkyl group, it is specifically preferable to be the alkyl group with 1 to 10 carbons. Specific examples include methyl, ethyl, propyl, isopropyl, butyl, t-butyl, pentyl, isopentyl, 2-ethyl-hexyl, octyl, decyl, cyclohexyl, cycloheptyl, 1-methylcyclohexyl, etenyl-2-propenyl, 3-butenyl, 1-methyl-3-propenyl, 3-pentenyl, 1-methyl-3-butenyl, 1-cycloalkenyl, 2-cycloalkenyl, ethynyl, 1-propinyl groups and the like. More preferably included are methyl, ethyl isopropyl groups and the like. Preferably $R_x$ is a hydrogen atom.

$Q_{20}$ represents a group capable of being substituted on the benzene ring, and can specifically include alkyl groups with 1 to 25 carbons (e.g., methyl, ethyl, propyl, isopropyl, tert-butyl, pentyl, hexyl, cyclohexyl groups, etc.), halogenated alkyl groups (e.g., trifluoromethyl, perfluorooctyl groups, etc.), cycloalkyl groups (e.g., cyclohexyl, cyclopentyl groups, etc.), alkynyl groups (propargyl group, etc.), glycidyl, acrylate, methacrylate groups, aryl groups (e.g., phenyl group, etc.), heterocyclic ring groups (e.g., pyridyl, thiazolyl, oxazolyl, imidazolyl, furyl, pyrrolyl, pyrazinyl, pyrimidinyl, pyridazinyl, selenazolyl, suliforanyl, piperidinyl, pyrazolyl, tetrazolyl groups, etc.), halogen atoms (chlorine, bromine, iodine, fluorine atoms), alkoxy groups (methoxy, ethoxy, propyloxy, pentyloxy, cyclopentyloxy, hexyloxy, cyclohexyloxy groups, etc.), aryloxy groups (phenoxy group, etc.), alkoxycarbonyl groups (methyloxycarbonyl, ethyloxycarbonyl, butyloxycarbonyl groups, etc.), aryloxycarbonyl groups (phenyloxycarbonyl groups, etc.), sulfonamide groups (methanesulfonamide, ethanesulfonamide, butanesulfonamide, hexanesulfonamide, cyclohexanesulfonamide, benzenesulfonamide groups, etc.), sulfamoyl groups (aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl groups, etc.), urethane groups (methylureide, ethylureide, pentylureide, cyclohexylureide, phenylureide, 2-pyridylureide groups, etc.), acyl groups (acetyl, propionyl, butanoyl, hexanoyl, cyclohexanoyl, benzoyl, pyridinoyl groups, etc.), carbamoyl groups (aminocarbonyl, methyaminocarbonyl, dimethylaminocarbonyl, propylaminocarbonyl, pentylaminocarbonyl, cyclohexylaminocarbonyl, phenylaminocarbonyl, 2-pyridylaminocarbonyl groups, etc.), amide groups (acetamide, propionamide, butanamide, hexanamide, benzamide groups, etc.), sulfonyl groups (methylsulfonyl, ethylsulfonyl, butylsulfonyl, cyclohexylsulfonyl, phenylsulfonyl, 2-pyridylsulfonyl groups, etc.), amino groups (amino, ethylamino, dimethylamino, butylamino, cyclopentylamino, anilino, 2-pyridylamino groups, etc.), cyano, nitro, sulfo, carboxyl, hydroxyl, oxamoyl groups and the like. These groups may be further substituted with these groups. And, n2 and m2 represent an integer of 0 to 2, and most preferably both n2 and m2 are 0.

$L_{21}$ represents a bivalent linkage group, preferably is an alkylene group such as methylene, ethylene, and propylene, and the number of carbons is preferably from 1 to 20, and more preferably from 1 to 5, and k represents an integer of 0 to 1, and most preferably is the case of k=0.

Next, the compound of the Formula (A-2) is described.

In the Formula (A-2), $Q_{21}$ represents a halogen atom, an alkyl, aryl or hetero ring group, $Q_{22}$ represents a hydrogen atom, a halogen atom, an alkyl, aryl or hetero ring group, and the halogen atoms specifically include chlorine, bromine, fluorine and iodine. Preferably it is fluorine, chlorine or bromine. As the alkyl group, specifically it is preferable to be the alkyl group with 1 to 10 carbons. Specific examples include methyl, ethyl, propyl, isopropyl, butyl, t-butyl, pentyl, iso-pentyl, 2-ethyl-hexyl, octyl, decyl, cyclohexyl, cycloheptyl, 1-methylcyclohexyl, etenyl-2-propenyl, 3-butenyl, 1-methyl-3-propenyl, 3-pentenyl, 1-methyl-3-butenyl, 1-cycloalkenyl, 2-cycloalkenyl, ethynyl, 1-propinyl groups and the like. More preferably, they are methyl and ethyl groups. The aryl groups specifically include phenol and naphthyl groups. The hetero ring groups preferably include 5- to 6-memberd hetero aromatic groups such as pyridyl, furyl, thienyl and oxazolyl groups. G represents a nitrogen or carbon atom, and is preferably a carbon atom, and ng represents 0 or 1 and is preferably 1.

$Q_{21}$ is most preferably a methyl group, $Q_{22}$ is preferably a hydrogen atom or a methyl group and most preferably a hydrogen atom.

$Z_{22}$ represents a carbon atom and an atomic group required for configuring a 3- to 10-membered non-aromatic ring together with G, and the 3- to 10-membered non-aromatic ring is the same as defined in the Formula (A-1) described above.

$R_{21}$, $R_{22}$, $R_x$, $Q_{20}$, k, n2 and m2 are the same as defined in the Formula (A-1).

Next, the reducing agents represented by the Formula (A-4) or (A-5) are described.

In the Formula (A-4), $R_{40}$ represents the compound represented by the Formula (A-6), and $R_{43}$ to $R_{45}$ each represent a hydrogen atom or a substituent. The substituents represented by $R_{43}$ to $R_{45}$ include, for example, alkyl groups (methyl, ethyl, propyl, isopropyl, cyclopropyl, butyl, isobutyl, sec-butyl, t-butyl, cyclohexyl, 1-methyl-cyclohexyl groups, etc.), alkenyl groups (vinyl, propenyl, butenyl, pentenyl, isohexenyl, cyclohexenyl, butenylidene, isopentylidene groups, etc.), alkynyl groups (ethynyl, propinylidene groups, etc.), aryl groups (phenyl, naphthyl groups, etc.), hetero ring groups (furyl, thienyl, pyridyl, tetrahydrofuranyl groups, etc.), halogen, hydroxyl, alkoxy, aryloxy, acyloxy, sulfonyloxy, nitro, amino, acylamino, sulfonylamino, sulfonyl, carboxy, alkoxycarbonyl, aryloxycarbonyl, carbamoyl, sulfamoyl, cyano, sulfa groups and the like.

When C in the Formula (A-6) does not form a ring along with any of $R_{43}$ to $R_{45}$, $R_{40}$ comprises at least one ethylene group which may be substituted (2,6-dimethyl-5-heptenyl, 1,5-dimethyl-4-hexenyl, etc.) or acetylene group which may be substituted (1-propinyl, etc.).

When C in the Formula (A-6) forms a ring (phenyl, naphthyl, furyl, thienyl, pyridyl, cyclohexyl, cyclohexenyl, etc.) along with any of $R_{43}$ to $R_{45}$, $R_{40}$ comprises at least one ethylene group (vinyl, propenyl, acryloxy, methacryloxy, etc.) which may be substituted or acetylene group (ethynyl, acetylenecarbonyloxy, etc.) out of this ring.

$R_{41}$, $R_{41}'$, $R_{42}$, $R_{42}'$, $X_{41}$ and $X_{41}'$ each represent a hydrogen atom or a substituent, and the substituents include the same groups as the substituents included in the description of $R_{43}$ to $R_{45}$.

$R_{41}$, $R_{41}'$, $R_{42}$ and $R_{42}'$ are preferably alkyl groups, and specifically include the same groups as the alkyl groups included in the description of $R_{43}$ to $R_{45}$.

In the Formula (A-5), $R_{50}$ represents a hydrogen atom or a substituent, and the substituent includes the same groups as the substituents included in the description of $R_{43}$ to $R_{45}$. $R_{50}$ is preferably a hydrogen atom, alkyl, alkenyl, or alkynyl, and more preferably a hydrogen atom or alkyl group.

$R_{51}$, $R_{51}'$, $R_{52}$, $R_{52}'$, $X_{51}$ and $X_{51}'$ each represent a hydrogen atom or a substituent, and the substituents include the same groups as the substituents included in the description of $R_{43}$ to $R_{45}$ in the Formula (A-4).

$R_{51}$, $R_{51}'$, $R_{52}$ and $R_{52}'$ are preferably alkyl, alkenyl and alkynyl groups, and specifically include the same groups as the examples of alkyl, alkenyl and alkynyl groups included in the description of $R_{43}$ to $R_{45}$.

But, at least one of $R_{51}$, $R_{51}'$, $R_{52}$, $R_{52}'$, $X_5$, and $X_{51}'$ comprises an ethylene group which may be substituted (vinyl, ally, methacryloxymethyl, etc.) or an acetylene group which may be substituted (ethynyl, propargyl, propargyloxycarbonyloxymethyl, etc.).

Next, the compound represented by the Formula (A-3) is described.

In the Formula (A-3), $X_{31}$ represents a chalcogen atom or CHR. The chalcogen atom is sulfur, selenium or tellurium, and preferably sulfur atom. R in CHR represents a hydrogen, halogen atom, an alkyl or alkenyl group. The halogen atom is fluorine, chlorine, or bromine atom, and as the alkyl group, preferred is the substituted or unsubstituted alkyl group with 1 to 20 carbon atoms. Specific examples of the alkaly group are methyl, ethyl, propyl, butyl, hexyl, cyclohexyl, heptyl and the like. Specific examples of the alkenyl groups are vinyl, allyl, butenyl, hexenyl, hexadienyl, ethenyl-2-propenyl, 3-butenyl, 1-methyl-3-propenyl, 3-pentenyl, 1-methyl-3-butenyl and the like.

These groups may further have substituents, and the substituents specifically include halogen atoms (fluorine, chlorine, bromine, etc.), alkyl groups (methyl, ethyl, propyl, butyl, pentyl, i-pentyl, 2-ethylhexyl, octyl, decyl, etc.), cyclohexyl groups (cyclohexyl, cycloheptyl, etc.), alkenyl groups (ethenyl-2-propenyl, 3-butenyl, 1-methyl-3-propenyl, 3-pentenyl, 1-methyl-3-butenyl, etc.), cycloalkenyl groups (1-cycloalkenyl, 2-cycloalkenyl, etc.), alkynyl groups (ethynyl, 1-propinyl, etc.), alkoxy groups (methoxy, ethoxy, propoxy, etc.), alkylcarbonyloxy groups (acetyloxy, etc.), alkylthio groups (methylthio, trifluoromethylthio, etc.), carboxyl groups, alkylcarbonylamino groups (acetylamino, etc.), ureido groups (methylaminocarbonylamino, etc.), alkylsulfonylamino groups (methanesulfonylamino, etc.), alkylsulfonyl groups (methanesulfonyl, trifluoromethanesulfonyl, etc.), carbamoyl groups (carbamoyl, N,N-dimethylcarbamoyl, N-morpholinocarbamoyl, etc.), sulfamoyl groups (sulfamoyl, N,N-dimethylsulfamoyl, morpholinosulfamoyl, etc.), trifluoromethyl groups, hydroxyl groups, nitro groups, cyano groups, alkylsulfonamide groups (methanesulfonamide, butanesulfonamide, etc.), alkylamino groups (amino, N,N-dimethylamino, N,N-diethylamino, etc.), sulfo, phosphono, sulfite, sulfino groups, alkylsulfonylaminocarbonyl groups (methanesulfonylaminocarbonyl, ethanesulfonylaminocarbonyl, etc.), alkylcarbonylaminosulfonyl groups (acetoamidesulfonyl, methoxyacetoamidesulfonyl, etc.), alkynylaminocarbonyl groups (acetoamidecarbonyl, methoxyacetoamidecarbonyl, etc.), alkylsulfinylaminocarbonyl groups (methanesulfinylaminocarbonyl, ethanesulfinylaminocarbonyl, etc.) and the like. Also when the substituents are two or more, they may be the same or different. The especially preferable substituents are alkyl groups.

$R_{33}$ represent alkyl groups, which may be the same or different, but at least one is a secondary or tertiary alkyl group. The alkyl groups are preferably those with 1 to 20 carbons, which are substituted or unsubstituted, and specifically include methyl, ethyl, propyl, i-propyl, butyl, i-butyl, t-butyl, t-pentyl (t-amyl), t-octyl, cyclohexyl, cyclopentyl, 1-methylcyclohexyl, 1-methylcyclopropyl groups and the like.

The substituents of the alkyl groups are not especially limited, and include, for example, aryl, hydroxyl, alkoxy, aryloxy, alkylthio, arylthio, acylamino, sulfonamide, sulfonyl, phosphoryl, acyl, carbamoyl, ester groups, halogen atoms and the like. And the substituent may form a saturated ring together with $(Q_{20})_{n2}$ and $(Q_{20})_{m2}$. Both $R_{33}$ are preferably secondary or tertiary alkyl groups, and 2 to 20 carbons are preferable. They are more preferably tertiary alkyl groups, still preferably t-butyl, t-pentyl, 1-methylcyclohexyl, and most preferably t-butyl or 1-methylcyclohexyl.

$R_{34}$ represents a hydrogen atom or a group capable of being substituted on a benzene ring. The groups capable of being substituted on the benzene ring include, for example, halogen atoms such as fluorine, chlorine and bromine, alkyl, aryl, cycloalkyl, alkenyl, cycloalkenyl, alkynyl, amino, acyl, acyloxy, acylamino, sulfonylamino, sulfamoyl, carbamoyl, alkylthio, sulfonyl, alkylsulfonyl, sulfinyl, cyano, heterocyclic groups and the like.

$R_{34}$ has preferably from 1 to 5 carbons and more preferably from 1 to 2 carbons. These groups may further have substituents, and as the substituents, it is possible to use the substituents described in the Formula (A-1). All of $R_{34}$ are preferably alkyl groups with 1 to 20 carbons, and most preferably methyl groups.

As $R_{34}$, preferably included are methyl, ethyl, i-propyl, t-butyl, cyclohexyl, 1-methylcyclohexyl, 2-hydroxyethyl and the like. More preferably $R_{34}$ is methyl or 2-hydroxyethyl.

These groups may further have substituents, and as the substituents, the substituents included in the R can be used. $R_{34}$ is preferably the alkyl group with 1 to 20 carbons having hydroxyl group or the precursor group thereof, and more preferably the alkyl group with 1 to 5 carbons. Most preferably, it is 2-hydroxyethyl. In the most preferable combination of $R_{33}$ and $R_{34}$, $R_{33}$ is tertiary alkyl group (t-butyl, 1-methylcyclohexyl, etc.) and $R_{34}$ is primary alkyl group having hydroxyl group or the precursor group thereof (2-hydroxyethyl, etc.). Multiple $R_{33}$ and $R_{34}$ may be the same or different.

Here, the precursor groups are groups which generate a hydroxyl group, and include acetyloxy groups, benzoyloxy groups and the like. Thus, it is possible to remarkably improve image density by using primary alkyl groups having a hydroxyl group or a precursor group therof as $R_{34}$.

$Q_{20}$ represents a group capable of being substituted on benzene ring, and specifically can include alkyl groups with 1 to 25 carbons (methyl, ethyl, propyl, i-propyl, t-butyl, pentyl, hexyl, cyclohexyl, etc.), alkyl halide groups (trifluoromethyl, perfluorooctyl, etc.), cycloalkyl groups (cyclohexyl, cyclopentyl, etc.), alkynyl groups (propargyl, etc.), glycidyl groups, acrylate groups, methacrylate groups, aryl groups (phenyl, etc.), heterocyclic groups (pyridyl, thiazolyl, oxazolyl, imidazolyl, furyl, pyrrolyl, pyrazinyl, pyrimidinyl, pyridazinyl, selenazolyl, suliforanyl, piperidinyl, pyrazolyl, tetrazolyl, etc.), halogen atoms (chlorine, bromine, iodine, fluorine), alkoxy groups (methoxy, ethoxy, propyloxy, pentyloxy, cyclopentyloxy, hexyloxy, cyclohexyloxy, etc.), aryloxy groups (phenoxy, etc.), alkoxycarbonyl groups (methyloxycarbonyl, ethyloxycarbonyl, butyloxycarbonyl, etc.), aryloxycarbonyl groups (phenyloxycarbonyl, etc.), sulfonamide groups (methanesulfonamide, ethanesulfonamide, butanesulfonamide, hexanesulfonamide, cyclohexanesulfonamide, benzenesulfonamide, etc.), sulfamoyl groups (aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl, etc.), urethane groups (methylureido, ethylureido, pentylureido, cyclohexylureido, phenylureido, 2-pyridylureido, etc.), acyl groups (acetyl, propionyl, butanoyl, hexanoyl, cyclohexanoyl, benzoyl, pyridinoyl, etc.), carbamoyl groups (aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl, etc.), amide groups (acetamide, propionamide, butanamide, hexanamide, benzamide, etc.), sulfonyl groups (methylsulfonyl, ethylsulfonyl, butylsulfonyl, cyclohexylsulfonyl, phenylsulfonyl, 2-pyridylsulfonyl, etc.), amino groups (amino, ethylamino, dimethylamino, butylamino, cyclopentylamino, anilino, 2-pyridylamino, etc.), cyano, nitro, sulfo, carboxyl, hydroxyl, oxamoyl, groups and the like. These groups may be further substituted with these groups. And, n2 and m2 represent integers of 0 to 2, and most preferably both n2 and m2 are 0.

Also, $Q_{20}$ may form a saturated ring together with $R_{33}$ and $R_{34}$. $Q_{20}$ is preferably a hydrogen, halogen atom or an alkyl group, and more preferably the hydrogen atom.

These bisphenol compounds represented by the Formula (A-3) can be easily synthesized by the methods known in earlier technology.

Hereinafter, specific examples of the compounds represented by the Formulas (A-1) to (A-5) of the present invention are listed, but the invention is not limited thereto.

(1-1)

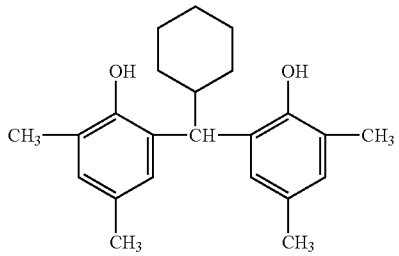

(1-2)

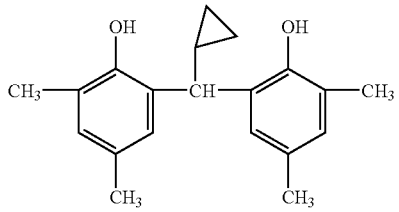

(1-3)

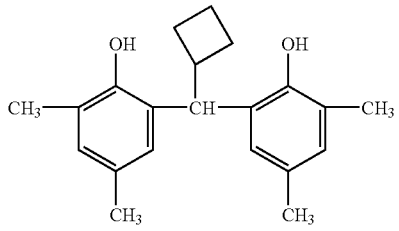

(1-4)

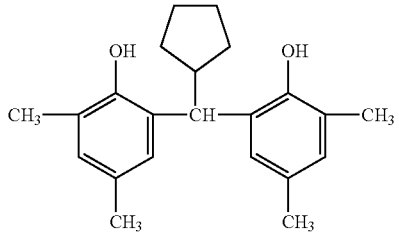

(1-5)

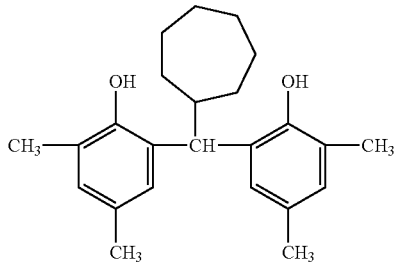

(1-6)

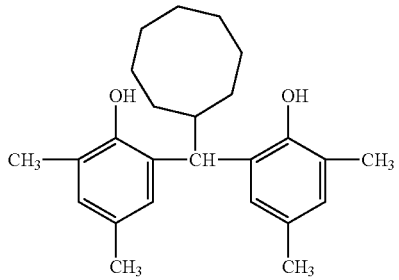

-continued
(1-7)
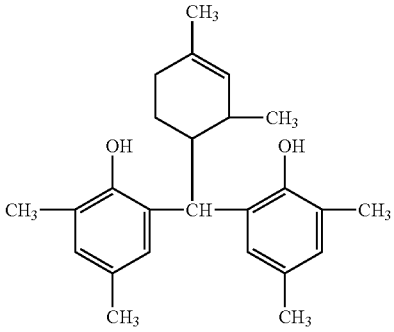
(1-8)
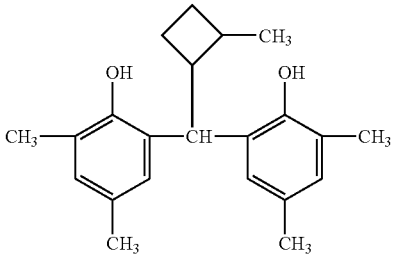
(1-9)
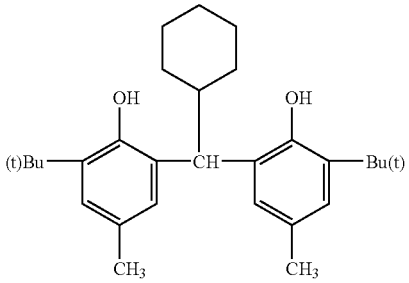
(1-10)
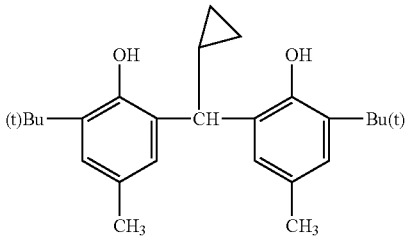
(1-11)
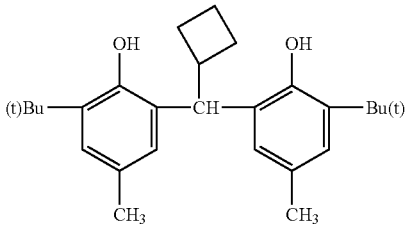
-continued
(1-12)
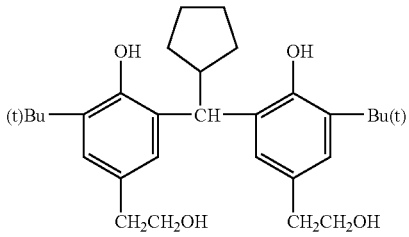
(1-13)
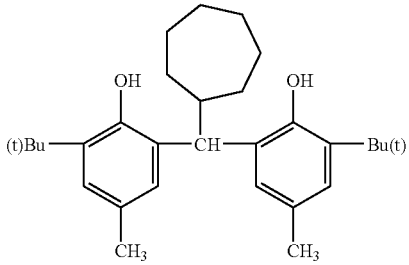
(1-14)
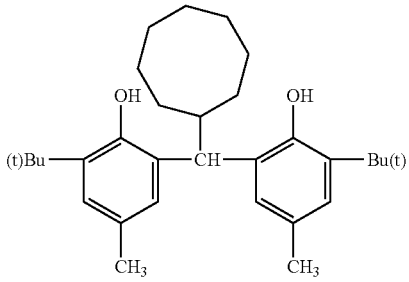
(1-15)
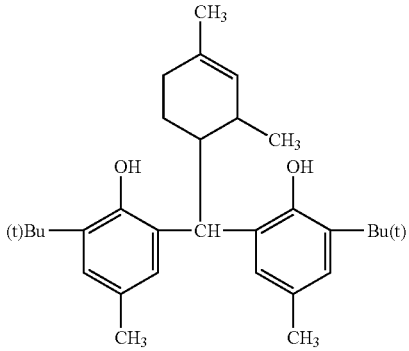
(1-16)
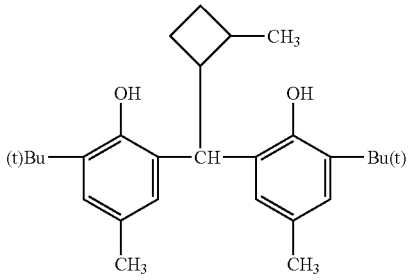

-continued
(1-17)
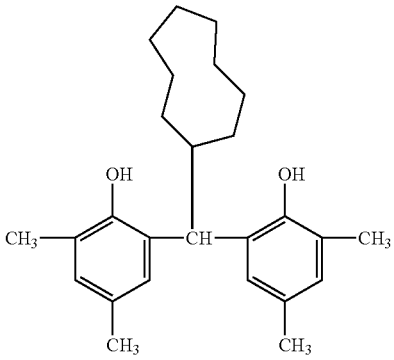
(1-18)
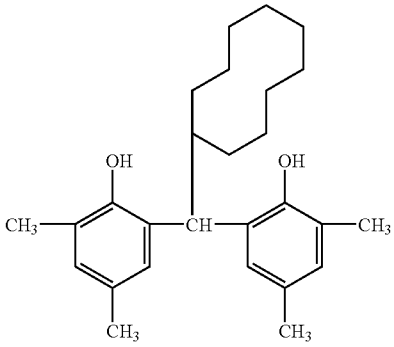
(1-19)
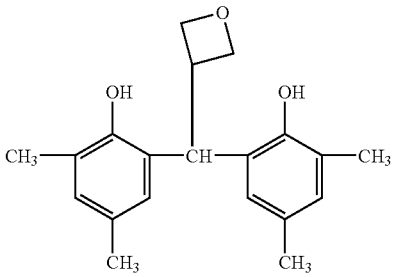
(1-20)
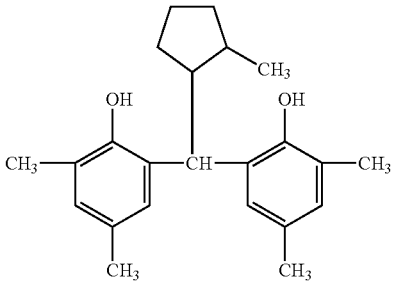
(1-21)
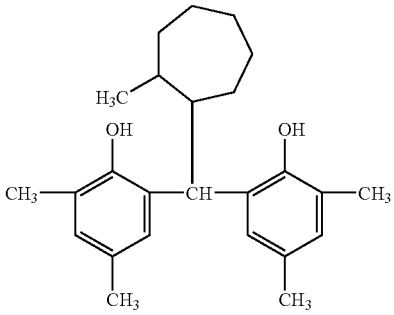
-continued
(1-22)
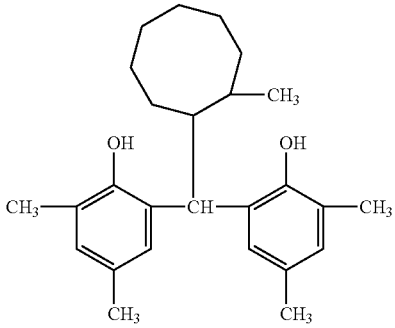
(1-23)
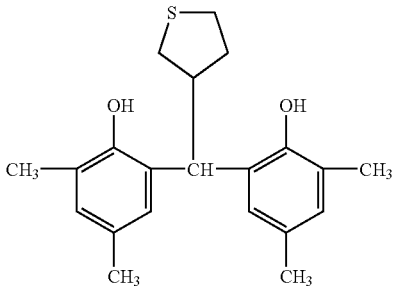
(1-24)
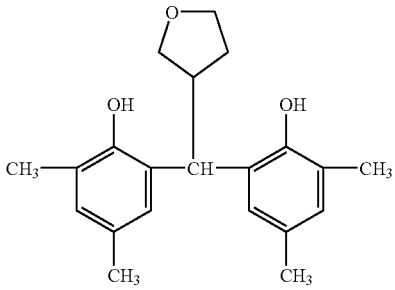
(1-25)
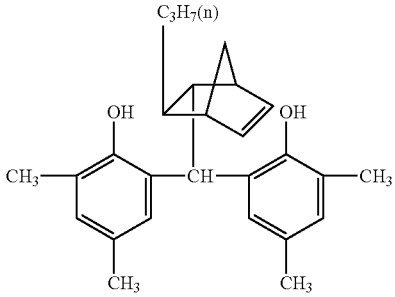
(1-26)
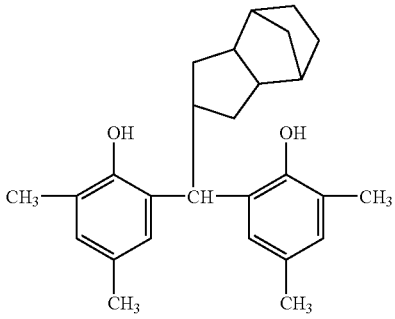

-continued
(1-27)
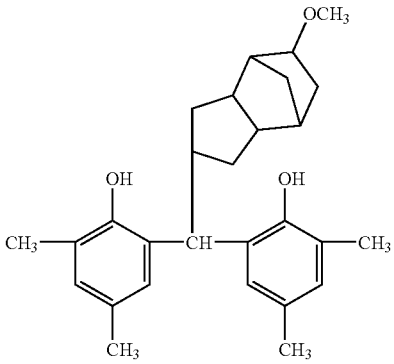
(1-28)
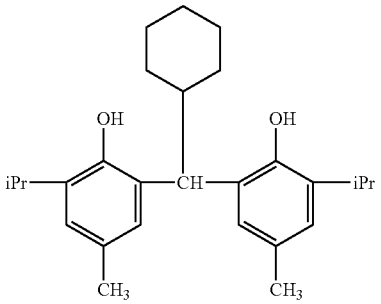
(1-29)
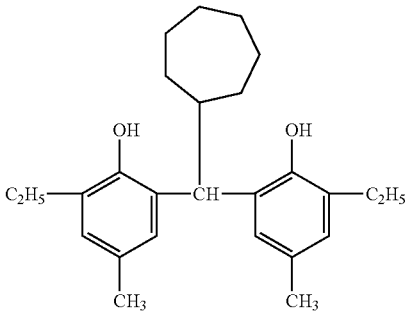
(1-30)
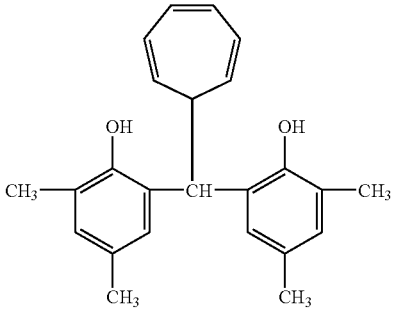
(1-31)
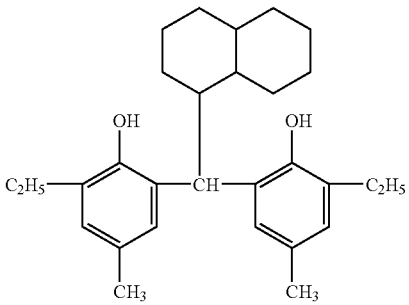
-continued
(1-32)
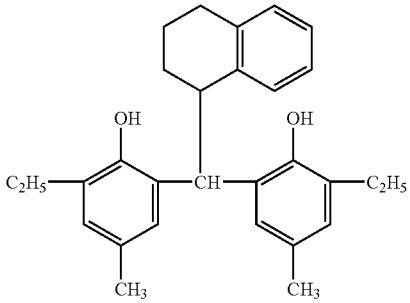
(1-33)
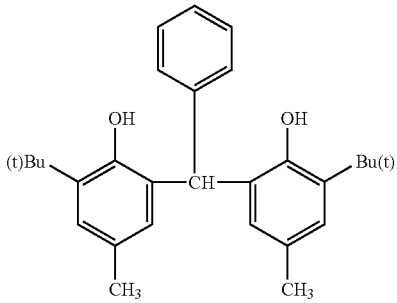
(1-34)
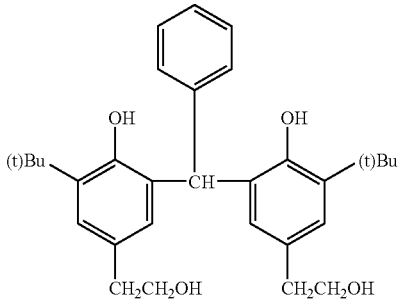
(1-35)
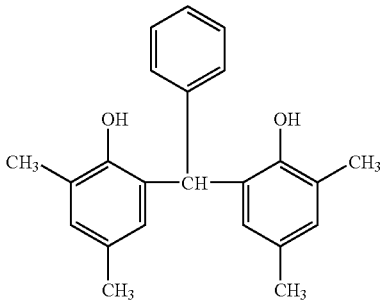
(1-36)
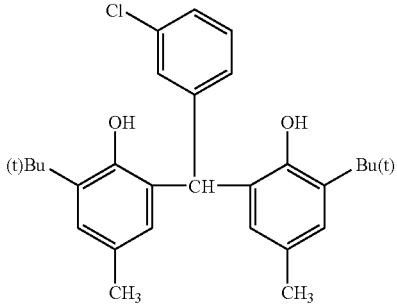

-continued
(1-37)
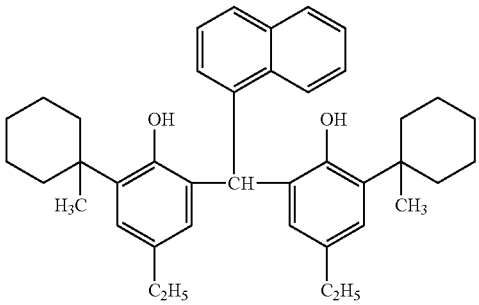
(1-38)
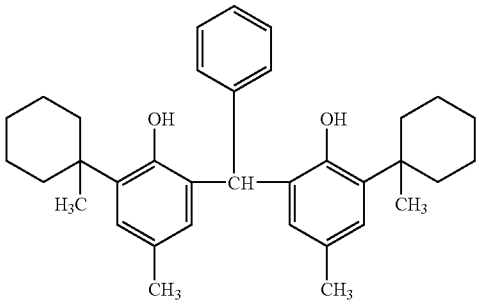
(1-39)
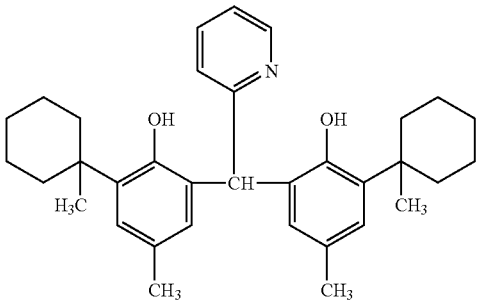
(1-40)
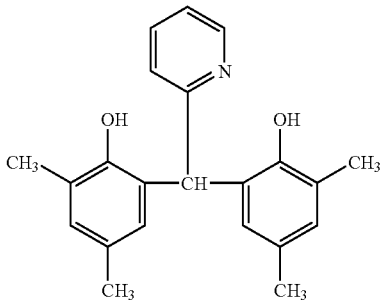
(1-41)
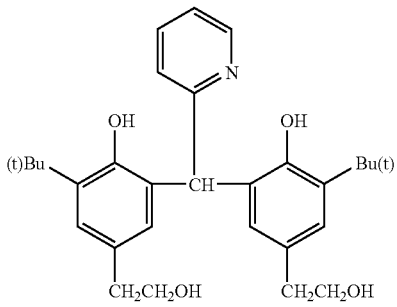
-continued
(1-42)
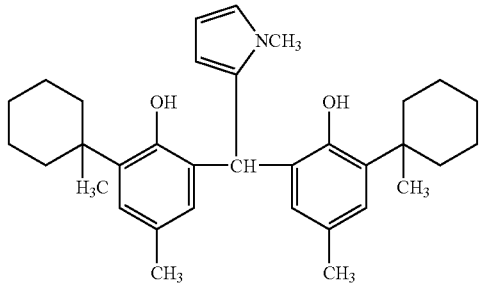
(1-43)
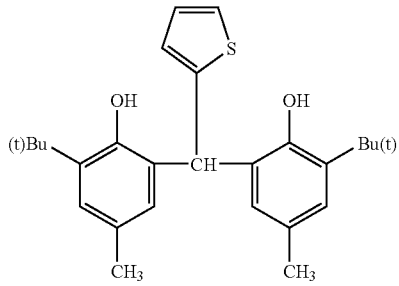
(1-44)
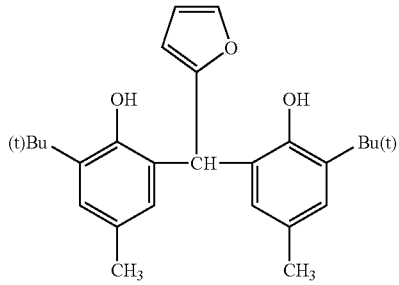
(1-45)
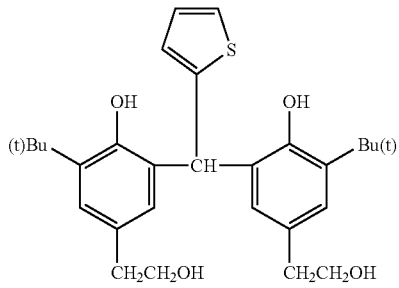
(1-46)
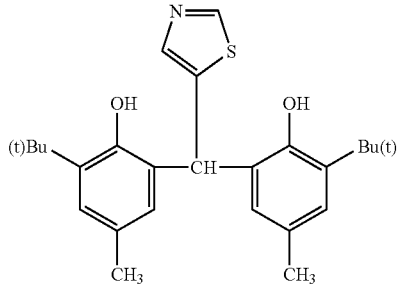

-continued
(1-47)
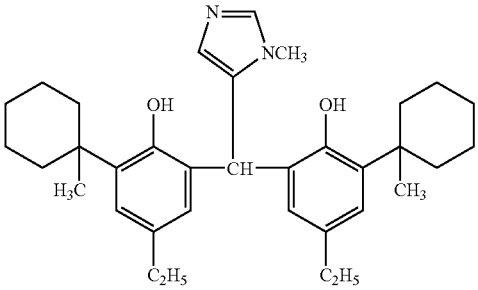
(1-48)
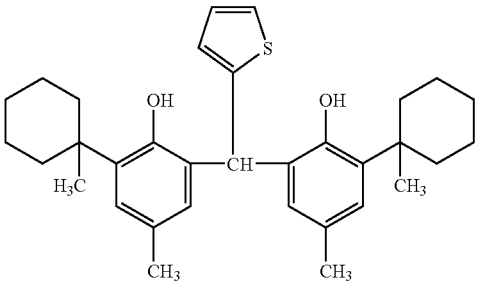
(1-49)
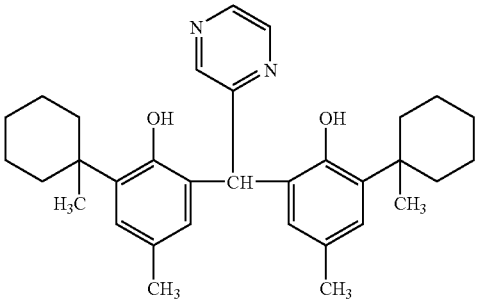
(1-50)
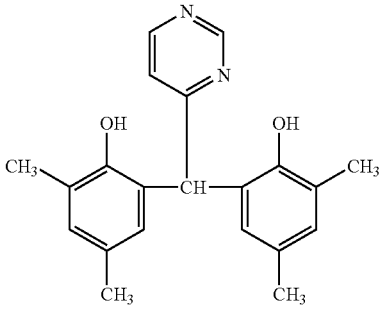
(1-51)
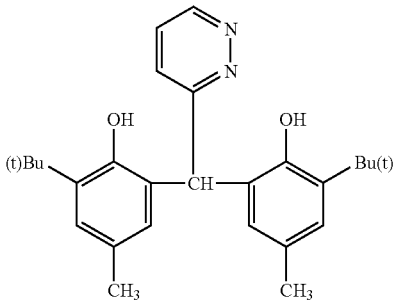
-continued
(1-52)
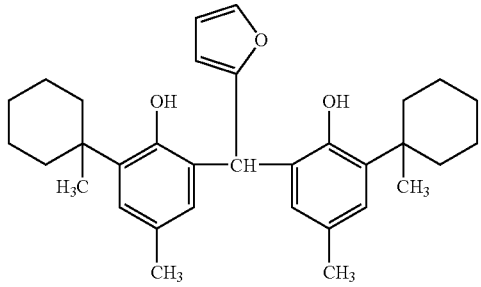
(1-53)
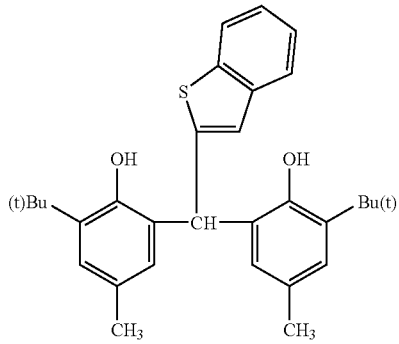
(1-54)
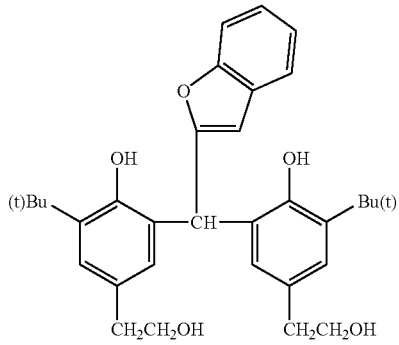
(1-55)
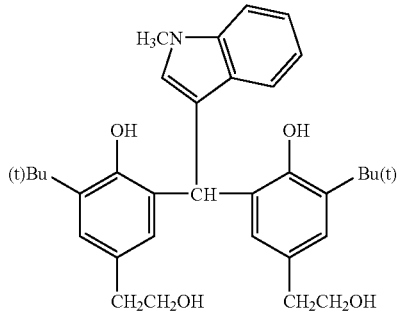

-continued
(1-56)
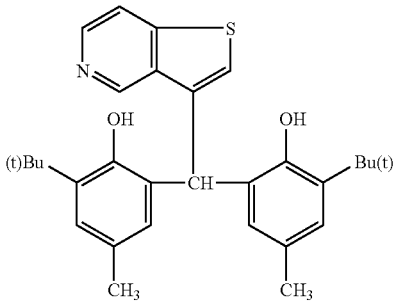
(1-57)
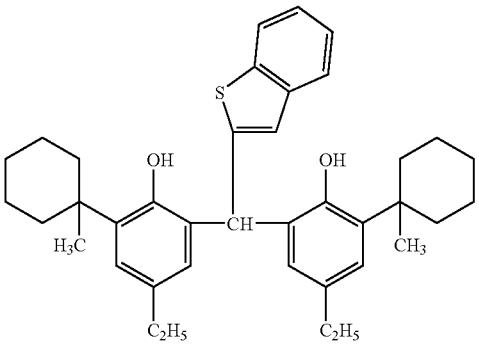
(1-58)
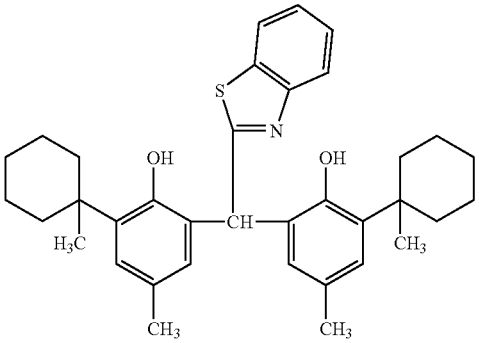
(1-59)
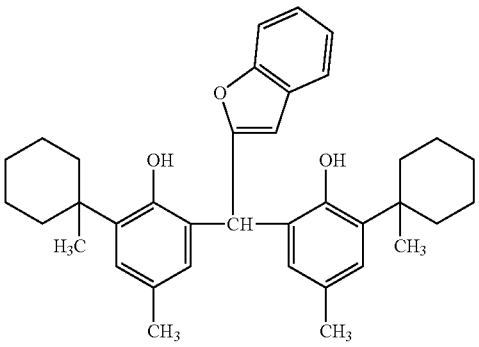
-continued
(1-60)
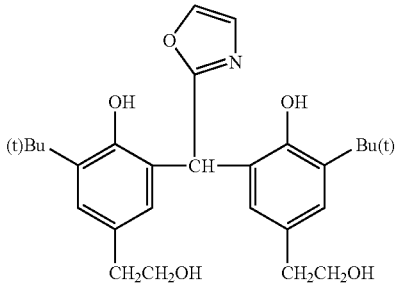
(1-61)
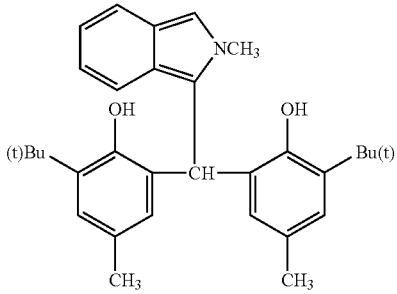
(1-62)
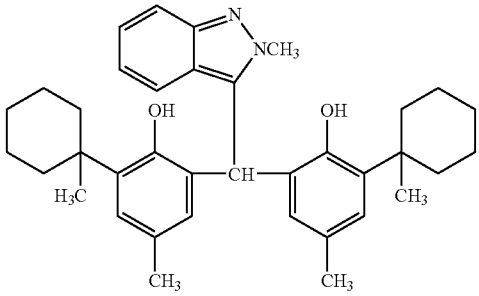
(1-63)
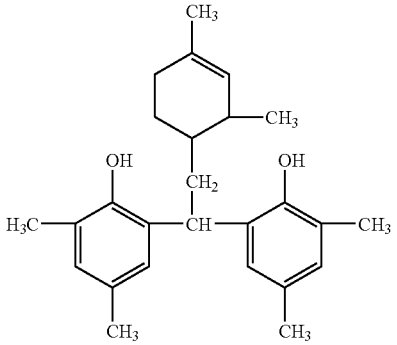
(1-64)
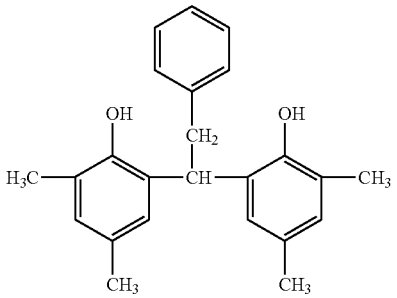

-continued
(1-65)
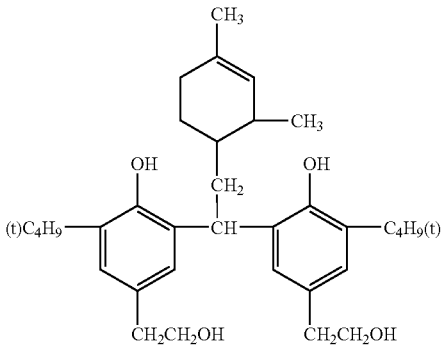
(1-66)
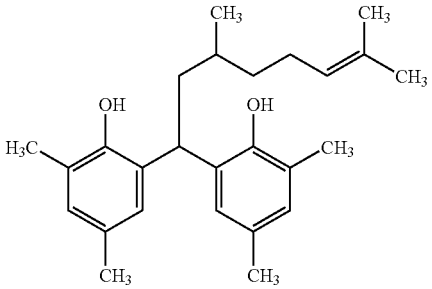
(1-67)
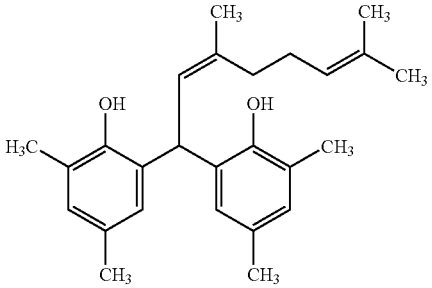
(1-68)
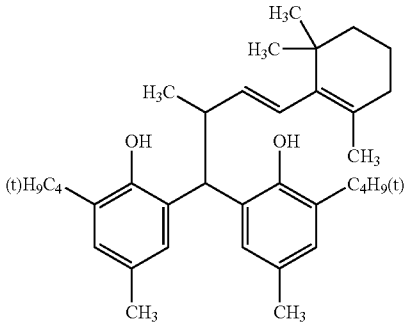
(1-69)
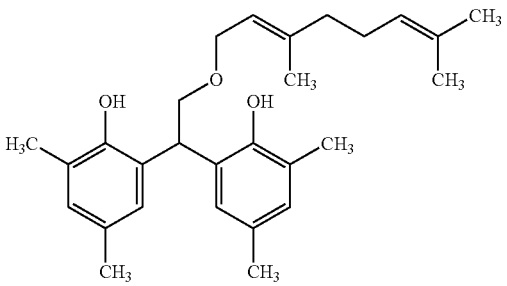
-continued
(1-70)
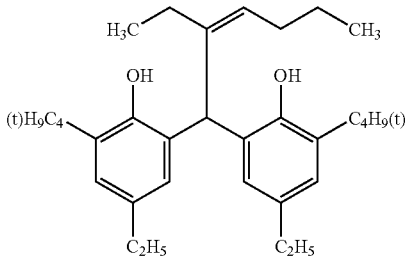
(1-71)
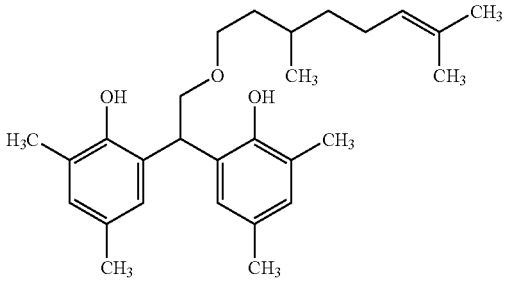
(1-72)
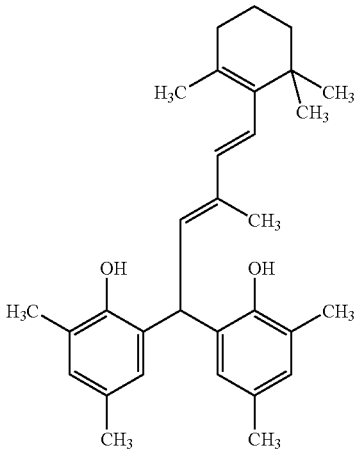
(1-73)
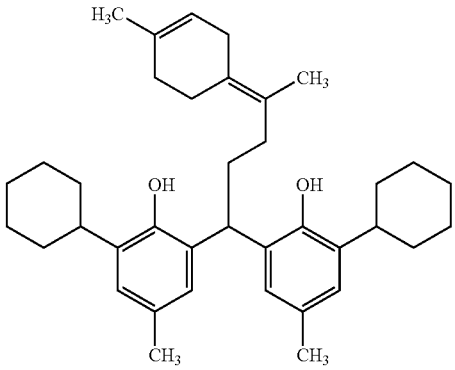

-continued
(1-74)
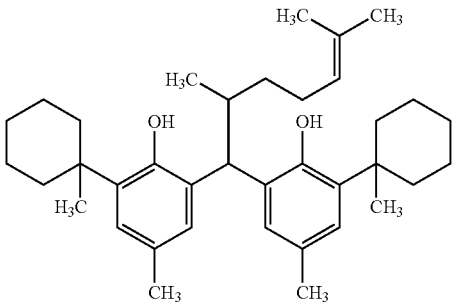
(1-75)
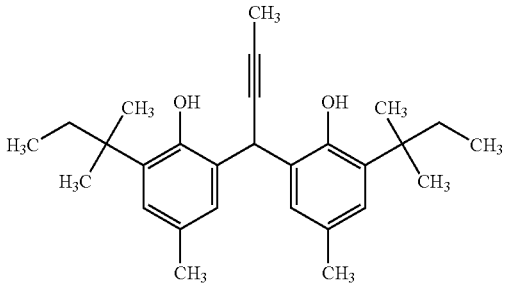
(1-76)
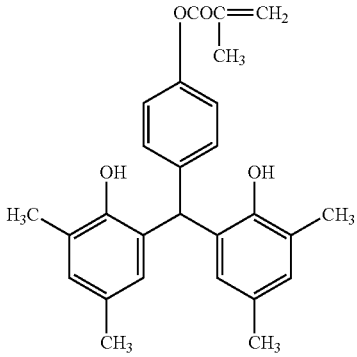
(1-77)
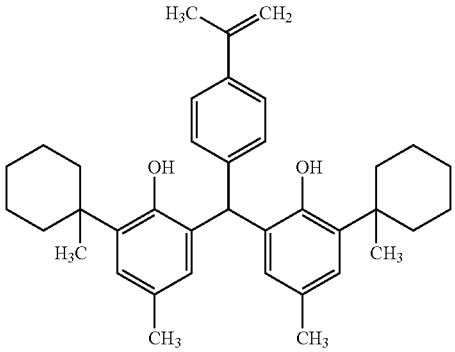
-continued
(1-78)
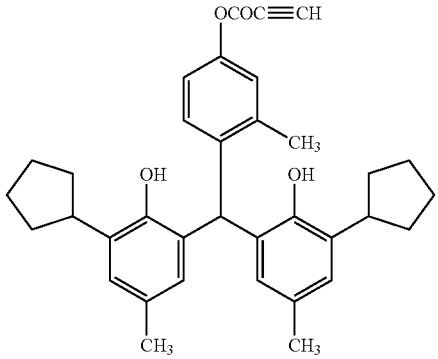
(1-79)
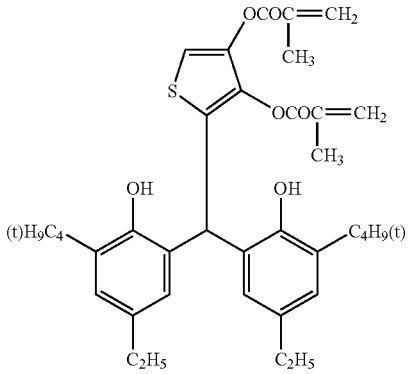
(1-80)
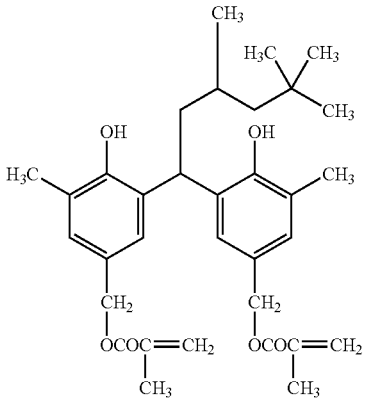
(1-81)
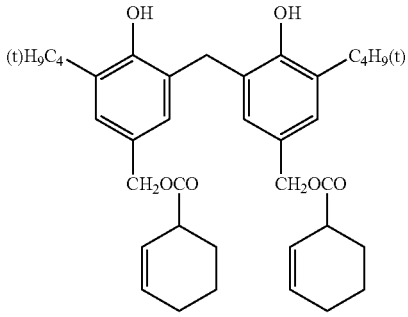

-continued
(1-82)
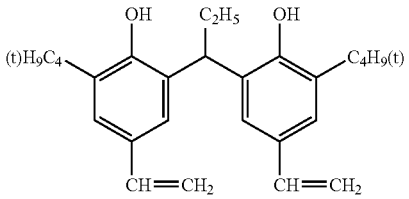
(1-83)
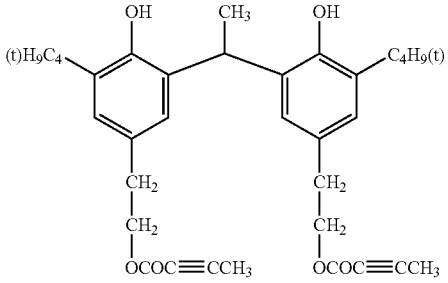
(1-84)
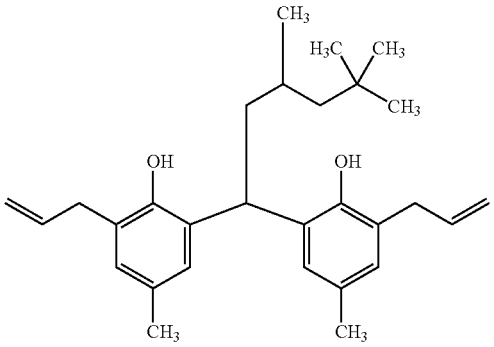
(1-85)
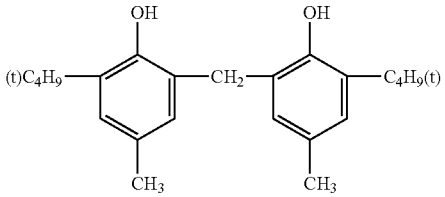
(1-86)
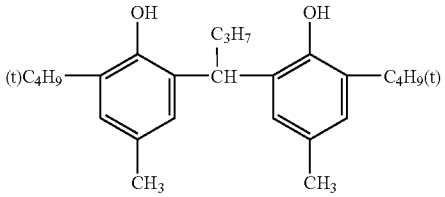
(1-87)
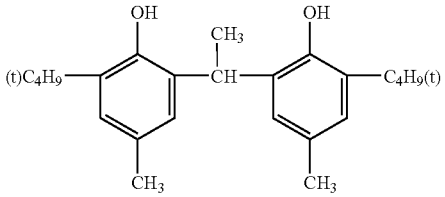
-continued
(1-88)
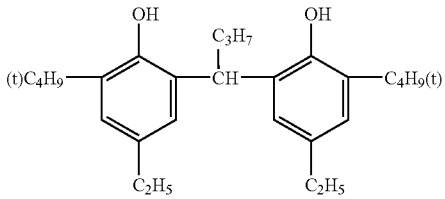
(1-89)
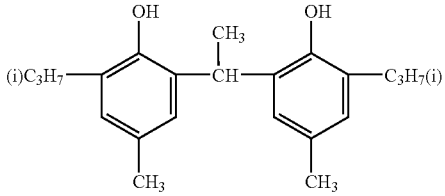
(1-90)
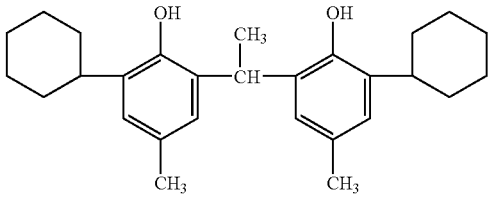
(1-91)
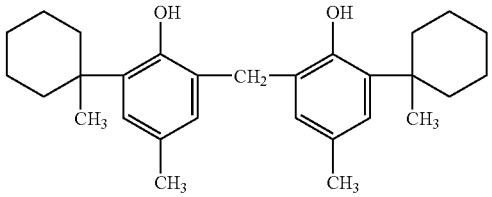
(1-92)
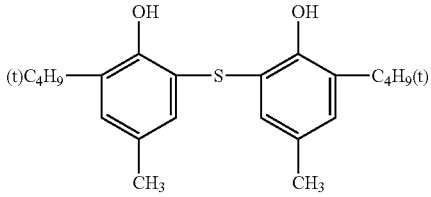
(1-93)
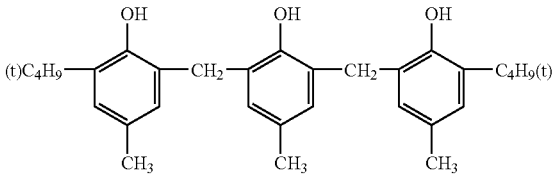
(1-94)
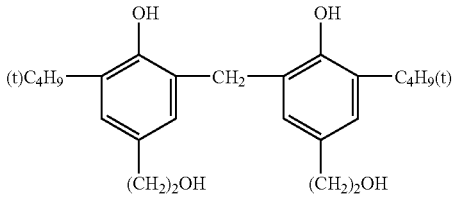

-continued (1-95)

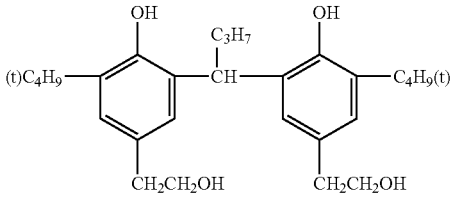

(1-96)

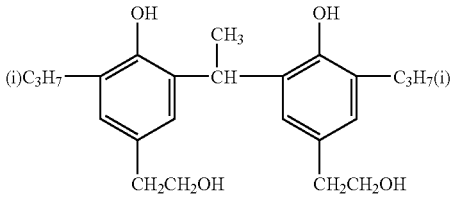

(1-97)

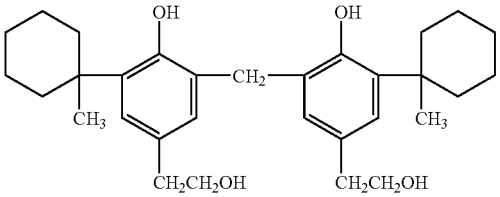

The reducing agents contained in both embodiments are those which reduce the organic silver salt to form silver images. The reducing agents which can be combined with the reducing agent of the present invention are described in, for example, U.S. Pat. Nos. 3,770,448, 3,773,512, and 3,593,863, Research Disclosure (hereinafter, abbreviated as RD) 17029 and 29963, JP-A-11-119372 and JP-A-2002-62616.

The use amount of the reducing agents including the compounds represented by the Formulas (A-1) to (A-5) are preferably from $1\times10^{-2}$ to 10 mol, and especially preferably from $1\times10^{-2}$ to 1.5 mol per 1 mol of the silver.

Further, in the first embodiment, as the reducing agent (silver ion reducing agent), especially as at least one type of the reducing agents, the compound represented by the above Formula (A-3) is used alone or in combination with the other reducing agent having a different chemical structure. By the use of these reducing agents with high activity, it is possible to obtain the photothermographic imaging material with high density which is excellent in light radiated image stability.

Furthermore, in the embodiment, it is preferable to combine the compound of the Formula (A-3) with o-bisphenol compound other than the Formula (A-3). The combination ratio of [mass of the compound of the Formula (A-3)]:[mass of the o-bisphenol compound other than the Formula (A-3)] is preferably from 5:95 to 45:55, and more preferably from 10:90 to 40:60.

Further, in the second embodiment, it is preferable to combine the compound represented by the Formula (A-1) and the compound represented by the following Formula (A-3). A combination ratio is preferably [weight of the Formula (A-1)]:[weight of the Formula (A-3)]=95:5 to 55:45, and more preferably from 90:10 to 60:40.

[Color Tones of Images and Leuco Dye]

Next, described are color tones of the images obtained by thermally developing the materials of the embodiments.

Concerning the color tone of the output images for medical diagnosis such as X-ray films in earlier technology, it is said that more accurate diagnostic observation results of the recorded image are easily obtained for interpreting persons in image tone with cooler tone. Here, it is said that the image tone with cool tone is blue-black tone where pure black or black images take on a blue tinge and that the image tone with warm tone is warm-black tone where black images take on a brown tinge. But, so as to perform more strict and quantitative discussions, the color tones are described below on the basis of the expression recommended by International Commission on Illumination (CIE, Commission Internationale de l'Eclairage).

The terms for the color tones, "cooler tone" and "warmer tone" can be expressed by a hue angle, $h_{ab}$ at the minimum density Dmin and at the optical density D=1.0. That is, the hue angle $h_{ab}$ is obtained by the following formula using color coordinates, a* and b* in a color space, L*a*b* which is the color space with perceptually nearly equal paces, recommended by International Commission on Illumination (CIE) in 1976.

$$h_{ab}=\tan^{-1}(b^*/a^*)$$

As a result of investigating by the expression on the basis of the above hue angle, it has been found that the color tone of the silver salt photothermal photographic imaging material according to the invention after the development is preferably in the range of hue angle $h_{ab}$ of 180 degree<$h_{ab}$<270 degree, more preferably 200 degree<$h_{ab}$<270 degree, and most preferably 220 degree<$h_{ab}$<260 degree. This is disclosed in JP-A-2002-6463.

It has been known in earlier technology that diagnostic images with visually preferable color tone are obtained by adjusting u* and v* or a* and b* at the color space CIE 1976 (L*u*v*) or (L*a*b*) at the optical density of around 1.0 to the certain numerical values, and for example it is described in JP-A-2000-29164.

However, as a result of further intensive study, it has been found to have diagnosability equivalent to or more than that of the wet type silver salt imaging materials in earlier technology by adjusting a linear regression straight line to the certain range when the linear regression straight line is made by plotting u* and v* or a* and b* at various photographic densities on a graph where a horizontal axis is made u* or a* and a vertical axis is made v* or b* in CIE 1976 (L*u*v*) color space or (L*a*b*) color space. The preferable ranges are described below.

(1) It is preferable that a coefficient of determination (multiple determination) $R^2$ of the linear regression straight line is 0.998 to 1.000 when the linear regression straight line is made by measuring each density at the optical density of 0.5, 1.0, 1.5 and the minimum of the silver image obtained after the thermal development processing of the material of the embodiment and disposing u* and v* at the above each optical density on two dimensional coordinates where the horizontal axis is made u* and the vertical axis is made v* of the CIE 1976 (L*u*v*) color space.

Further it is preferred that a v* value of an intersecting point of the linear regression straight line with the vertical axis is −5 to 5 and a slope (v*/u*) is 0.7 to 2.5.

(2) Also, it is preferable that the coefficient of determination (multiple determination) $R^2$ of a linear regression straight line is 0.998 or more and 1.000 or less when the linear regression straight line is made by measuring each density at the optical density of 0.5, 1.0, 1.5 and the minimum of the material and disposing a* and b* at the above each optical density on two dimensional coordinates where the horizontal axis is made a* and the vertical axis is made b* of the CIE 1976 (L*a*b*) color space.

Further, it is preferred that a b* value of an intersecting point of the linear regression straight line with the vertical axis is −5 or more and 5 or less and a slope (b*/a*) is 0.7 or more and 2.5 or less.

Next, described is the method for making the above linear regression straight line, i.e., one example of the method for measuring u*, v* and a*, b* in the CIE 1976 color space.

A four stage wedge sample including an unexposed part and parts of the optical density of 0.5, 1.0 and 1.5 is made using the thermal development apparatus. Each wedge density made in this way is measured using a spectral calorimeter (e.g., CM-3600d supplied from Minolta Co., Ltd.), and u*, v* or a*, b* are calculated. As a measurement condition at that time, a light source is F7 light source, an angle of field is 10°, and the measurement is carried out in a transmission measurement mode. The measured u*, v* or a*, b* are plotted on the graph where the horizontal axis is made u* or a* and the vertical axis is made v* or b* to obtain the linear regression straight line, from which the coefficient of determination (multiple determination) $R^2$, an intercept and the slope are obtained.

Next, described are specific methods for obtaining the linear regression straight line with the above characteristics.

In the embodiment, it is possible to optimize the developed silver shape and make the preferable color tone by regulating the addition amounts of the compounds directly and indirectly involved in the development reaction process, such as the following toning agent, developer, silver halide grains and aliphatic silver carboxylate and the like. For example, when the developed silver shape is made into dendrite, the image is prone to take on a blue tinge and when it is made into filament, the image is prone to take on a yellow tinge. That is, the color tone can be regulated by considering such tendencies of the developed silver shape.

In earlier technology, as the toning agents, phthalazinone or phthalazine and phthalic acids, phthalic acid anhydrides are generally used. Examples of the suitable toning agents are disclosed in RD 17029, U.S. Pat. Nos. 4,123,282, 3,994,732, 3,846,136, 4,021,249 and the like.

In addition to such toning agents, it is also possible to adjust the color tone using the couplers disclosed in JP-A-11-288057 and EP 1134611A2 and leuco dyes described in detail below. Especially, it is preferable to use the leuco dyes for fine adjustment of the color tone.

Hereinafter, the leuco dyes are described.

The leuco dyes of the embodiment serve as image color tone adjusters, could be any colorless or slightly colored compounds which become colored patterns by being oxidized when heated preferably at a temperature of about 80 to 200° C. for 0.5 to 30 sec, and it is possible to use any leuco dyes which are oxidized by the silver ions to form dyestuffs in the invention. Compounds having pH sensitivity and capable of being oxidized to the colored pattern are useful. The representative leuco dyes include, for example, biphenol leuco dye, phenol leuco dye, indoaniline leuco dye, acrylated azine leuco dye, phenoxazine leuco dye, phenodiazine leuco dye and phenothiazine leuco dye and the like. Also, useful are the leuco dyes disclosed in U.S. Pat. Nos. 3,445,234, 3,846,136, 3,994,732, 4,021,249, 4,021,250, 4,022,617, 4,123,282, 4,368,247, 4,461,681, and JP-A-50-36110, JP-A-59-206831, JP-A-5-204087, JP-A-11-231460, JP-A-2002-169249, JP-A-2002-236334 and the like.

In order to adjust to the given color tone, it is preferred that leuco dyes of various colors are used alone or in combination with multiple types. In the invention, the leuco dyes which develop a cyan color are used in order to prevent the color tone from excessively taking on a yellow tinge involved in the use of the reducing agent with high activity and especially prevent the image from excessively taking on a red tinge at high density parts where the density is 2.0 or more, but for the fine adjustment of the color tone, it is preferable to further combine leuco dyes which develop yellow and cyan colors.

It is preferred that coloring density is properly adjusted in association with the color tone of the developed silver per se. In the invention it is preferred that the color is developed to have a reflection optical density of 0.01 to 0.05 or a transmission optical density of 0.005 to 0.03 and the color tone is adjusted to become the image within the preferable color tone described below. As addition methods, it is possible to contain in a coating solution for the photosensitive layer or a coating solution for the layer adjacent thereto to contain in these layers by dispersing in water or dissolving in an organic solvent. The organic solvent can be optionally selected from alcohols such as methanol and ethanol, ketones such as acetone and methylethylketone, aromatic types such as toluene and xylene. The use amount is in the range of $1\times10^{-2}$ to 10 mol, and preferably from $1\times10^{-2}$ to 1.5 mol per 1 mol of the silver.

In the embodiment, those especially preferably used as the cyan coloring leuco dyes are dye image forming agents where absorbance at 600 to 700 nm is increased by being oxidized, JP-A-59-206831 (especially, the compounds where λmax is within the range of 600 to 700 nm), the compounds of the Formulae (I) to (IV) of JP-5-204087 (specifically, the compounds (1) to (18) described in the paragraphs of [0032] to [0037]), and the compounds of the Formulae 4 to 7 of JP-A-11-231460 (specifically, the compounds No. 1 to No. 79) described in the paragraph [0105]).

The cyan coloring leuco dyes especially preferably used in the invention are represented by the following Formula (CL).

(CL)

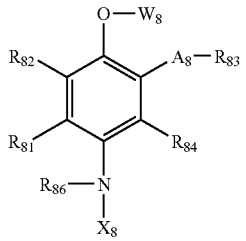

In the formula, $R_{81}$ and $R_{82}$ are hydrogen atoms, halogen atoms, substituted or unsubstituted alkyl, alkenyl, alkoxy and —NHCO—$R_{10}$ groups ($R_{10}$ represents an alkyl, aryl or heterocyclic group), or $R_{81}$ and $R_{82}$ are the groups which are bound one another to form an aliphatic hydrocarbon ring, aromatic hydrocarbon ring or heterocycle. $A_8$ represents —NHCO—, —CONH— or —NHCONH— group, and $R_{83}$ represents a substituted or unsubstituted alkyl, aryl or heterocyclic group. Also, —$A_8$—$R_{83}$ may be a hydrogen atom. $W_8$ represents a hydrogen atom or —CONH—$R_{85}$, —CO—$R_{85}$ or —CO—O—$R_{85}$ group ($R_{85}$ represents a substituted or unsubstituted alkyl, aryl or heterocyclic group.), and $R_{84}$ represents a hydrogen atom, halogen atom, a substituted or unsubstituted alkyl, alkenyl, alkoxy, carbamoyl or nitrile group. $R_{86}$ represents —CONH—$R_{87}$, —CO—$R_{87}$ or —CO—O—$R_{87}$ group ($R_{87}$ represents a substituted or unsubstituted alkyl, aryl or heterocyclic group.). $X_8$ represents a substituted or unsubstituted aryl or heterocyclic group.

In the Formula (CL), as the halogen atoms represented by $R_{81}$ and $R_{82}$, included are for example fluorine, bromine, chlorine atoms and the like. As the alkyl groups represented by $R_{81}$ and $R_{82}$, included are the alkyl groups with up to 20 carbon atoms (e.g., methyl, ethyl, butyl, dodecyl, etc.). As the alkenyl groups represented by $R_{81}$ and $R_{82}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As the alkoxy groups represented by $R_{81}$ and $R_{82}$, included are the alkoxy groups with up to 20 carbon atoms (e.g., methoxy, ethoxy groups, etc.). Also, in —NHCO—$R_{10}$, as the alkyl, aryl and heterocyclic groups represented by $R_{10}$, included are the alkyl groups with up to 20 carbon atoms (e.g., methyl, ethyl, butyl, dodecyl, etc.), the aryl groups with 6 to 20 carbon atoms such as phenyl, naphthyl and thienyl groups, and the heterocyclic groups such as thiophene, furan, imidazole, pyrazole and pyrrole groups, respectively. The alkyl groups represented by $R_{83}$ are preferably the alkyl groups with up to 20 carbon atoms, and for example, included are methyl, ethyl, butyl, dodecyl and the like. The aryl groups represented by $R_{83}$ are preferably the aryl groups with 6 to 20 carbon atoms, and for example, included are phenyl, naphthyl, thienyl groups and the like. As the heterocyclic groups represented by $R_{83}$, included are thiophene, furan, imidazole, pyrazole, pyrrole groups and the like. In —CONH—$R_{85}$, —CO—$R_{85}$ or —CO—O—$R_{85}$ represented by $W_8$, the alkyl groups represented by $R_{85}$ are preferably the alkyl groups with up to 20 carbon atoms, and for example, included are methyl, ethyl, butyl, dodecyl and the like, the aryl groups represented by $R_{85}$ are preferably the aryl groups with 6 to 20 carbon atoms, and for example, included are phenyl, naphthyl, thienyl groups and the like, and as the heterocyclic groups represented by $R_{85}$, included are, for example, thiophene, furan, imidazole, pyrazole, pyrrole groups and the like.

The halogen atoms represented by $R_{84}$, for example, included are fluorine, chlorine, bromine, iodine groups and the like. As the alkyl groups represented by $R_{84}$, for example, included are the chain or cyclic alkyl groups such as methyl, butyl, dodecyl and cyclohexyl groups. As alkenyl groups represented by $R_{84}$, included are the alkenyl groups with up to 20 carbon atoms (e.g., vinyl, allyl, butenyl, hexenyl, hexadienyl, etenyl-2-propenyl, 3-butenyl, 1-methyl-3-propenyl, 3-pentenyl, 1-methyl-3-butenyl, etc.). As alkoxy groups represented by $R_{84}$, for example, included are methoxy, butoxy, tetradecyloxy groups and the like. The carbamoyl groups represented by $R_{84}$, for example, included are diethylcarbamoyl, phenylcarbamoyl groups and the like. Also, nitrile groups are preferable. In these, the hydrogen atom and the alkyl group are more preferable. The above $R_{83}$ and $R_{84}$ may be linked one another to form a cyclic structure.

The above groups can further have a single substituent or multiple substituents. As the typical substituents, included are halogen atoms (e.g., fluorine, chlorine, bromine atoms, etc.), alkyl groups (e.g., methyl, ethyl, propyl, butyl, dodecyl, etc.), hydroxy, cyano, nitro groups, alkoxy groups (e.g., methoxy, ethoxy, etc.), alkylsulfonamide groups (e.g., methylsulfonamide, octylsulfonamide, etc.), arylsulfonamide groups (e.g., phenylsulfonamide, naphthylsulfonamide, etc.), alkylsulfamoyl groups (e.g., butylsulfamoyl, etc.), arylsulfamoyl groups (e.g., phenylsulfamoyl, etc.), alkyloxycarbonyl groups (e.g., methoxycarbonyl, etc.), aryloxycarbonyl groups (e.g., phenyloxycarbonyl, etc.), aminosulfonamide, acylamino, carbamoyl, sulfonyl, sulfinyl, sulfoxy, sulfo, aryloxy, alkoxy, alkylcarbonyl, arylcarbonyl, aminocarbonyl groups and the like.

$R_{10}$ or $R_{85}$ is preferably phenyl group, and more preferably the phenyl group having multiple halogen atoms and cyano groups as the substituents.

In —CONH—$R_{87}$, —CO—$R_{87}$ or —CO—O—$R_{87}$ group represented by $R_{86}$, the alkyl groups represented by $R_{87}$ are preferably the alkyl groups with up to 20 carbon atoms and for example included are methyl, ethyl, butyl, dodecyl groups and the like, the aryl groups represented by $R_{87}$ are preferably the aryl groups with 6 to 20 carbons and for example included are phenyl, naphthyl, thienyl groups and the like, and as the heterocyclic groups represented by $R_{87}$, for example included are thiophene, furan, imidazole, pyrazole and pyrrole groups and the like.

As the substituents which the groups represented by $R_{87}$, it is possible to use those which are the same as the substituents included in the description for $R_{81}$ to $R_{84}$ of the Formula (CL).

The aryl groups represented by $X_8$ include the aryl groups with 6 to 20 carbon atoms such as phenyl, naphthyl and thienyl groups, and the heterocyclic groups represented by $X_8$ include thiophene, furan, imidazole, pyrazole and pyrrole groups and the like.

As the substituents which the groups represented by $X_8$, it is possible to use those which are the same as the substituents included in the description for $R_{81}$ to $R_{84}$ of the Formula (CL). As the groups represented by $X_8$, preferable are the aryl or heterocyclic group having the alkylamino group (diethylamino, etc.) at a para-position. These groups may comprise photographically useful groups.

Specific examples of the cyan coloring leuco dyes (CL) are shown below, but the cyan coloring leuco dye used for the invention is not limited thereto.

(CA-1)

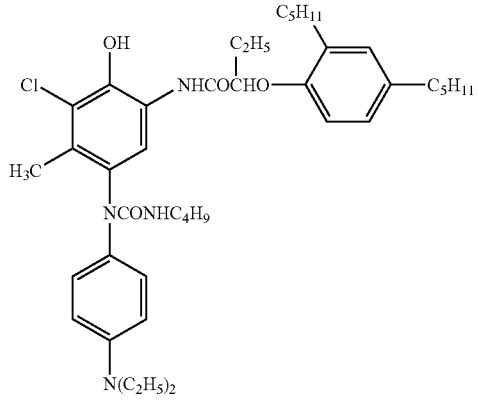

(CA-2)

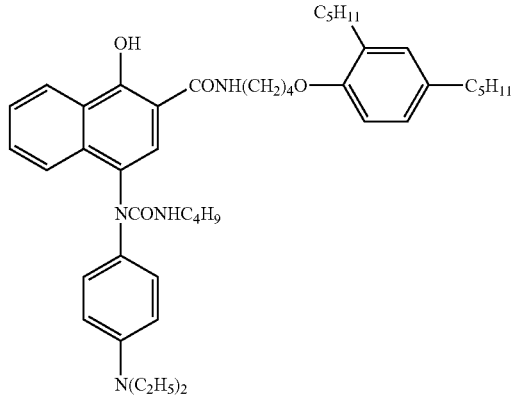

-continued
(CA-3)
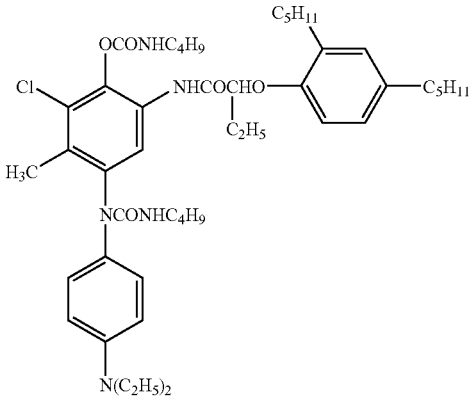
(CA-4)
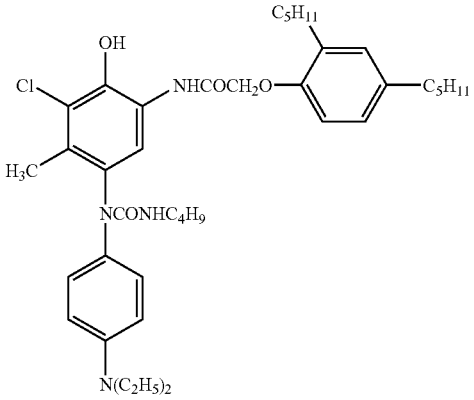
(CA-5)
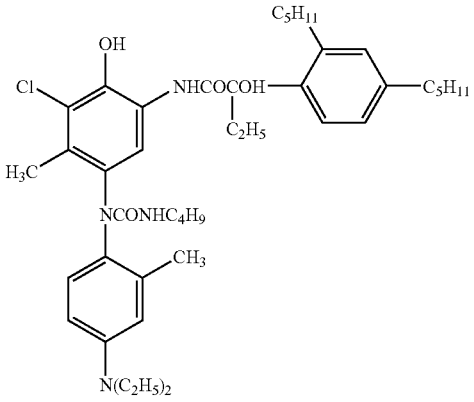
-continued
(CA-6)
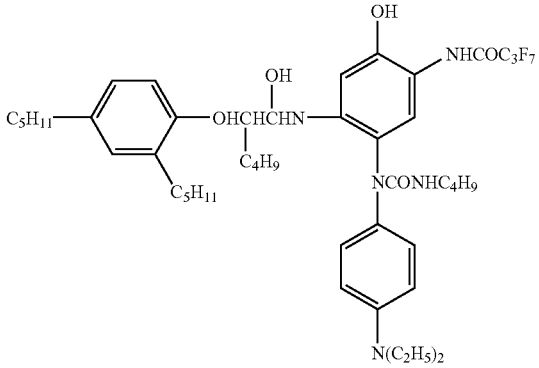
(CA-7)
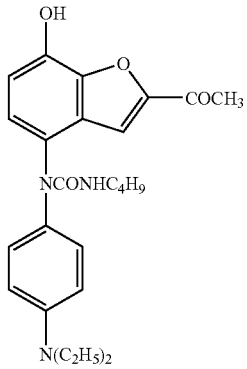
(CA-8)
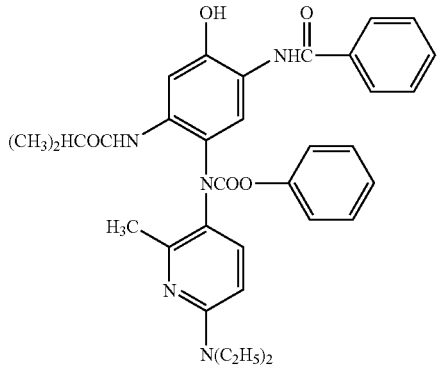
(CA-9)
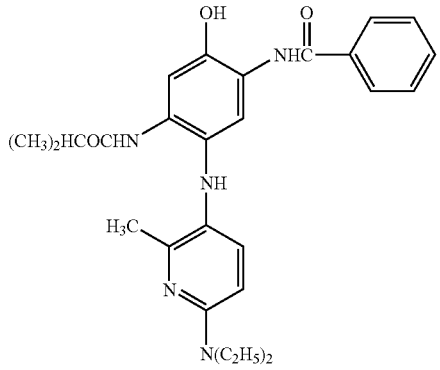

-continued (CA-10)

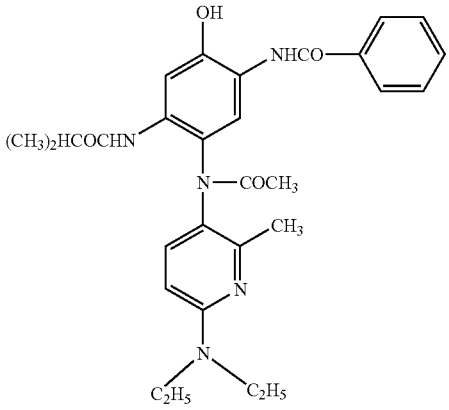

(CA-11)

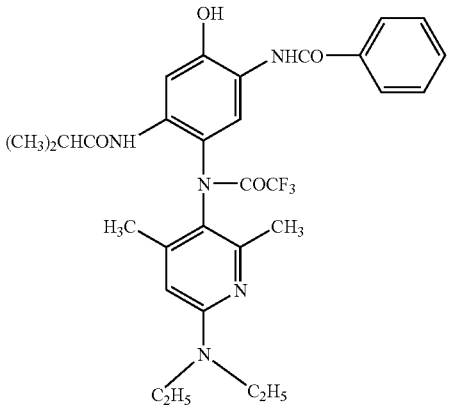

(CA-12)

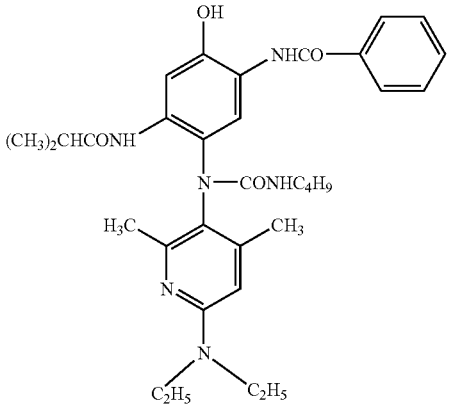

-continued (CA-13)

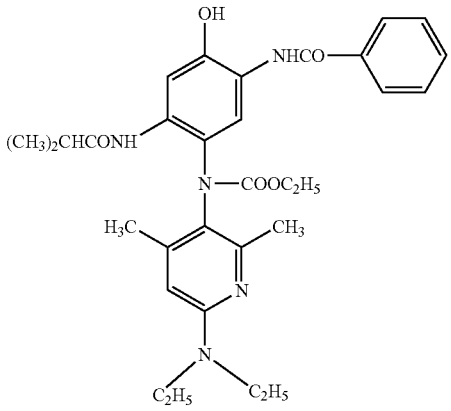

The addition amount of the cyan coloring leuco dye is typically from 0.00001 to 0.05 mol/1 mol of Ag, preferably from 0.0005 to 0.02 mol/1 mol of Ag, and more preferably from 0.001 to 0.01 mol/1 mol of Ag. Also, the addition amount ratio of the cyan coloring leuco dye to the total amount of the reducing agents represented by the Formulas (A-1) to (A-5) is preferably from 0.001 to 0.2 in mol ratio, more preferably, from 0.005 to 0.1. In the invention, a sum total of the maximum density at the maximum absorbance wavelength of dyestuff image formed by the cyan leuco dye is preferably 0.01 or more and 0.50 or less, more preferably 0.02 or more and 0.30 or less, and especially preferably it is preferable to develop color to have a value of 0.03 or more and 0.10 or less.

Further, those used as yellow coloring leuco dyes according to need are dye image forming agents represented by the Formula (YA) where absorbance at 360 to 450 nm is increased by being oxidized. The compounds of the Formula (YA) are described in detail below.

(YA)

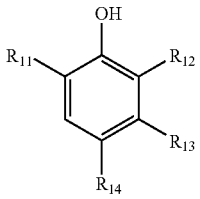

In the Formula (YA), $R_{11}$ represents a substituted or unsubstituted alkyl group, and when $R_{12}$ is a substituent other than hydrogen atom, $R_{11}$ represents an alkyl group. The alkyl group is preferably the alkyl group with 1 to 30 carbons and may have substituents.

Specifically, methyl, ethyl, butyl, octyl, i-propyl, t-butyl, t-octyl, t-pentyl, sec-butyl, cyclohexyl, 1-methyl-cyclohexyl and the like are preferable. The groups which are sterically greater than i-propyl (i-propyl, i-nonyl, t-butyl, t-amyl, t-octyl, cyclohexyl, 1-methyl-cyclohexyl, adamanthyl, etc.) are preferable. Among others, secondary or tertiary alkyl groups are preferable, and t-butyl, t-octyl, t-pentyl and the like which are the tertiary alkyl groups are especially preferable. The substituents which $R_{11}$ may have include halogen atoms, aryl, alkoxy, amino, acyl, acylamino, alkylthio, arylthio, sulfonamide, acyloxy, oxycarbonyl, carbamoyl, sulfamoyl, sulfonyl, phosphoryl groups and the like.

$R_{12}$ represents a hydrogen atom, a substituted or unsubstituted alkyl or acylamino group. The alkyl groups represented by $R_{12}$ are preferably the alkyl groups with 1 to 30 carbons, and the acylamino groups represented by $R_{12}$ are preferably the acylamino groups with 1 to 30 carbons. In these, the description of the alkyl groups is the same as that of the $R_{11}$.

The acylamino groups represented by $R_{12}$ may be unsubstituted or may have substituents, which specifically include acetylamino, alkoxyacetylamino, aryloxyacetylamino groups and the like. $R_{12}$ is preferably a hydrogen atom or an unsubstituted alkyl group with 1 to 24 carbons, and specifically include methyl, i-propyl and t-butyl. Also, $R_{11}$ and $R_{12}$ are not 2-hydroxyphenylmethy groups.

$R_{13}$ represents a hydrogen atom or a substituted or unsubstituted alkyl group. As the alkyl groups, preferable are the alkyl groups with 1 to 30 carbons, and the description of the alkyl groups is the same as that of $R_{11}$. $R_{13}$ is preferably a hydrogen atom or an unsubstituted alkyl group with 1 to 24 carbons, and specifically include methyl, i-propyl, t-butyl and the like. And it is preferred that either $R_{12}$ or $R_{13}$ is the hydrogen atom.

$R_{14}$ represents a group capable of being substituted to benzene ring, and is, for example, the same group described in the substituent $Q_{20}$ in the Formula (A-3). $R_{14}$ is preferably a substituted or unsubstituted alkyl group with 1 to 30 carbons or an oxycarbonyl group with 2 to 30 carbons, and more preferably an alkyl group with 1 to 24 carbons. The substituents of the alkyl group include aryl, amino, alkoxy, oxycarbonyl, acylamino, acyloxy, imide, ureido groups and the like, and are more preferably aryl, amino, oxycarbonyl and alkoxy groups. These substituents of the alkyl group may be further substituted with these substituents.

Next, a bisphenol compound represented by the following Formula (YB) is most preferably used in the embodiment. The bisphenol compound represented by the Formula (YB) is described.

(YB)

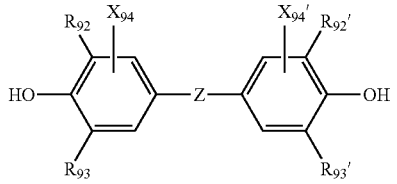

In the Formula (YB), Z represents —S— group or —C($R_{91}$)($R_{91}$')— group, and $R_{91}$ and $R_{91}$' each represent hydrogen atoms or substituents. The substituents represented by $R_{91}$ and $R_{91}$' include, for example, alkyl groups (methyl, ethyl, propyl, isopropyl, cyclopropyl, butyl, isobutyl, sec-butyl, t-butyl, cyclohexyl, 1-methyl-cyclohexyl, etc.), alkenyl groups (vinyl, propenyl, butenyl, pentenyl, isohexenyl, cyclohexenyl, butenylidene, isopentylidene, etc.), alkynyl groups (ethynyl, propinylidene, etc.), aryl groups (phenyl, naphthyl, etc.), heterocyclic groups (furyl, thienyl, pyridyl, tetrahydrofuran, etc.), and further, halogen, hydroxyl, alkoxy, aryloxy, acyloxy, sulfonyloxy, nitro, amino, aminoacyl, sulfonylamino, sulfonyl, carboxy, alkoxycarbonyl, aryloxycarbonyl, carbamoyl, sulfamoyl, cyano, sulfo and the like. As $R_{91}$ and $R_{91}$', preferred are hydrogen atoms or alkyl groups.

$R_{92}$, $R_{93}$, $R_{92}$' and $R_{93}$' each represent substituents, and the substituents include the same groups as the substituents included in the description for $R_{91}$ and $R_{91}$'.

As $R_{92}$, $R_{93}$, $R_{92}$' and $R_{93}$', preferred are alkyl, alkenyl, alkynyl, aryl, heterocyclic groups and the like, and the alkyl groups are more preferable.

The substituents of alkyl groups include the same groups as the substituents included in the description for $R_{91}$ and $R_{91}$'.

$R_{92}$, $R_{93}$, $R_{92}$' and $R_{93}$' are more preferably tertiary alkyl groups such as t-butyl, t-amyl, t-octyl, 1-methyl-cyclohexyl and the like.

$X_{94}$ and $X_{94}$' each represent hydrogen atoms or substituents, and the substituents include the same groups as the substituents included in the description for $R_{91}$ and $R_{91}$'.

The compounds represented by the Formulas (YA) and (YB) can include the compounds (II-1) to (II-40) described in [0032] to [0038] of JP-A-2002-169249, and the compounds (ITS-1) to (ITS-12) described in [0026] of EP 1,211,093.

Hereinafter, specific examples of the bisphenol compounds represented by the Formulas (YA) and (YB) are shown, but the present invention is not limited thereto.

(YA-1)

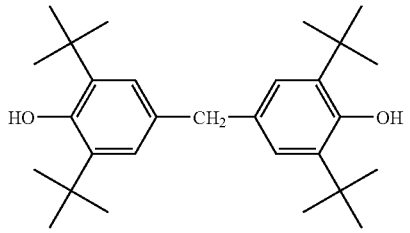

(YA-2)

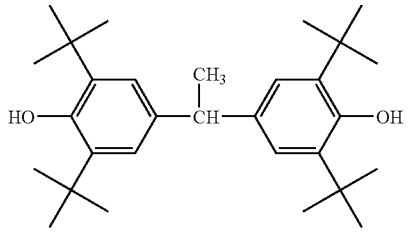

-continued
(YA-3)
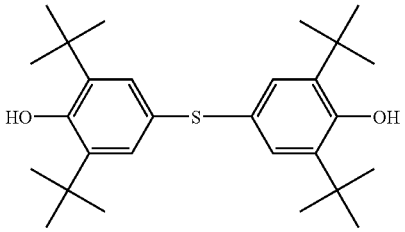
(YA-4)
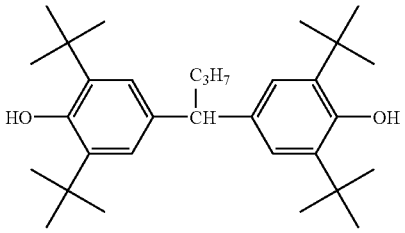
(YA-5)
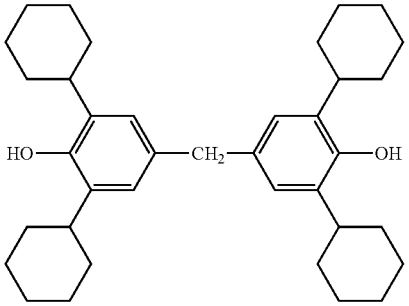
(YA-6)
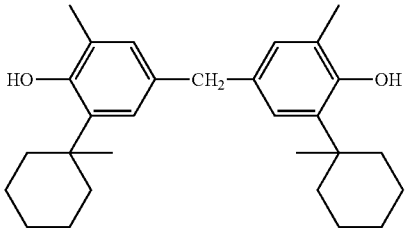
(YA-7)
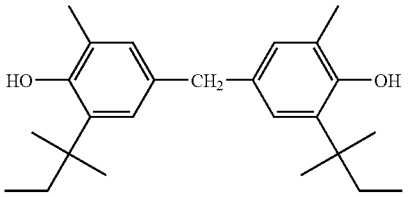
(YA-8)
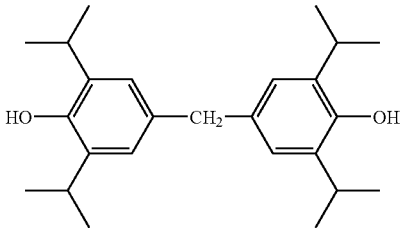
-continued
(YA-9)
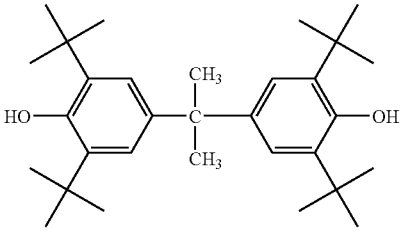
(YA-10)
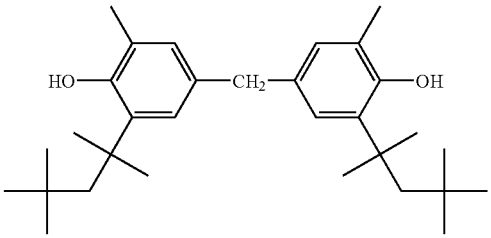
(YA-11)
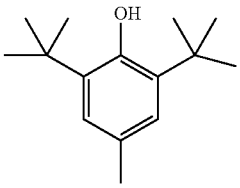
(YA-12)
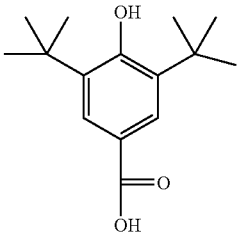
(YA-13)
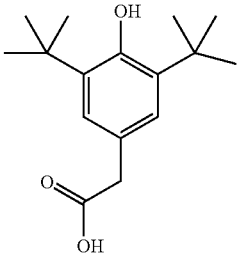
(YA-14)
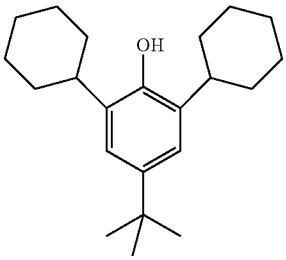

-continued (YA-15)

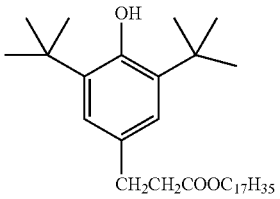

The addition amount of the compound (hindered phenol compound) of the Formula (YA) (including the compounds of the Formula (YB)) is typically from 0.00001 to 0.01 mol, preferably from 0.0005 to 0.01 mol, and more preferably from 0.001 to 0.008 mol per 1 mol of Ag.

It is preferred that the compounds of the Formulas (A-6), (YA) and (YB) and the cyan coloring leuco dye are contained in the image formation layer containing the organic silver salt, but one may be contained in the image formation layer and the other may be contained in non-image formation layer adjacent thereto, and both may be contained in the non-image forming layer. Also when the image forming layer is made up of multiple layers, they may be contained in different layers, respectively.

In the photothermographic imaging material of the embodiment, the phenol derivatives represented by the formula (A) described in JP-A-2000-267222 are preferably used as a development accelerator.

[Binder]

Binders suitable for the materials of the embodiments are transparent or translucent, generally colorless, and include naturally occurring polymer synthetic resins and polymers and copolymers and the other media which form films, e.g., those described in [0069] of JP-A-2001-330918. In these, the binders preferable for the photosensitive layer of the materials of the embodiment are polyvinyl acetals, and the especially preferable binder is polyvinyl butyral.

Also, for non-photosensitive layers such as a face coating layer and a base coating layer, especially a protection layer and a back coat layer, preferred are cellulose esters which are polymers with higher softening temperature, especially polymers such as triacetylcellulose and cellulose acetate butyrate. The above binders can be used in combination of two or more if necessary.

For the binder, it is preferable to use those at least one or more of polar group selected from —COOM, —$SO_3M$, —$OSO_3M$, —P═O$(OM)_2$, —O—P═$(OM)_2$, —N$(R_6)_2$, —N$(R_6)$ (M represents a hydrogen atom or an alkali metal base and $R_6$ represents a hydrocarbon group), epoxy group, —SH, —CN and the like are introduced by copolymerization or addition reaction, and —$SO_3M$, and —$OSO_3M$ are especially preferable. The amount of such a polar group is from $1\times10^{-1}$ to $1\times10^{-8}$ mol/g, and preferably from $1\times10^{-2}$ to $1\times10^{-6}$ mol/g.

Such a binder is used in the effective range to function as the binder. The effective range can be easily determined by those skilled in the art. For example, as an index when at least retaining the organic silver salt at the image forming layer, a ratio of the binder to the organic silver salt is preferably from 15:1 to 1:2, and especially the range of 8:1 to 1:1 is preferable. That is, it is preferred that the amount of binder in the image forming layer is from 1.5 to 6 g/$m^2$. More preferably it is from 1.7 to 5 g/$m^2$. When it is less than 1.5 g/$m^2$, the density at an unexposed part is drastically increased and there are sometimes unusable cases.

A glass transition temperature (Tg) of the binder used in the invention is preferably 70° C. to 150° C. Tg can be obtained by measuring with a differential thermometer, and an intersecting point of a baseline and a slope of an endothermic peak is rendered the glass transition temperature. Tg in the present invention is obtained by the method described in Brandwrap et al., "Polymer Handbook" III-139 to III-179 pages (1966, Willy and Sun Publisher).

When the binder is a copolymer resin, Tg is obtained by the following formula.

$$Tg(\text{copolymer})(^\circ\text{ C.})=v_1Tg_1+v_2Tg_2+\ldots v_nTg_n$$

In the formula, $v_1$, $v_2$ . . . $V_n$ represent a percentage by mass of a monomer in the copolymer, and $Tg_1$, $Tg_2$ . . . $Tg_n$ represent Tg (° C.) of a single polymer obtained from each monomer in the copolymer.

An accuracy of Tg calculated according to the above formula is ±5° C.

When using the binder with Tg of 70 to 105° C., the sufficient and maximum density can be obtained in the image formation, and thus it is preferable. Furthermore, by using such binders, it is possible to improve image storage stability in storage at high temperature.

As the binder used in the invention, Tg is from 70 to 105° C., the number average molecular weight is from 1,000 to 1,000,000, preferably from 10,000 to 500,000, and the polymerization degree is from about 50 to 1,000. The polymers or copolymers comprising the ethylenic unsaturated monomer mentioned above as a component unit include those described in [0069] of JP-A-2001-330918.

Among them, the especially preferable examples include alkyl methacrylate esters, aryl methacrylate esters, styrenes and the like. In such polymer compounds, it is preferable to use the polymer compounds having acetal group. It is more preferable to be polyvinyl acetal having acetoacetal structure, and for example, it is possible to include polyvinyl acetal shown in U.S. Pat. Nos. 2,358,836, 3,003,879 and 2,828,204, British Patent No. 771,155 and the like.

As the polymer compounds having the acetal group, especially preferred are the compounds represented by the following Formula (V).

(V)

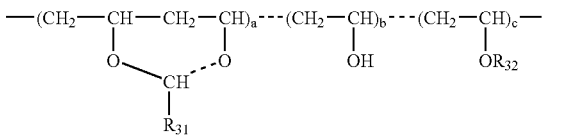

In the Formula, $R_{31}$ represents an unsubstituted alkyl, substituted alkyl, aryl or substituted aryl group, and is preferably a group other than aryl group. $R_{32}$ represents unsubstituted alkyl, substituted alkyl, unsubstituted aryl, substituted aryl group, —$COR_{35}$ or $ONHR_{35}$. $R_{35}$ is the same as defined $R_{31}$.

The unsubstituted alkyl groups represented by $R_{31}$, $R_{32}$ and $R_{35}$ are preferably those with 1 to 20 carbons, and more preferably those with 1 to 6 carbons. These may be linear or branched, and preferably linear alkyl groups are preferable. Such substituents include, for example, methyl, ethyl, n-propyl, isopropyl, n-butyl, isobutyl, t-butyl, n-amyl, t-amyl, n-hexyl, cyclohexyl, n-hepsyl, n-octyl, t-octyl, 2-ethylhexyl, n-nonyl, n-decyl, n-dodecyl, n-octadecyl and the like. Methyl or propyl group is especially preferable.

The unsubstituted aryl groups are preferably those with 6 to 20 carbons, and for example include phenyl, naphthyl groups and the like.

The groups capable of being substituted to the above alkyl or aryl group include alkyl groups (e.g., methyl, n-propyl, t-amyl, t-octyl, n-nonyl, dodecyl groups, etc.), aryl groups (e.g., phenyl group, etc.), nitro, hydroxy, cyano, sulfo groups, alkoxy groups (e.g., methoxy group, etc.), aryloxy groups (e.g., phenoxy group, etc.), acyloxy groups (e.g., acetoxy group, etc.), acylamino groups (e.g., acetylamino group, etc.), sulfonamide groups (e.g., methanesulfonamide group, etc.), sulfamoyl groups (e.g., methylsulfamoyl group, etc.), halogen atoms (e.g., fluorine, chlorine, bromine atoms, etc.), carboxy, carbamoyl groups (e.g., methylcarbamoyl group, etc.), alkoxycarbonyl groups (e.g., methoxycarbonyl group, etc.), sulfonyl groups (e.g., methylsulfonyl group, etc.) and the like. When these substituents are two or more, they may be the same or different. The total carbon number of substituted alkyl group is preferably from 1 to 20, and the total carbon number of substituted aryl group is preferably from 6 to 20.

As $R_{32}$, preferred is —$COR_{35}$ ($R_{35}$ is an alkyl or aryl group) or —$CONR_{35}$ ($R_{35}$ is an aryl group). And, a, b and c is values showing the weight of respective repeat units by mol %, a is in the range of 40 to 86 mol %, b is in the range of 0 to 30 mol %, c is in the range of 0 to 60 mol %, which represent the numbers to be a+b+c=100 mol %. Especially preferably, a is in the range of 50 to 86 mol %, b is in the range of 5 to 25 mol %, and c is in the range of 0 to 40 mol %. Each repeat unit having each composition ratio of a, b and c may be made up of the same or different components.

The polymer compounds represented by the above Formula (V) can be synthesized by the general method for synthesis described in "Vinyl Acetate Resins" edited by Ichiro Sakurada (1962, Kobunshi Kagaku Kankokai).

As polyurethane resins which can be used in the invention, it is possible to use those known in the art where the structure is polyester polyurethane, polyether polyurethane, polyetherpolyester polyurethane, polycarbonate polyurethane, polyesterpolycarbonate polyurethane, polycaprolactone polyurethane and the like. Also, it is preferable to have at least one OH group at each end of polyurethane molecule and thus total two or more OH groups. Since OH groups form three dimensional network structure by crosslinking with polyisocyanate which is a hardening agent, it is more preferable to include more groups in the molecules. Especially, when OH groups are located at the molecular ends, the reactivity to the hardening agent is high, and thus it is preferable. Polyurethane has preferably 3 or more OH groups at the molecular ends, and it is especially preferable to have 4 or more. When polyurethane is used in the invention, it is preferred that Tg is from 70 to 105° C., elongation after fracture is from 100 to 2000% and breaking stress for link chain is from 0.5 to 100 $N/mm^2$.

These polymer compounds (polymers) may be used alone or in blend of two or more. The above polymer is used as the main binder for the image forming layer of the invention.

The main binder here is referred to a "state where the above polymer occupies 50% or more by mass of the total binders of the image forming layer". Therefore, the other polymers may be blended in the range of less than 50% by mass of the total binders. These polymers is not especially limited as long as they are solvents where the polymer of the invention is solubilized. More preferably included are polyvinyl acetate, polyacryl resins, urethane resins and like.

In the present invention, an organic gelling agent may be contained in the image forming layer. The organic gelling agent herein is referred to compounds such as polyvalent alcohols having a function which makes fluidity of the system disappear or lower by adding to an organic liquid to impart an yield value to the system.

In the present invention, it is also the preferable aspect that an coating solution for the image forming layer contains polymer latex in aqueous dispersion. In this case, it is preferred that 50% or more by mass of the total binders of the coating solution for the image forming layer is polymer latex in aqueous dispersion. Also, when the image forming layer according to the invention contains polymer latex, it is preferred that 50% or more by mass of the total binders in the image forming layer is the polymer latex, and more preferably the polymer latex is 70% or more by mass.

"Polymer latex" is one where water-insoluble hydriphobic polymer is dispersed in an aqueous dispersion medium as fine particles. The dispersion state may be any of one where the polymer is emulsified in the dispersion medium, emulsified and polymerized one, micelle dispersion, or one where hydriphilic structures are partially present in the molecule and molecular chains per se are in molecular dispersion. The mean particle size of the dispersed particles is preferably from 1 to 50,000 nm, and more preferably in the range of about 5 to 1,000 nm. The particle size distribution is not especially limited, and the particles may have a broad particle size distribution or a particle size distribution of monodisperse.

The polymer latex used in the invention may be so-called core/shell type latex in addition to the polymer latex with common uniform structure. In this case, there are sometimes preferable cases when the glass transition temperature is different in the core and the shell. A minimum film forming temperature (MFT) of the polymer latex according to the invention is preferably from −30 to 90° C., and more preferably from about 0 to 70° C. Also, a film forming aid may be added to control the minimum film forming temperature.

The film forming aid used for the invention is also called a plasticizer, an organic compound (typically organic solvent) which reduces the minimum film forming temperature of the polymer latex, and for example, described in "Chemistry of Synthetic Latex (written by Soichi Muroi, published by Kobunshi Kanko, 1970)".

Polymer types used for the polymer latex are acryl, vinyl acetate, polyester, polyurethane, rubber type, vinyl chloride, vinyliden chloride and polyolefin resins, or copolymers thereof and the like. The polymers may be linear polymers, branched polymers or crosslinked polymers. Also, the polymers may be so-called homopolymers where a single monomer is polymerized or copolymers where two or more types of monomers are polymerized. The copolymers may be random copolymers or block copolymers. The molecular weight of the polymer is typically from 5,000 to 1,000,000, and preferably from about 10,000 to 100,000 by number average molecular weight. When the molecular weight is too small, dynamic strength of the photosensitive layer is insufficient, and when it is too large, it is not preferable either because film-making ability is poor.

The polymer latex with equilibrium water content of 0.01 to 2% or less by mass at 25° C. and 60% RH (relative humidity) is preferable, and more preferable are those with 0.01 to 1% by mass. For the definition of and the method for measurement of the equilibrium water content, it is possible to refer to, for example, "Kobunshi Kogaku Koza 14, Kobunshi Zairyo Shikenho (edited by Society of Polymer Science, Japan, Chijinshokan).

Specific examples of the polymer latex include latex of methyl methacrylate/ethyl methacrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer, and the like. These polymers may be used alone or in blend of two or more if necessary. As polymer types of the polymer latex, it is preferred that carboxylic acid ingredient such as acrylate or methacrylate ingredient is contained at about 0.1 to 10% by mass.

Furthermore, hydriphilic polymers such as gelatin, polyvinyl alcohol, methylcellulose, hydroxypropylcellulose, carboxymethylcellulose, and hydroxypropylmethylcellulose may be added in the range of 50% or less by mass based on total binders if necessary. It is preferred that the addition amount of these hydriphilic polymers is 30% or less by mass based on the total binders of the photosensitive layer.

In the preparation of the coating solution for the image forming layer according to the invention, concerning an order of the addition of the organic silver salt and the polymer latex in aqueous dispersion, either one may be added precedently, or they may be added simultaneously, but preferably the polymer latex is added later.

Furthermore, it is preferred that the organic silver salt and further the reducing agent have been mixed before the addition of the polymer latex. Also, in the present invention, after mixing the organic silver salt and the polymer latex, there is problematic in that when the temperature with time is too low, a coating face is impaired whereas when it is too high, the photographic fog is increased, and thus, it is preferred that the coating solution after mixing is retained at 30° C. to for the above time period. Furthermore, it is preferred to retain at 65° C. 35° C. to 60° C., and especially, it is preferred to retain at 35° C. to 55° C. for time elapsing. To maintain such a temperature, a liquid preparation bath for the coating solution could be kept warm.

Concerning the coating of the coating solution for the image forming layer according to the invention, it is preferable to use the coating solution 30 min to 24 hours after mixing the organic silver salt and the polymer latex, more preferably the coating solution is left 60 min to 12 hours after the mixing, and it is especially preferable to use the coating solution 120 min to 10 hours after the mixing.

Here, "after mixing" is referred to subsequence of adding the organic silver salt and the polymer latex in aqueous dispersion and added materials being dispersed evenly.

In addition, it is well known that the use of a crosslinker described below for the above binder improves film adherence and reduces development unevenness, and there are also effects that the photographic fog in storage and the production of printout silver after the development are inhibited.

[Crosslinker]

As such crosslinkers, it is possible to use various crosslinkers used as photographic materials in earlier technology such as aldehyde, epoxy, ethyleneimine, vinylsulfone, sulfonate ester, acryloyl, carbodiimide, silane type crosslinkers and the like described in JP-A-50-96216, but in the embodiment, preferred are vinylsulfone type compounds, isocyanate type compounds, carbodiimide type compounds silane type compounds, epoxy type compounds or acid anhydride shown below.

Described are the compounds containing vinylsulfone group preferably used in the embodiments. As the used compounds containing vinylsulfone group, those represented by the following Formula (1) are preferable.

$$(R_1R_2C{=}CR_3{-}SO_2)_{na}{-}L_2 \quad (1)$$

In the formula, $R_1$, $R_2$ and $R_3$ represent hydrogen atoms, alkyl, aryl groups, and these substituents may be bound with adjacent groups to form a ring. And, na represents 1, 2, 3 or 4, and $L_2$ represents a linkage group. The linkage groups are composed of residues having a binding site to any position of the compounds such as alkane, alkene and aromatic hydrocarbon rings, with 20 or less carbon atoms. The linkage groups may be monovalent bivalent or higher, and for example, may be bivalent or higher linkage groups having multiple binding sites at any positions of various alkyl substituted aromatic hydrocarbon rings known in this field.

The aromatic hydrocarbon rings may have substituents selected from the group consisting of halogens (e.g., Br, Cl), hydroxy, amino, carboxy, alkyl and alkoxy. Hereinafter, listed are examples of the compounds containing the vinylsulfone groups according to the invention, but the invention is not limited thereto.

1-1

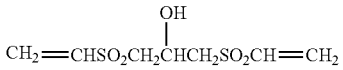

1-2

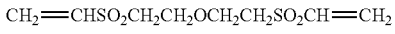

1-3

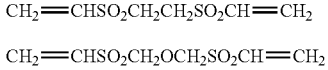

1-4

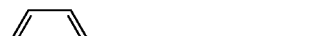

1-5

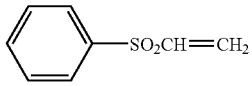

1-6

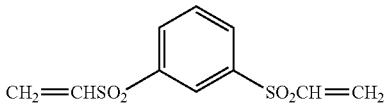

1-7

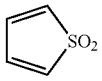

The compounds containing the vinylsulfone groups are known in the art in the references, e.g., U.S. Pat. Nos. 2,994,611, 3,061,436, 3,132,945, 3,490,911, 3,527,807, 3,593,644, 3,642,486, 3,642,908, 3,839,042, 3,841,872, 3,957,882, 4,088,495, 4,108,848, 4,137,082, and 4,142,897. These are also described in Belgian Patent No. 819,015 and U.S. Pat. No. 4,173,481.

The compound containing the vinylsulfone group(s) is generally used at least at 0.001 mol based on 1 mol of the silver. Typically, the range thereof is from 0.01 to 5 mol based on 1 mol of the silver, and preferably from 0.02 to 0.6 mol based on 1 mol of the silver.

Next, described are the isocyanate type compounds containing isocyanate groups of the invention. The isocyanate type crosslinker used for the invention is isocyanates or adduct bodies thereof having at least two isocyanate groups, and especially those represented by the following Formula (2) are preferable.

$$X_2{=}C{=}N{-}J_1{-}(L_2)_{nb}{-}(J_2{-}N{=}C{=}X_2)_v \quad (2)$$

In the formula, $J_1$ and $J_2$ each represent arylene or alkylene groups, $L_3$ represents a (v+1) valent alkyl, alkenyl, aryl or heterocyclic group, or a group where these groups are bound by binding groups, and at least one of $J_1$, $J_2$ and $L_3$ represents the aryl or arylene group. $X_2$ represents oxygen or sulfur atoms, v represents an integer of 1 or more, and nb represents 0 or 1.

As the crosslinkers used in the invention, it is possible to use the various crosslinkers used as the silver halide photographic imaging materials in earlier technology, e.g., aldehyde type, epoxy type, ethyleneimine type, vinylsulfone type, sulfonate ester type, acryloyl type and carbodiimide type, silane type crosslinkers, but preferred are isocyanate type compounds shown below, silane compounds, epoxy compounds or acid anhydrides.

The above isocyanate type compounds are the isocyanates or the adduct bodies thereof having at least two isocyanate groups, and further specifically include aliphatic diisocyanates, aliphatic diisocyanates having cyclic group(s), benzene diisocyanates, naphthalene diisocyanates, biphenyl isocyanates, diphenylmethane diisocyanates, triphenylmethane diisocyanates, triisocyanates, tetraisocyanates, the adduct bodies of theses isocyanates, and the adduct bodies of these isocyanates and bivalent or trivalent polyalcohols.

Specific examples can include the isocyanate compounds described in pages 10 to 12 of JP-A-56-5535. The adduct body of isocyanate and polyalcohol especially makes interlayer adhesion good and has a high ability to prevent occurrence of dropout of layer, image slippage and cells.

Generally, the aromatic isocyanate compounds sometimes turn yellow with time, and thus, it has been said that they are not preferable in terms of the image storage. However this time, it has been discovered that fine density variation in the image storage can be inhibited without turning yellow by using the multifunctional aromatic isocyanate compound, among others, using the multifunctional aromatic isocyanate compound represented by the Formula (2) as a thermal transition temperature is controlled. In the Formula (2) of the invention, the arylene groups represented by $J_1$ and $J_2$ are for example phenylene, tolylene, naphthalene and the like, and the alkylene groups represented by $J_1$ and $J_2$ are for example methylene, ethylene, trimethylene, tetramethylene, hexamethylene, and the like. The (v+1)valent alkyl groups represented by $L_3$ are methyl, ethyl, propyl, butyl, pentyl, and the like, the alkenyl groups represented by $L_3$ are ethenyl, propenyl, butadiene, pentadiene, and the like, the aryl groups represented by $L_3$ are benzene, naphthalene, toluene, xylene and the like, the heterocyclic groups represented by $L_3$ are furan, thiophene, dioxane, pyridine, piperazine, morpholine and the like, and may be groups where these groups are bound via linkage groups. The linkage groups may be simple binding sites or may comprise carbon atoms, and represent the linkage groups formed from oxygen, nitrogen, sulfur and phosphorus atoms, and are for example O, S, NH, CO, SO, $SO_2$, NHCO, NHCONH, PO, PS and the like. The integer represented by v, which is 1 or more is preferably the integer of 1 to 6, and more preferably 1, 2 or 3.

Specific examples of the compounds represented by the Formula (2) are shown below.

2-1

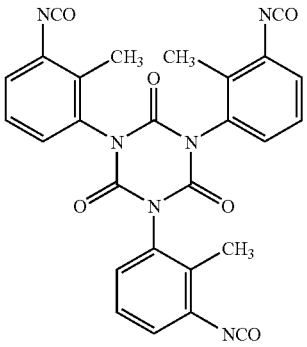

2-2

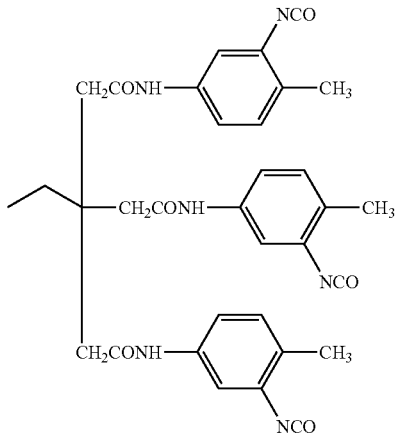

2-3

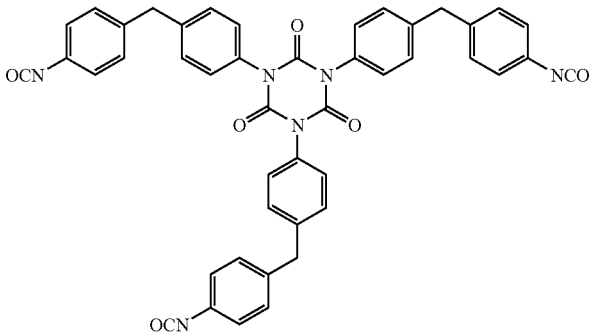

2-4

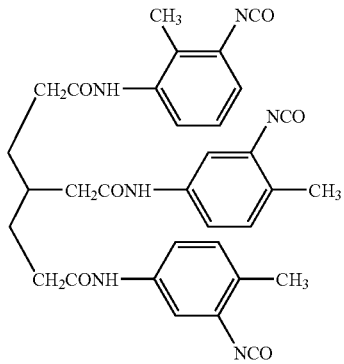

-continued
2-5
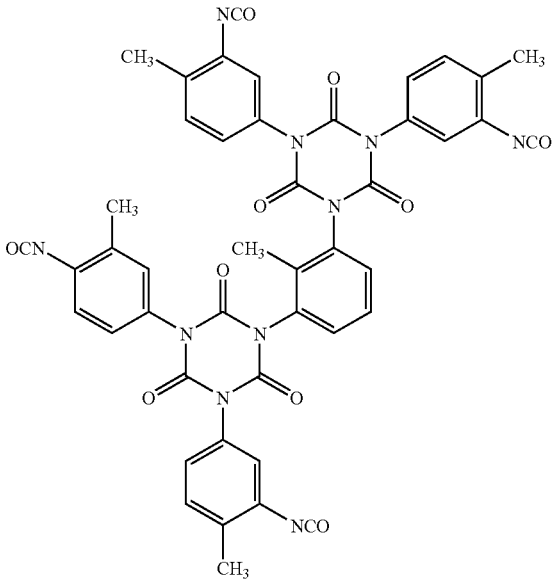
2-6
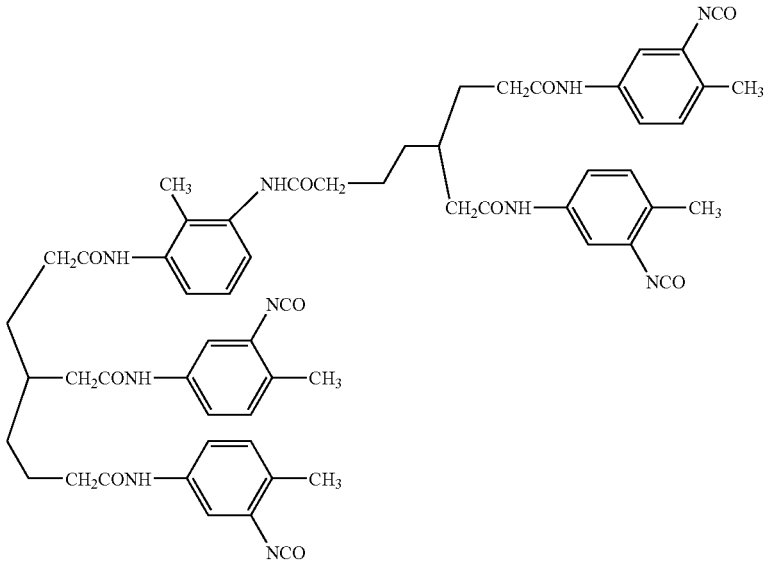

-continued
2-7
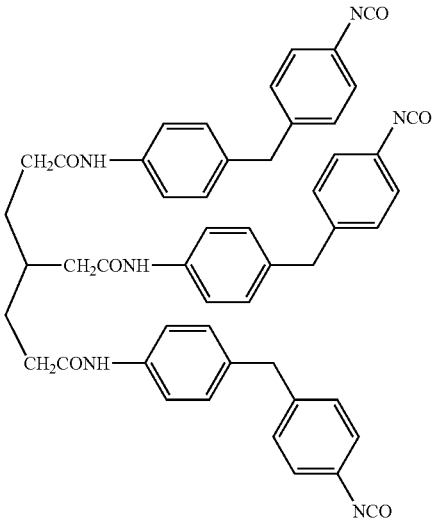
2-8
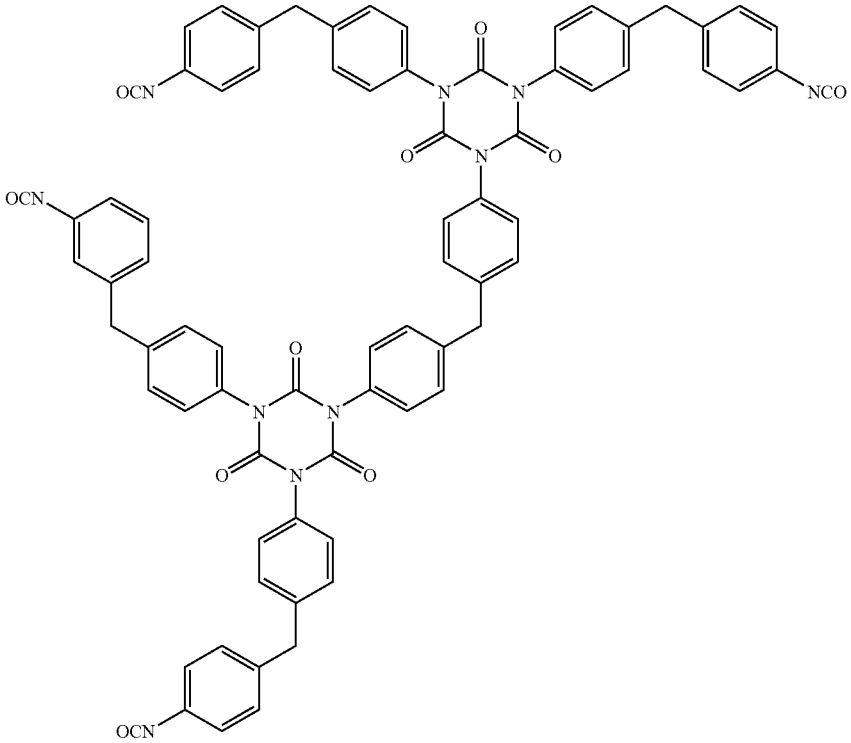
2-9
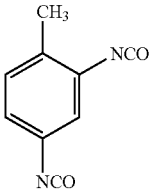
2-10
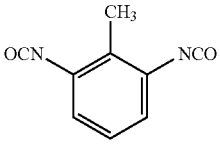

-continued
2-11
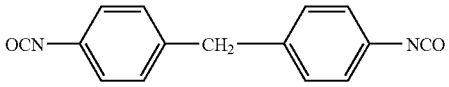
2-12
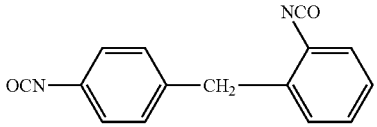
2-13
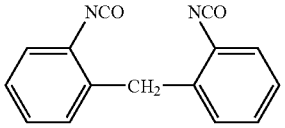
2-14
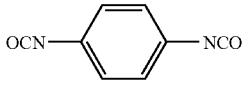
2-15
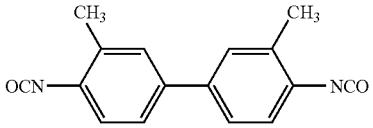
2-16
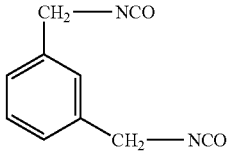
2-17
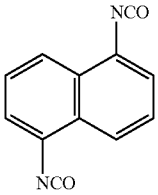
2-18
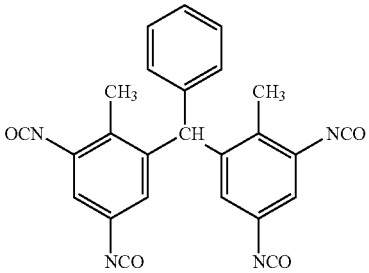
2-19
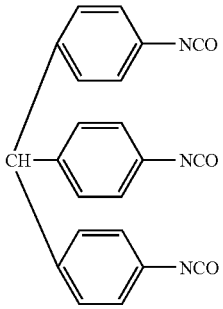
2-20
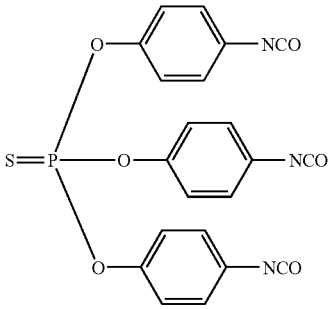
2-21
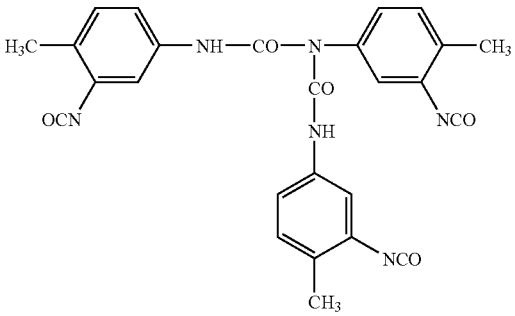
2-22
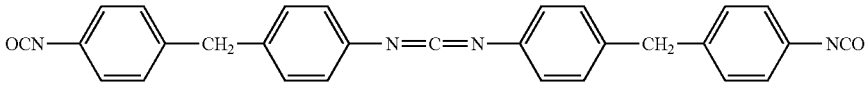

-continued 2-23

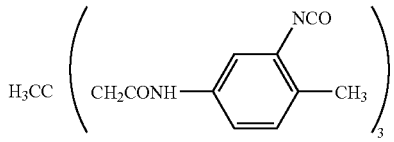

Such an isocyanate compound may be placed at any part of the silver salt photothermographic dry imaging material. For example, it can be added to the given layer at the side of the photosensitive layer of the support such as the photosensitive layer, a surface protection layer, an intermediate layer, an anti-halation layer and an under coating layer in the support (especially when the support is paper, it can be contained in the size composition), and it can be added to one layer or two or more layers in these layers.

The amount of the above isocyanate compound used in the invention is in the range of 0.001 to 2 mol, and preferably from 0.005 to 0.5 mol per 1 mol of the silver. In this range, two or more types may be combined.

Also, as thioisocyanate type crosslinkers which can be used in the embodiment, useful are also the compounds having thioisocyanate structure corresponding to the above isocyanates.

The amount of the above crosslinker is typically from 0.001 to 2 mol per 1 mol of the silver, and preferably in the range of 0.005 to 0.5 mol per 1 mol of the silver.

It is preferred that the isocyanate and thioisocyanate compounds which can be contained in the invention are the compounds having the function as the above crosslinker, but a good result is obtained by even the compound having only one of the functional group.

The carbodiimide compounds may be any compounds as long as they have carbodiimide bonds, but among others, preferred are multifunctional carbodiimide compounds as represented by the following Formula (3).

$$R_4—J_{11}—N{=}C{=}N—J_{12}—(L_4)_{nc}—(J_{13}—N{=}C{=}N—J_{14}—R_5)_{v1} \quad (3)$$

In the formula, $R_4$ and $R_5$ each represent aryl or alkyl groups, $J_{11}$ and $J_{14}$ each represent bivalent linkage groups, $J_{12}$ and $J_{13}$ represent arylene or alkylene groups, $L_4$ represents a (v1+1) valent alkyl, alkenyl aryl or heterocyclic group, or a group where these groups are bound via binding groups, v1 represents an integer of 1 or more, and nc represents 0 or 1.

The alkyl groups represented by the above $R_4$ and $R_5$ are for example methyl, ethyl, propyl, butyl, pentyl and the like, the aryl groups represented by $R_4$ and $R_5$ are residues such as benzene, naphthalene, toluene, xylene and the like, the heterocyclic groups represented by $R_4$ and $R_5$ are residues such as furan, thiophene, dioxane, pyridine, piperazine, morpholine and the like and may be the groups where these groups are bound via linkage groups.

The linkage groups represented by $J_{11}$ and $J_{14}$ may be a simple binding site, may comprise carbon atoms, represent the linkage groups formed from oxygen, nitrogen, sulfur, phosphorus atoms and the like, and are for example, O, S, NH, CO, COO, SO, $SO_2$, NHCONH, PO, PS and the like. The alkylene and arylene groups represented by $J_{12}$ and $J_{13}$ are for example the alkylene groups such as methylene, ethylene, trimethylene, tetramethylene, hexamethylene and the like, and the arylene groups such as phenylene, tolylene, naphthalene and the like.

The (v1+1) valent alkyl groups represented by $L_4$ are methyl, ethyl, propyl, butyl, pentyl and the like, the alkenyl groups represented by $L_4$ are ethenyl, propenyl, butadiene, pentadiene and the like, and the heterocyclic groups represented by L are furan, thiophene, dioxane, pyridine, piperazine, morpholine and the like and may be the groups where these groups are bound via linkage groups. The linkage groups may be a simple binding site, may comprise carbon atoms, represent the linkage groups formed from oxygen, nitrogen, sulfur, phosphorus atoms and the like, and are for example, O, S, NH, CO, COO, SO, $SO_2$, NHCONH, PO, PS and the like. The integer of 1 or more represented by v1 is preferably the integer of 1 to 6, and more preferably 1, 2 or 3.

Hereinafter, shown are specific examples of the preferably used carbodiimide compounds, but the invention is not limited thereto.

3-1

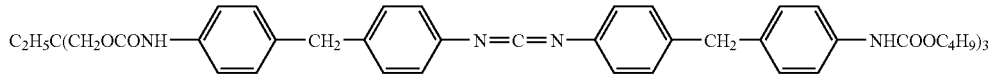

3-2

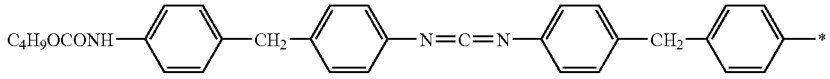

-continued
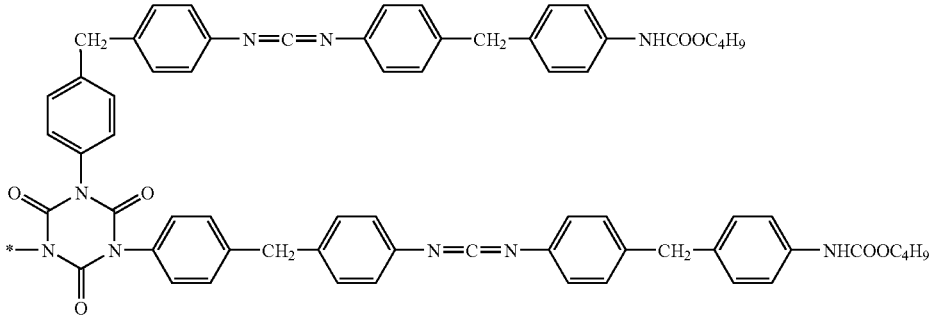
3-3
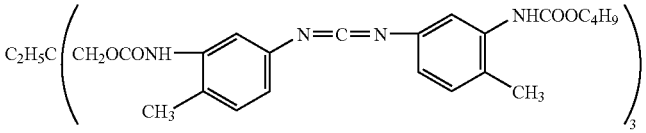
3-4
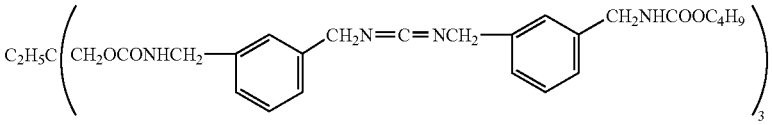
3-5
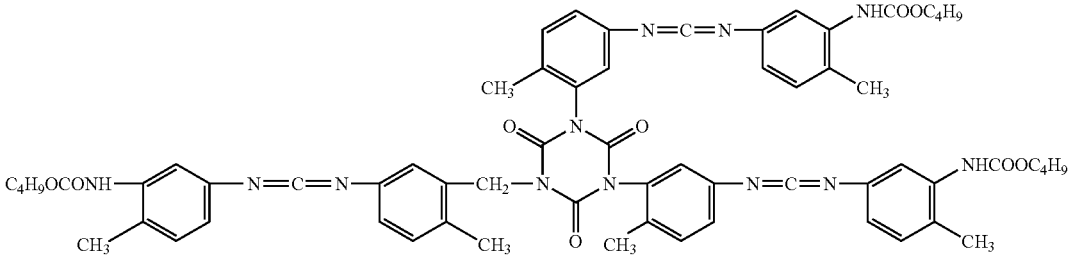
3-6
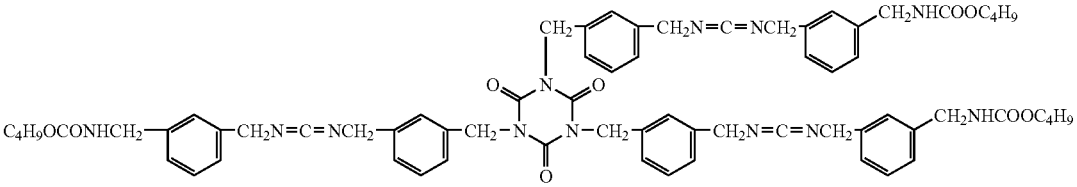
3-7
$C_2H_5C(CH_2OCONH(CH_2)_6N{=}C{=}N(CH_2)_6NHCOOC_4H_9)_3$
3-8
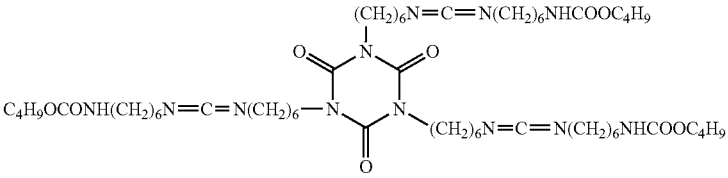
3-9
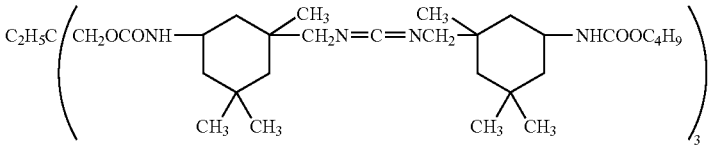

-continued
3-10
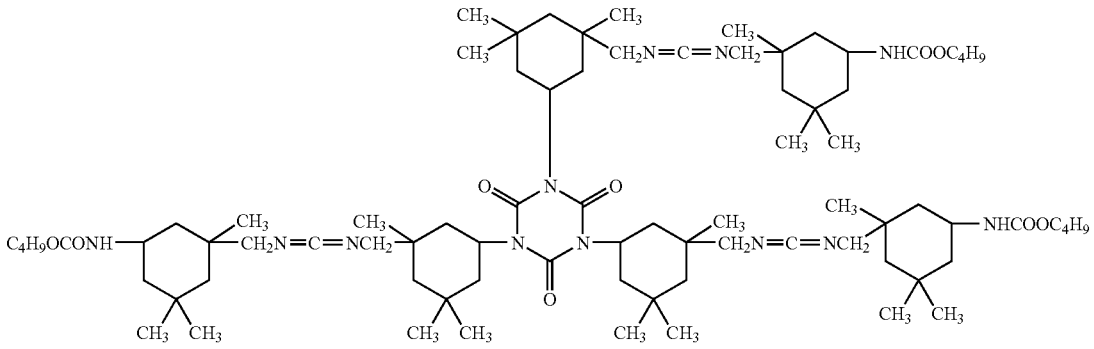
3-11
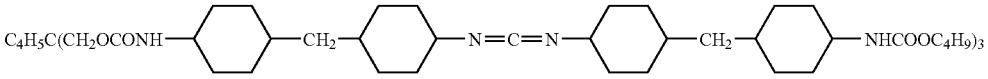
3-12
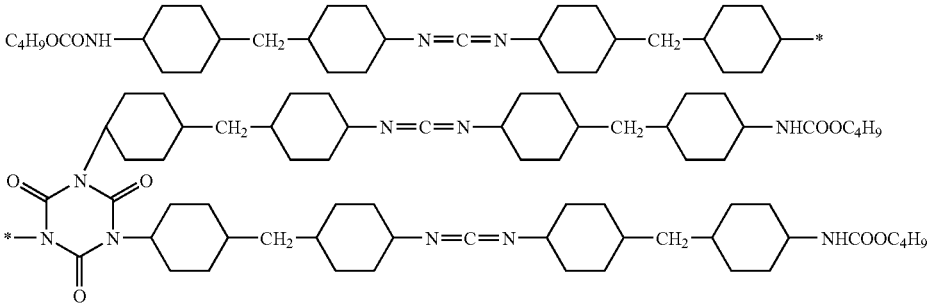
3-13
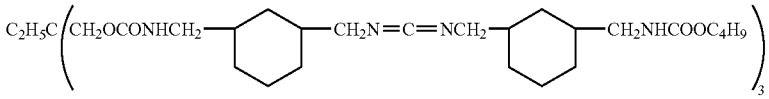
3-14
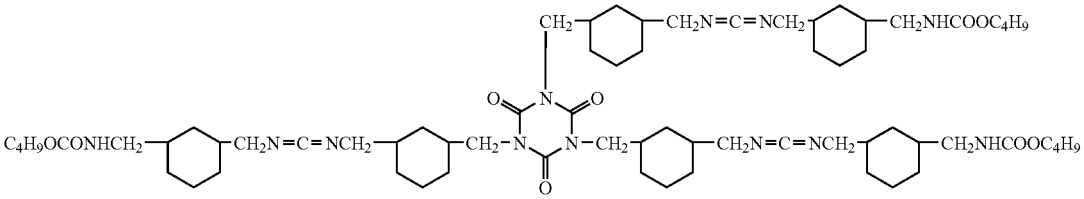
3-15
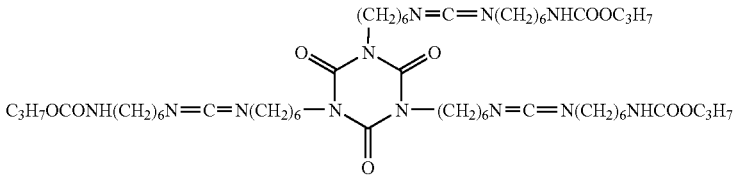
3-16
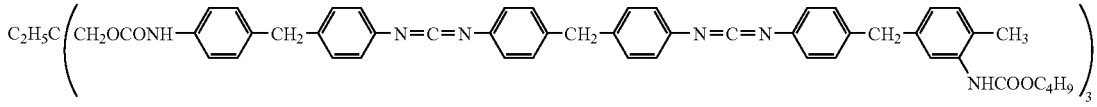

-continued
3-17
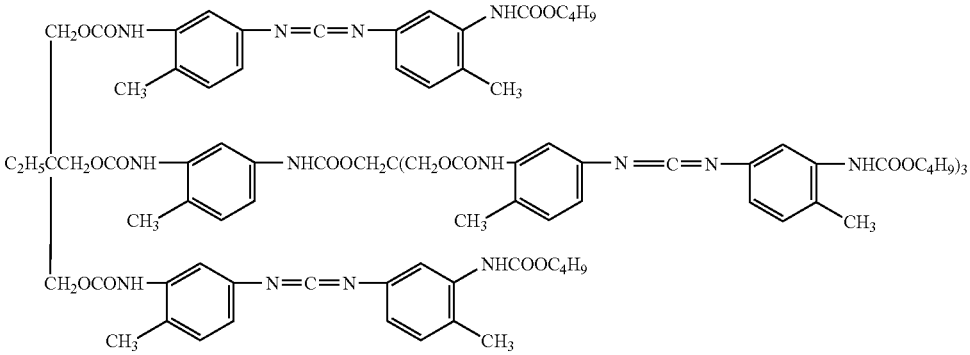
3-18
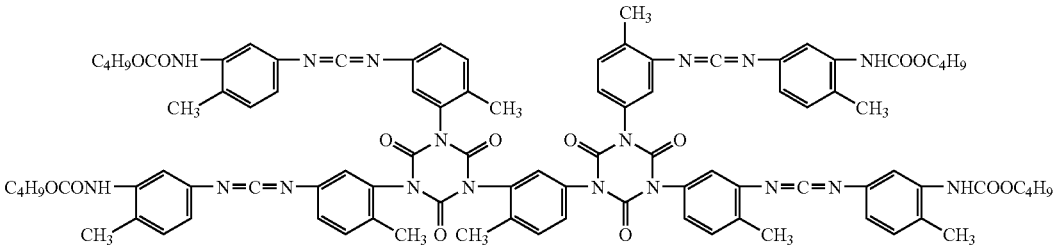
3-19
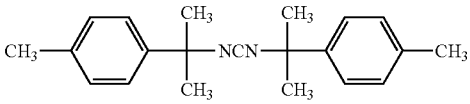
3-20
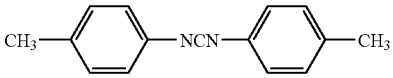
3-21
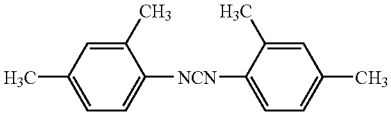
3-22
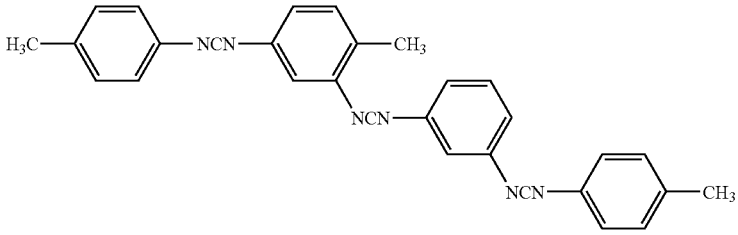
3-23
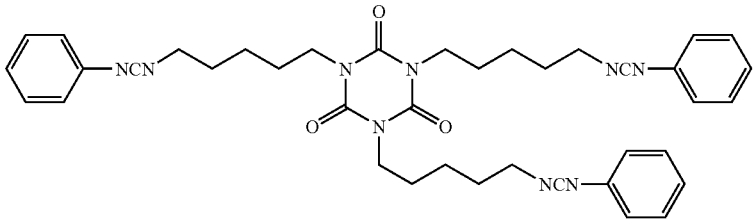

The carbodiimide compound of the invention could be contained in at least one layer of the photosensitive layer and the layer adjacent thereto, may be added by dissolving in alcohols such as methyl and ethyl, ketones such as methylethylketone and acetone, aromatic types such as toluene and xylene, and non-aromatic types such as hexane and decane, may be dispersed in water, or may be directly added by making into powder or tablets. The use amount can be in the range of $10^{-6}$ to 10 mol per mol of the silver halide.

Also, examples of the silane compounds include the compounds represented by the Formulas (1) to (3) disclosed in JP-A-2001-264930.

Further, the epoxy compounds could be those having one or more epoxy groups, and the number of epoxy groups, molecular weight and the others are not limited. It is preferred that epoxy group is contained in the molecule as glycidyl group via ether and imino bonds. Also, the epoxy compound may be any of monomer, oligomer and polymer, the number of epoxy groups present in the molecule is typically from about 1 to 10, and preferably from 2 to 4. When the epoxy compound is polymer, it may be either of homopolymer or copolymer, and the preferable range of the number average molecular weight thereof is from about 2,000 to 20,000.

Also, the acid anhydride is the compound having at least acid anhydride group represented by the following structure formula. The acid anhydride used for the invention could be having one or more of such acid anhydride groups, and the number of acid anhydride groups, molecular weight and the others are not limited.

—CO—O—CO—

The above epoxy compounds and acid anhydride may be used alone or in combination of two or more. The addition amount thereof is not especially limited, but the range of $1\times10^{-6}$ to $1\times10^{-2}$ mol/m$^2$ is preferable, and the range of $1\times10^{-5}$ to $1\times10^{-3}$ mol/m$^2$ is more preferable. The epoxy compound and acid anhydride can be added to any layer of the photosensitive layer side of the support such as the photosensitive layer, surface protection layer, intermediate layer, anti-halation layer and under coating layer, and can be added to one or two or more layers of these layers.

[Silver Saving Agent]

The silver saving agent used in the invention is referred to the compounds capable of reducing the silver amount required for obtaining the constant silver image density. Various action mechanisms for this reduction are thought, but preferred are the compounds having the function to enhance covering power of development silver. Here, the covering power of development silver is referred to optical density per unit amount of the silver.

As the silver saving agent, preferable examples include hydrazine derivative compounds represented by the following Formula (H), vinyl compounds represented by the following Formula (G), and quaternary onium compounds represented by the following Formula (P).

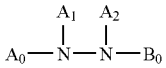

(H)

-continued

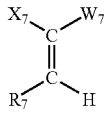

(G)

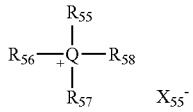

(P)

In the Formula (H), $A_0$ represents an aliphatic group, aromatic group, heterocyclic group or —$G_0$—$D_0$— group which may have substituents, respectively, $B_0$ represents a blocking group, $A_1$ and $A_2$ both represent hydrogen atoms or one represents a hydrogen atom and the other represents an acyl, sulfonyl or oxalyl group. Here, $G_0$ represents —CO—, —COCO—, —CS—, —C(=N$G_1D_1$)—, —SO—, —$SO_2$— or —P(O)($G_1D_1$) group, $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different. $D_0$ represents a hydrogen atom, aliphatic, aromatic, heterocyclic, amino, alkoxy, aryloxy, alkylthio or arylthio group. Preferable $D_0$ includes hydrogen atom, alkyl, alkoxy and amino groups.

The aliphatic groups represented by $A_0$ are preferably those with 1 to 30 carbons, especially preferably linear, branched or cyclic alkyl groups with 1 to 20 carbons, and include, for example, methyl, ethyl, t—butyl, octyl, cyclohexyl, and benzyl groups. These may be further substituted with appropriate substituents (e.g., aryl, alkoxy, aryloxy, alkylthio, arylthio, sulfoxy, sulfonamide, sulfamoyl, acylamino, ureido groups, etc.)

The aromatic group represented by $A_0$ is preferably monocyclic or condensed cyclic aryl group, and for example, includes benzene or naphthalene ring. The heterocyclic group represented by $A_0$ is preferably monocyclic or condensed cyclic heterocyclic group containing at least one heteroatom selected from nitrogen, sulfur and oxygen atoms, and for example includes imidazole, tetrahydrofuran, morpholine, pyridine, pyrimidine, quinoline, thiazole, benzothiazole, thiophene, and furan rings. The aromatic and heterocyclic and —$G_0$—$D_0$ groups of $A_0$ may have substituents. As $A_0$, especially preferred are aryl group and —$G_0$—$D_0$ group.

Also, it is preferred that $A_0$ comprises at lease one of anti—diffusion group and silver halide adsorption group. As the anti—diffusion group, preferred is ballast group usually used in additives for unmoving photographs such as coupler, and the ballast groups include alkyl, alkenyl, alkynyl, alkoxy, phenyl, phenoxy, alkylphenoxy groups and the like, which are photographically inert. It is preferred that total number of carbons at substituted moiety is 8 or more.

The silver halide adsorption facilitating groups include thio urea, thiourethane, mercapto, thioether, thione, heterocyclic, thioamide heterocyclic, mercapto heterocyclic groups or adsorption groups described in JP-A-64-90439.

$B_0$ represents a blocking group, and is preferably —$G_0$—$D_0$ group. $G_0$ represents —CO—, —COCO—, —CS—, —C(=N$G_1D_1$)—, —SO—, —$SO_2$— or —P(O)($G_1D_1$) group, and preferable $G_0$ includes —CO— and —COCO— groups. $G_1$ represents a simple bond, —O—, —S— or —N($D_1$) group, $D_1$ represents an aliphatic, aromatic, heterocyclic group or hydrogen atom, and when multiple $D_1$ are present in the molecule, they may be the same or different.

$D_0$ represents a hydrogen atom, aliphatic, aromatic, heterocyclic, amino, alkoxy, aryloxy, alkylthio or arylthio group, and preferable $D_0$ includes hydrogen atom, alkyl, alkoxy and amino groups.

$A_1$ and $A_2$ both represent hydrogen atoms, or one represents a hydrogen atom and the other represents an acyl group (acetyl, trifluoroacetyl, benzoyl, etc.), sulfonyl group (methanesulfonyl, toluene sulfonyl, etc.) or oxalyl group (ethoxalyl etc.).

These compounds represented by the Formula (H) can be readily synthesized by the methods known in the art. For example, they can be synthesized in reference to U.S. Pat. Nos. 5,464,738 and 5,496,695.

The other hydrazine derivatives which can be preferably used can include the compounds H-1 to H-29 described in columns of 11 to 20 of U.S. Pat. No. 5,545,505, the compounds 1 to 12 described in the columns of 9 to 11 of U.S. Pat. No. 5,464,738, the compounds H-1-1 to H-1-28, H-2-1 to H-2-9, H-3-1 to H-3-12, H-4-1 to H-4-21 and H-5-1 to H-5-5 described in [0042] to [0052] of JP-A-2001-27790. These hydrazine derivatives can be synthesized by the methods known in the art.

Representative examples of the hydrazine derivatives preferably used in the invention are shown below, but the invention is not limited thereto.

(H-1)

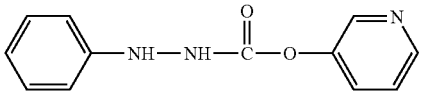

(H-2)

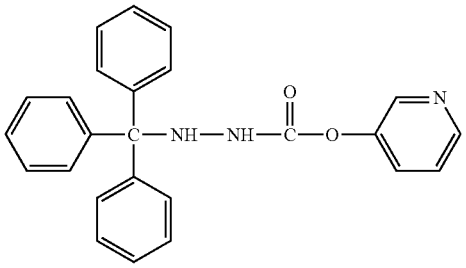

(H-3)

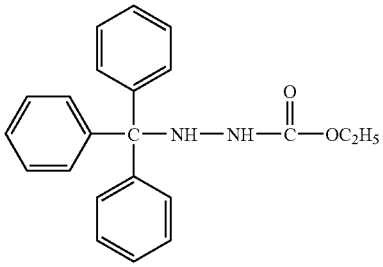

(H-4)

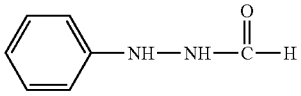

(H-5)

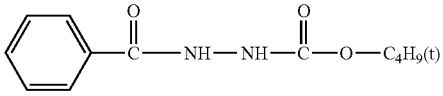

-continued (H-6)

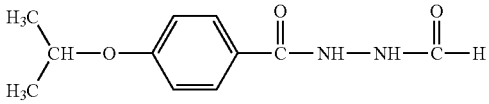

(H-7)

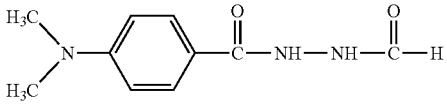

(H-8)

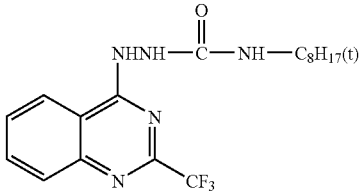

(H-9)

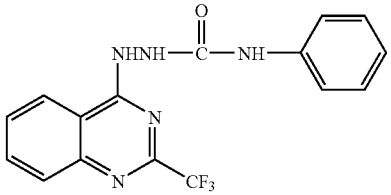

(H-10)

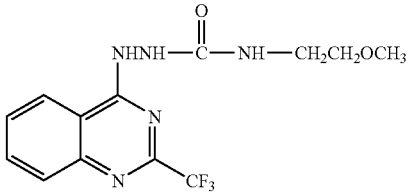

The vinyl compound represented by the Formula (G) is described. In the Formula (G), $X_7$ and $R_7$ are represented in the form of cis, but the form where $X_7$ and $R_7$ are trans is included in the Formula (G). This is the same in the structure representation of the specific compounds.

$X_7$ represents an electron withdrawing group, and $W_7$ represents hydrogen atom, alkyl, alkenyl, alkynyl, aryl, hetero ring groups, halogen atom, acyl, thioacyl, oxalyl, oxyoxalyl, thiooxalyl, oxamoyl, oxycarbonyl, thiocarbonyl, carbamoyl, thiocarbamoyl, sulfonyl, sulfinyl, oxysulfinyl, thiosulfinyl, sulfamoyl, oxysulfinyl, thiosulfinyl, sulfamoyl, phosphoryl, nitro, imino, N-carbonylimino, N-sulfonylimino, dicyanoethylene, ammonium, sulfonium, phosphonium, pyrilium, and immonium groups.

$R_7$ represents halogen atom, hydroxyl, alkoxy, aryloxy, hetero ring oxy, alkenyloxy, acyloxy, alkoxycarbonyloxy, aminocarbonyloxy, mercapto, alkylthio, arylthio, hetero ring thio, alkenylthio, acylthio, alkoxycarbonyl thio, aminocarbonyl thio groups, organic or inorganic salt of hydroxyl or mercapto group (e.g., sodium, potassium, silver salts, etc.), amino, alkylamino, cyclic amino (e.g., pyrolidino etc.), acylamino, oxycarbonylamino, hetero ring groups (nitrogen-containing 5 to 6-membered cyclic ring, e.g., benztriazolyl, imidazolyl, triazolyl, tetrazolyl, etc.), ureido and sulfonamide groups.

$X_7$ and $W_7$, $X_7$ and $R_7$ may be bound one another to form a cyclic structure. Rings which $X_7$ and $W_7$ form include, for example, pyrazolone, pyrazolidinone, cyclopentanedione, β-ketolactone, β-ketolactam and the like.

The electron withdrawing group represented by $X_7$ is the substituent where a substituent constant ρp can be a positive value. Specifically included are substituted alkyl groups (halogen substituted alkyl etc.), substituted alkenyl groups (cyanovinyl, etc.), substituted/unsubstituted alkynyl groups (trifluoromethylacetylenyl, cyanoacetylenyl, etc.), substituted aryl groups (cyanophenyl, etc.), substituted/unsubstituted hetero ring groups (pyridyl, triazyl, benzoxazolyl, etc.), halogen atoms, cyano group, acyl groups (acetyl, trifluoroacetyl, formyl, etc.), oxalyl groups (methyloxalyl, etc.), oxyoxalyl groups (ethoxalyl, etc.), thiooxalyl groups (ethylthiooxalyl, etc.), oxamoyl groups (methyloxamoyl, etc.), oxycarbonyl groups (ethoxycarbonyl, etc.), carboxyl groups, thiocarbonyl groups (ethylthiocarbonyl, etc.), carbamoyl, thiocarbamoyl, sulfonyl, sulfinyl groups, oxysulfonyl groups (ethoxysulfonyl, etc.), thio sulfonyl groups (ethylthiosulfonyl, etc.), sulfamoyl, oxysulfinyl groups (methoxysulfinyl, etc.), thiosulfinyl groups (methylthiosulfinyl, etc.), sulfinamoyl, phosphoryl, nitro, imino groups, N-carbonylimino groups (N-acetylimino, etc.), N-sulfonylimino groups (N-methanesulfonylimino, etc.), dicyanoethylene, ammonium, sulfonium, phosphonium, pyrilium and immonium, and comprised are hetero rings where ammonium, sulfonium, phosphonium and immonium form the ring. The substituents with the up value of 0.30 or more are especially preferable.

The alkyl groups represented by $W_7$ include methyl, ethyl, trifluoromethyl and the like, the alkenyl groups include vinyl, halogen substituted vinyl, cyanovinyl, and the like, the alkynyl groups include acetylenyl, cyanoacetylenyl and the like, the aryl groups include nitrophenyl, cyanophenyl, pentafluorophenyl, and the like, and the hetero rings include pyridyl, pyrimidyl, triazyl, succinimide, tetrazolyl, triazolyl, imidazolyl, benzoxazolyl and the like. As $W_7$, the electron withdrawing group with positive σp value is preferable, and further the value is preferably 0.30 or more.

In the above substituents of $R_7$, preferably included are hydroxyl, mercapto, alkoxy, alkylthio groups, halogen atoms, organic or inorganic salt of hydroxyl or mercapto group, and hetero ring, more preferably included are hydroxyl, alkoxy, organic or inorganic salt of hydroxyl or mercapto group and hetero ring, and especially preferably included is organic or inorganic salt of hydroxyl or mercapto group.

Specific examples of the compounds of the Formula (G) include the compounds CN-01 to CN-13 described in the columns of 13 to 14 of U.S. Pat. No. 5,545,515, the compounds HET-01 to HET-02 described in the column 10 of U.S. Pat. No. 5,635,339, the compounds MA-01 to MA-07 described in the columns of 9 to 10 of U.S. Pat. No. 5,654,130, the compounds IS-01 to IS-04 described in the columns of 9 to 10 of U.S. Pat. No. 5,705,324, and the compounds 1-1 to 218-2 described in [0043] to [0088] of JP-A-2001-125224, and the like.

Vinyl compound examples preferably used in the invention are shown below, but the invention is not limited thereto.

(G-1)

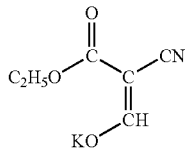

-continued (G-2)

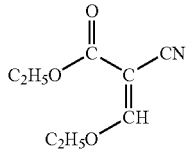

(G-3)

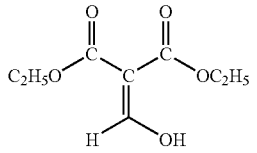

(G-4)

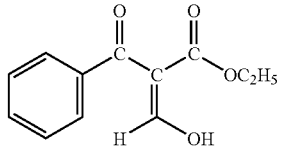

(G-5)

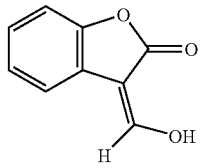

(G-6)

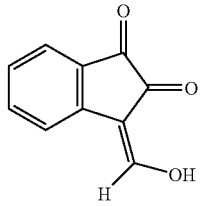

(G-7)

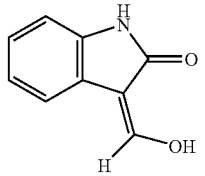

(G-8)

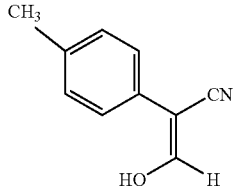

(G-9)

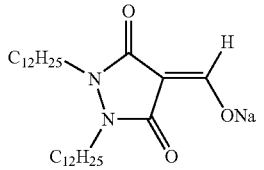

-continued (G-10)

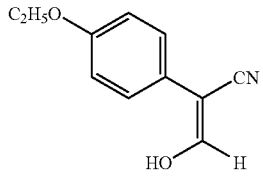

The onium compound represented by Formula (P) is described. In the formula, Q represents a nitrogen or phosphorus atom, $R_{55}$, $R_{56}$, $R_{57}$ and $R_{58}$ each represent hydrogen atoms or substituents, and $X_{55}$ represents anion. Besides, $R_{55}$ to $R_{58}$ may be linked one another to form a ring.

The substituents represented by $R_{55}$ to $R_{58}$ include alkyl groups (methyl, ethyl, propyl, butyl, hexyl, cyclohexyl, etc.), alkenyl groups (allyl, butenyl, etc.), alkynyl groups (propargyl, butynyl, etc.), aryl groups (phenyl, naphthyl, etc.), heterocyclic groups (piperidinyl, piperadinyl, morpholinyl, pyridyl, furyl, thienyl, tetrahydrofuryl, tetrahydrothienyl, sulfolanyl, etc.), amino groups and the like.

The rings which $R_{55}$ to $R_{58}$ can be linked one another to form include piperidine, morpholine, piperazine, quinuclidine, pyridine, pyrrole, imidazole, triazole, tetrazole rings and the like.

The groups represented by $R_{55}$ to $R_{58}$ may have substituents such as hydroxyl, alkoxy, aryloxy, carboxyl, sulfo, alkyl and aryl groups. $R_{55}$, $R_{56}$, $R_{57}$ and $R_{58}$ are preferably hydrogen atoms and alkyl groups.

Anions represented by $X_{55}$ include inorganic and organic anions such as halogen ion, sulfate ion, nitrate ion, acetate ion, p-toluene sulfonate ion and the like.

The above quaternary onium compounds can be readily synthesized according to the methods known in the art, and for example, the above tetrazolium compounds can refer to the method described in Chemical Review, Vol. 55 pages 335 to 483.

The addition amount of the above silver saving agent is from $1\times10^{-5}$ to 1 mol, and preferably in the range of $1\times10^{-4}$ to $5\times10^{-1}$ mol per 1 mol of the organic silver salt.

In the present invention, it is preferred that at least one type of the silver saving agent is the silane compound. As the silane compounds used as the silver saving agent, preferred are alkoxy silane compounds or salts thereof having two or more primary or secondary amino groups as described in JP-2001-192698.

Here, having two or more primary or secondary amino groups indicates comprising two or more of only primary amino groups, two or more of only secondary amino groups, and further one or more of the primary and secondary amino groups, respectively. The salt of alkoxy silane compound indicate an addition compound of an organic or inorganic acid capable of forming onium salt with amino group and the alkoxy silane compound.

Such alkoxy silane compounds or salts thereof can include those described below, but in the invention, as long as it is the alkoxy silane compound or the salt thereof having two or more intramolecular primary or secondary amino groups, it is not limited to these compounds.

(S-1)

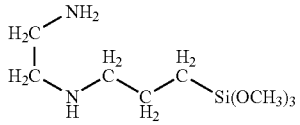

(S-2)

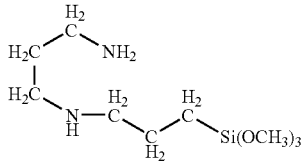

(S-3)

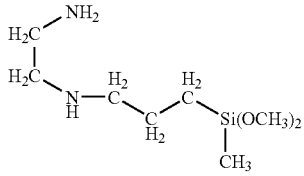

(S-4)

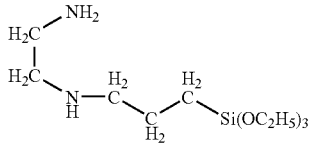

(S-5)

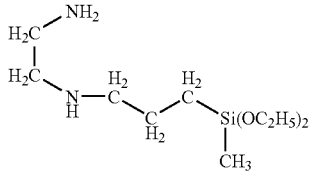

(S-6)

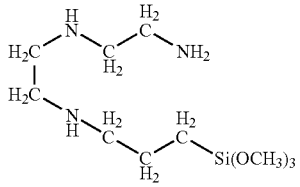

(S-7)

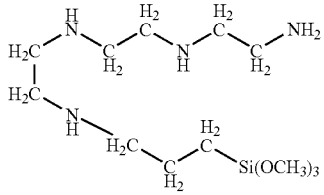

(S-8)

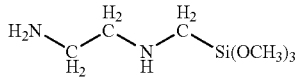

(S-9)

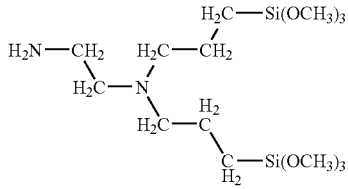

-continued (S-10)

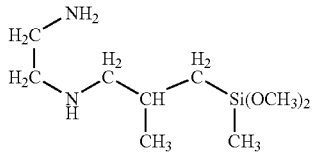

(S-11)

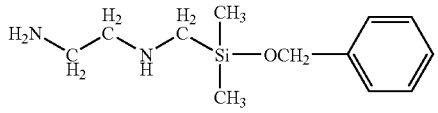

(S-12)

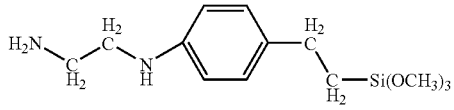

In these compounds, as the alkoxy group which forms alkoxy silyl, the alkoxy group made up of saturated hydrocarbon is preferable, and further, methoxy, ethoxy and isopropoxy groups are preferable because of being more excellent in storage stability. Also, for the purpose of reducing sensitivity variation due to the storage condition before the thermal development, more preferable are the compounds having no unsaturated hydrocarbon in the molecule. Besides, these alkoxy silane compounds or the salts thereof may be used alone or in combination of two or more.

Also, it is preferred that the image forming layer contains Schiff base formed from dehydrated condensation reaction of the alkoxy silane compound having at least one or more primary amino group with the ketone compound. The use of such Schiff base can save the amount of silver, and affords the images where the photographic fog is low, sensitivity variation is low and gamma does not extremely rise regardless the storage condition before the thermal development. Furthermore, since the primary amine moiety is precedently blocked, when a ketone type solvent is used in the preparation of an image forming layer forming coating liquid described below, it is possible to inhibit the sensitivity variation due to elapsed time after the preparation of the coating liquid.

The ketone compound used for forming Schiff base with the above alkoxy silane compound can be used with no special limitation, but in terms of an odor issue caused when the image is formed by an image formation method described below, those with boiling point of 150° C. or below are preferable, and further those with boiling point of 100° C. or below are more preferable.

Such a Schiff base can include the compounds shown below, but it is not limited thereto as long as it is the Schiff base formed from the dehydrated condensation reaction of alkoxy silane compound having one or more primary amino groups with the ketone compound.

In the above compounds, for the purpose further saving the silver amount, Schiff base having one or more secondary amino groups in the molecule is more preferable. These Schiff bases may be used alone or in combination of two or more.

When alkoxy silane compound or the salt thereof or Schiff base is added in the image forming layer as the silver saving agent, it is preferable to typically add at the range of 0.00001 to 0.05 mol based on 1 mol of the silver. Also when alkoxy silane compound or the salt thereof and Schiff base are added in the image forming layer, both are in the same range.

However, when the addition amount of the above alkoxy silane compound and Schiff base based on 1 mol of the silver slightly increases, there are some cases where the image density at the unexposed part formed by the image formation method described below becomes high. Thus, for the purpose of moderating dependency of the addition amount of alkoxy silane compound or Schiff base to be added based on 1 mol of the silver, it is preferable to further add isocyanate compound having two or more isocyanate groups into the molecule of the image forming layer. As isocyanate compound, it is possible to use the isocyanate compounds used as the crosslinker described above.

[Antifoggant and Image Stabilizer]

Next, described are an Antifoggant and an image stabilizer used for materials of the embodiments.

Since as the reducing agent used in the embodiments, mainly the reducing agent such as bisphenols and sulfonamidephenols having proton is used, it is preferable to contain compounds capable of inactivating the reducing agent by producing active species capable of withdrawing these hydrogen atoms. Suitably, preferred is the compound as colorless photooxidation substance capable of producing free radicals as reaction active species at exposure.

Therefore, it may be any compound as long as it is the compound having these functions, but organic free radical made up of multiple atoms is preferable. It may be the compound having any structure as long as it is the compound having such functions and which cause no special adverse effect on the photothermographic imaging material. Also, the compounds which produce these free radicals are preferably those having carbocyclic or heterocyclic aromatic groups in order to make produced free radicals have stability capable of contacting sufficiently to react with and inactivate the reducing agent.

Representatives of these compounds can include biimidazolyl compounds and iodonium compounds.

The addition amount of the above biimidazolyl compounds and iodonium compounds is in a range of 0.001 to 0.1 mol/$m^2$, and preferably, 0.005 to 0.05 mol/$m^2$. Besides, the compounds can be contained also in any component layer of the material in the invention. However, they are preferred to be contained in the vicinity of the reducing agent.

Also, as Antifoggants and image stabilizers, many compounds which can release halogen atoms as active species are well known.

As specific examples of the compounds which produce these active halogen atoms, there are the compounds of the Formula (ST) shown below.

(ST)

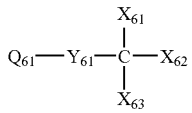

In the formula, $Q_6$ represents an aryl or heterocyclic group. $X_{61}$, $X_{62}$ and $X_{63}$ represent hydrogen atoms, halogen atoms, acyl, alkoxycarbonyl, aryloxycarbonyl, sulfonyl, or aryl groups, and at least one is the halogen atom. $Y_{61}$ represents —C(═O)—, —SO— or —$SO_2$—.

The aryl group represented by $Q_{61}$ may be monocyclic or condensed cyclic, is preferably the monocyclic or bicyclic aryl group with 6 to 30 carbons (e.g., phenyl, naphthyl, etc.), more preferably phenyl or naphthyl group, and still preferably phenyl group.

The heterocyclic group represented by $Q_{61}$ is the 3- to 5-membered saturated or unsaturated heterocyclic group comprising at least one of N, O or S, and this may be monocyclic or may form a condensed ring with the other ring. The heterocyclic groups are preferably 5- to 6-membered unsaturated heterocyclic groups which may have condensed rings, and more preferably 5- to 6-membered aromatic heterocyclic groups which may have condensed rings. The heterocyclic groups are still preferably 5- to 6-membered aromatic heterocyclic groups which may have condensed rings comprising nitrogen atoms, and especially preferably 5- to 6-membered aromatic heterocyclic groups which may have condensed rings comprising 1 to 4 nitrogen atoms.

Heterocyclic groups in such heterocyclic groups preferably include those described in the paragraph [0268] of JP-A-2002-287299, and are more preferably imidazole, pyridine, pyrimidine, pyrazine, pyridazine, triazole, triazine, thiadiazole, quinoline, phthalazine, naphthylidine, quinoxaline, quinazoline, cinnoline, tetrazole, thiazole, benzimidazole and benzothiazole, and especially preferably, pyridine, thiadiazole, quinoline and benzothiazole.

The aryl groups and the heterocyclic groups represented by $Q_{51}$ may have substituents in addition to $—Y_{61}-C(X_{61})(X_{62})(X_{63})$. The substituents preferably include those described in the paragraph [0269] of JP-A-2002-287299, and are more preferably alkyl, aryl, alkoxy, aryloxy, acyl, acylamino, sulfonylamino, sulfamoyl, carbamoyl groups, halogen atoms, cyano, nitro and heterocyclic groups, and especially preferably alkyl, aryl groups and halogen atoms.

$X_{61}$, $X_{62}$ and $X_{63}$ are preferably halogen atoms, haloalkyl, acyl, alkoxycarbonyl, aryloxycarbonyl, carbamoyl, sulfamoyl, sulfonyl and heterocyclic groups, more preferably halogen atoms, haloalkyl, acyl, alkoxycarbonyl, aryloxycarbonyl and sulfonyl, and especially preferably halogen atoms. In the halogen atoms, chlorine, bromine and iodine atoms are preferable, chlorine and bromine atoms are more preferable, and bromine atoms are especially preferable.

$Y_{61}$ represents —C(═O)—, —SO—, or $—SO_2—$, and is preferably $—SO_2—$.

The addition amount of these compounds is preferably in the range where the increase of printout silver due to the production of silver halide does not substantially become problematic. It is preferred that their percentage (mass) for the compounds which produce no active halogen radical is 150% or less at the maximum, and preferably 100% or less. Specific examples of these compounds which produce active halogen radicals can include the compounds (III-1) to (III-23) described in the paragraph numbers of [0086] to [0087] of JP-A2002-169249.

Next, described are antifoggants preferably used in the invention. Such antifoggants can include, for example, the compound examples a to j described in the paragraph [0012] of JP-A-8-314059, thiosulfonate esters A to K described in the paragraph [0028] of JP-A-7-209797, the compound examples (1) to (44) described from page 14 of JP-A-55-140833, the compounds (I-1) to (I-6) described in the paragraph [0063] and (C-1) to (C-3) described in the paragraph [0066] of JP-A-2001-13627, the compounds (III-1) to (III-108) described in the paragraph [0027] of JP-A-2002-90937, the compounds VS-1 to VS-7, the compounds HS-1 to HS-5 described in the paragraph [0013] of JP-A-6-208192 as the compounds of vinylsulfones and/or β-halosulfones, the compounds of KS-1 to KS-8 described in JP-A-330235 as sulfonylbenzotriazole compounds, PR-01 to PR-08 described in JP-T-2000-515995 as substituted propenenitrile compounds, and the like.

The above Antifoggant is generally used at the amount of at least 0.001 mol per mol of the silver. —Typically, the range thereof is from 0.01 to 5 mol per 1 mol of the silver, and preferably from 0.02 to 0.6 mol per 1 mol of the silver.

In addition to the above compounds, the compound known as the Antifoggant in earlier technology may be comprised in the photothermographic imaging material of the invention, and may be the compound capable of producing the same reaction active species as the above compounds or may be the compound with different inhibition mechanism. For example, included are the compounds described in U.S. Pat. Nos. 3,589,903, 4,546,075, 4,452,885, JP-A-59-57234, U.S. Pat. Nos. 3,874,946, 4,756,999, JP-A-9-288328, and JP-A-9-90550. Additionally, the other Antifoggants include the compounds disclosed in U.S. Pat. No. 5,028,523, EP Nos. 600,587, 605,981, 631,176 and the like.

When the reducing agent used for the invention has aromatic hydroxy group (—OH), especially in the case of bisphenols, it is preferable to combine a non-reducing compound having a group capable of forming hydrogen bond with these groups. In the present invention, especially preferable specific examples of hydrogen bonding compounds include the compounds (UU-1) to (II-40) described in [0061] to [0064] of JP-A-2002-90937.

[Toning Agent]

The materials of the embodiments are those where photographic images are formed by thermal development, and it is preferred that a toning agent which regulates color tone of the silver if necessary is usually contained in (organic) binder matrix at the dispersed state.

The suitable toning agents used for the invention are disclosed in RD 17029, U.S. Pat. Nos. 4,123,282, 3,994,732, 3,846,136 and 4,021,249, and for example, include the followings.

Included are imides (e.g., succinimide, phthalimide, naphthalimide, N-hydroxy-1,8-naphthalimide, etc.); mercaptans (e.g., 3-mercapto-1,2,4-triazole, etc.); phthalazine derivatives or metallic salts of these derivatives (e.g., phthalazine, 4-(1-naphthyl) phthalazine, 6-chlorophthalazine, 5,7-dimethyloxyphthalazine and 2,3-dihydro-1,4-phthalazione, etc.); the combination of phthalazine and phthalic acid (e.g., phthalic acid, 4-methylphthalic acid, 4-nitrophthalic acid and tetrachlorophthalic acid, etc.); and the combination of phthalazine, maleic acid anhydride and at least one compound selected from phthalic acid, 2,3-naphthalene dicarboxylate or o-phenylenic acid derivatives and anhydrides thereof (e.g., phthalic acid, 4-methylphthalic acid, 4-nitrophthalic acid and tetrachlorophthalic acid anhydride, etc.).

Especially preferable toning agents are phthalazine or the combination of phthalazine with phthalic acid, phthalic acid anhydride.

[Fluorinated Surfactnat]

In the present invention, in order to improve film transport property and environmental aptitude (accumulation in vivo) in a thermal development apparatus, fluorinated surfactants represented by the Formula (SF) are used.

$$(Rf—(L_5)_{n1}—)_p—(Y)_{m1}—(A)_q \quad (SF)$$

In the Formula (SF), as the fluorine atom-containing substituents represented by Rf, include are, for example, alkyl groups with 1 to 25 carbons, which are substituted with fluorine atoms (methyl, ethyl, butyl, octyl, dodecyl and octadecyl groups, etc., which are substituted with fluorine atoms), or alkenyl groups, which are substituted with fluorine atoms (propenyl, butenyl, nonenyl and dodecenyl groups, etc., which are substituted with fluorine atoms).

$L_5$ represents a bivalent linkage group containing no fluorine atom, and the bivalent linkage groups containing no fluorine atom include, for example, alkylene groups (methylene, ethylene, butylene groups, etc.), alkyleneoxy groups (methyleneoxy, ethyleneoxy, butyleneoxy groups, etc.), oxyalkylene groups (oxymethylene, oxyethylene, oxybutylene groups, etc.), oxyalkyleneoxy groups (oxymethyleneoxy, oxyethyleneoxy, oxyethyleneoxyethyleneoxy groups, etc.), phenylene, oxyphenylene, phenyloxy, oxyphenyloxy groups or the combination thereof, and the like.

A represents an anion group or a salt group thereof, and for example, includes carboxylic acid group or the salt group thereof (sodium, potassium and lithium salts), sulfonic acid group or the salt group thereof (sodium, potassium and lithium salts), and phosphoric acid group or the salt group thereof (sodium, and potassium salts).

Y represents a tervalent or tetravalent linkage group having no fluorine atom, and for example, includes atomic groups which are tervalent or tetravalent linkage group having no fluorine atom and made up of mainly carbon and nitrogen atoms, and n1 and m1 represent integers of 0 or 1, and preferably 1.

The fluorinated surfactants represented by the Formula (SF) can be obtained by further introducing the anion group (A) for example by sulfate esterification to the compound (alkanol compound with partial Rf) obtained by the addition reaction or the condensation reaction of a fluorine atom-introducing alkyl compound (the compounds having trifluoromethyl, pentafluoroethyl, perfluorobutyl, perfluorooctyl and perfluorooctadecyl groups, etc.) and an alkenyl compound (the compounds having perfluorohexenyl, perfluorononenyl groups, etc.) with 1 to 25 carbons, with a trivalent to hexavalent alkanol compound introducing no fluorine atom, an aromatic compound or a hetero compound having 3 to 4 hydroxy groups introducing no fluorine atom.

The above tervalent to hexavalent alkanol compound includes glycerine, pentaerythritol, 2-methyl-2-hydroxymethyl-1,3-propanediol, 2,4-dihydroxy-3-hydroxymethylpentene, 1,2,6-hexanetriol, 1,1,1-tris (hydroxymethyl) propane, 2,2-bis (butanol)-3, aliphatic triol, tetramethylolmethane, D-sorbitol, xylitol, D-mannitol and the like. Also, the aromatic compound and hetero compound with the above 3 to 4 hydroxy groups include 1,3,5-trihydroxybenzene and 2,4,6-trihydroxypyridine.

Hereinafter, shown are preferable specific examples of the fluorinated surfactants represented by the Formula (SF).

SF-1

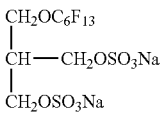

SF-2

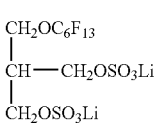

SF-3

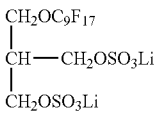

-continued

SF-4

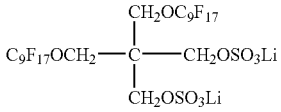

SF-5

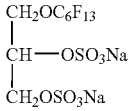

SF-6

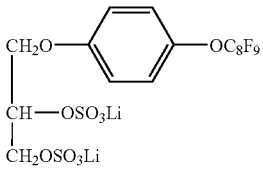

SF-7

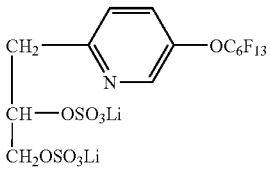

SF-8

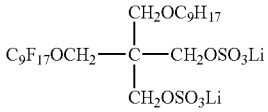

SF-9

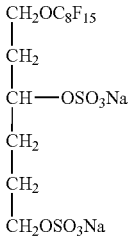

SF-10

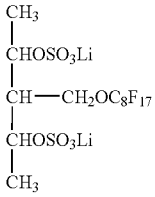

SF-11

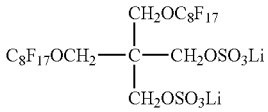

SF-12

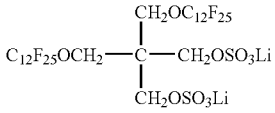

-continued

SF-13

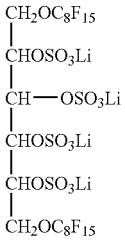

SF-14

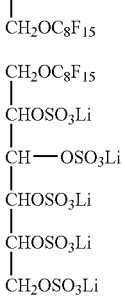

SF-15

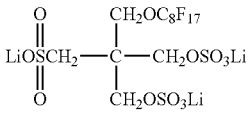

SF-16

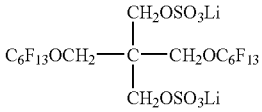

SF-17

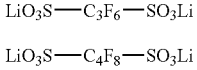

SF-18

These fluorinated can be added to the coating solution according to the methods known in the art. That is, it can be added by dissolving in polar solvents such as alcohols such as methanol and ethanol, ketones such as methylethylketone and acetone, methylsulfoxide, and dimethylformamide. Also it can be added by making into fine particles of 1 μm or less and dispersing in water or the organic solvent by sand mill dispersion, jet mill dispersion, ultrasonic dispersion and homogenizer dispersion. Numerous technologies are disclosed for fine particle dispersion technology, and the dispersion can be carried out according to these technologies.

It is preferred that the fluorinated surfactant represented by the Formula (SF) is added to the protection layer of the outermost layer. The addition amount of the fluorinated surfactant represented by the Formula (SF) of the invention is preferably from $1\times10^{-8}$ to $1\times10^{-1}$ mol per $m^2$, and especially preferably from $1\times10^{-5}$ to $1\times10^{-2}$ mol per $m^2$. When it is less than the former range, electrostatic property is not obtained whereas when it is over the former range, temperature dependency is high and storage stability under high temperature is deteriorated.

[Outer Layer]

In the materials of the embodiments, it is preferred that Lb/Le is 1.5 to 10, and more preferably, 2.0 to 10, when the mean particle size of matting agents comprised in an outermost face at the side having the image forming layer is made Le (μm), and that comprised in an outermost face at the side having the back coat layer is made Lb (μm). Density unevenness at thermal development can be improved by making Lb/Le this range.

In the present invention, it is preferred that organic or inorganic powder is used as the matting agent in the outer layer of the photothermographic imaging material (side of the image forming layer, also when non-photosensitive layer is installed at an opposite side of the image forming layer with interleaving the support) to control the object of the invention and surface roughness. As the used powder, it is preferable to use the powder with Mohs hardness of 5 or more.

As the powder, it is possible to use by appropriately selecting inorganic or organic powders known in the art. The inorganic powders can include, for example, titanium oxide, boron nitride, $SnO_2$, $SiO_2$, $Cr_2O_3$, α-$Al_2O_3$, α-$Fe_2O_3$, α-FeOOH, SiC, cerium oxide, corundum, artificial diamond, pomegranate stone, garnet, mica, silica stone, silicon nitride, silicon carbide and the like. The organic powders can include, for example, powders of polymethylmethacrylate, polystyrene, Teflon (R) and the like. In these, preferred are the inorganic powders such as $SiO_2$, titanium oxide, α-$Al_2O_3$, α-$Fe_2O_3$, α-FeOOH, $Cr_2O_3$, mica and the like, and especially preferable is $SiO_2$.

In the present invention, it is preferred that the powder has been surface-treated with Si compound and/or Al compound. When the powder with such surface treatment is used, it is possible to make the surface state of an uppermost layer good. For the content of the Si and/or Al, preferably Si is from 0.1 to 10% and Al is from 0.1 to 10%, and more preferably Si is from 0.1 to 5% and Al is 0.1 to 5%, and especially preferably Si is 0.1 to 0.2% and Al is 0.1 to 2% by mass based on the powder. Also it is better that the mass ratio of Si to Al is Si<Al. The surface treatment can be carried out by the method described in JP-A-2-83219. The mean particle size of the powder in the invention means the average diameter in spherical powder, the average long axis length in needle-shaped powder, and the average value of maximum diagonal lines in the platy face in plate-shaped powder. It can be easily obtained from the measurement by electron microscopy.

The mean particle size of the above organic or inorganic powder is preferably from 0.5 to 10 μm, and more preferably, from 1.0 to 8.0 μm.

The mean particle size of the organic or inorganic powder comprised in the outermost layer at the side of the photosensitive layer is typically from 0.5 to 8.0 μm, preferably from 1.0 to 6.0 μm, and more preferably from 2.0 to 5.0 μm. The addition amount is typically from 1.0 to 20%, preferably from 2.0 to 15%, and more preferably from 3.0 to 10% by mass based on the amount of the binders used for the outermost layer (a hardening agent is included in the binder amount).

The mean particle size of the organic or inorganic powder comprised in the outermost layer at the opposite side of the photosensitive layer with interleaving the support is typically from 2.0 to 15.0 μm, preferably from 3.0 to 12.0 μm, and more preferably from 4.0 to 10.0 μm. The addition amount is typically from 0.2 to 10%, preferably from 0.4 to 7%, and more preferably from 0.6 to 5% by mass based on the amount of the binders used for the outermost layer (a hardening agent is included in the binder amount).

Also, a variation coefficient of particle size distribution is preferably 50% or less, more preferably 40% or less and especially preferably 30% or less.

Here, the variation coefficient of particle size distribution is a value represented by the following formula.

{(Standard deviation of particle sizes)/(Mean value of particle sizes)}×100

An addition method of the organic or inorganic powder may be the method for coating by precedently dispersing in the coating solution or the method where after coating the coating solution, the organic or inorganic powder is sprayed before the completion of drying. Also when multiple types of the powders are added, both methods may be combined.

[Support]

Materials of the support used for the materials of the embodiments include various polymer materials, glass, wool fabrics, cotton fabrics, paper, metals (aluminium etc.) and the like, but flexible sheets or those capable of being made into rolls are suitable in terms of handling as information recording materials. Therefore, as the support in the photothermographic imaging material of the invention, preferred are plastic films such as cellulose acetate film, polyester film, polyethylene terephthalate film, polyethylene naphthalate film, polyamide film, polyimide film, cellulose triacetate film, polycarbonate film or the like, and in the invention, the biaxially stretched polyethylene terephthalate film is especially preferable. A thickness of the support is from about 50 to 300 μm, and preferably from 70 to 180 μm.

It is possible to include conductive compounds such as metal oxide and/or conductive polymer in the component layer to improve the electrostatic property. These may be contained in any layer, but preferably is comprised in the backing layer, the surface protection layer at the side of the photosensitive layer, the under coating layer and the like. In the present invention, preferably used are the conductive compounds described in columns 14 to 20 of U.S. Pat. No. 5,244,773. Among others, in the invention, it is preferable to contain the conductive metal oxide in the surface protection layer at the side of the backing layer. It has been found that this further enhances the effects of the invention (especially, transport property at the thermal development).

Here, the conductive metal oxide is crystalline metal oxide particle. Those comprising oxygen defect and those comprising heterogenous atoms at a small amount which form donors for the metal oxide used are especially preferable because they are highly conductive in general. In particular, the latter is especially preferable because they do not give the photographic fog to the silver halide emulsion. As examples of the metal oxide, preferred are ZnO, $TiO_2$, $AnO_2$, $Al_2O_3$, $In_2O_3$, $SiO_2$, MgO, BaO, $MoO_3$, $V_2O_5$ and the like, or composite oxides thereof, and in particular ZnO, $TiO_2$ and $SnO_2$ are preferable. As examples comprising heterogenous atoms, for example, the addition of Al, In to ZnO, the addition of Sb, Nb, P, halogen elements to $SnO_2$, and the addition of Nb, Ta to $TiO_2$ are effective. The addition amount of these heterogenous atoms is preferably in the range of 0.01 to 30 mol %, and the range of 0.1 to 10 mol % is especially preferable. Further also, to improve fine particle dispersibility and transparency, silicon compounds may be added at making fine particles.

The metal oxide particles used for the invention have conductivity, and volume resistance rate thereof is $10^7$ Ω·cm or less, and especially $10^5$ Ω·cm or less. These oxides are described in JP-A-56-143431, JP-A-56-120519 and JP-A-58-62647. Additionally also, as described in JP-B-59-6235, conductive materials where the above metal oxide is accreted to the other crystalline metal oxide particles or fibrous matters (titanium oxide, etc.) may be used.

The particle size which can be utilized is preferably 1 μm or less, but when it is 0.5 μm or less, stability after the dispersion is good and the particles are easy-to-use. Also, to make light scattering small as possible, when the conductive particles of 0.3 μm or less are utilized, it becomes possible to form the clear imaging material, and thus it is extremely preferable. Also when the conductive metal oxide is needle-shaped or fibrous, it is preferred that the length is 30 μm or less and the diameter is 1 μm or less, and especially preferable is that the length is 10 μm or less, the diameter is 0.3 μm or less and a length/diameter ratio is 3 or more. Besides, $SnO_2$ is commercially available from Ishihara Sangyo Co. Ltd., and it is possible to use SNS10M, SN-100P, SN-100D, FSS10M and the like.

The materials of the embodiments have the image forming layer which is at least one layer of the photosensitive layer on the support. Only the image forming layer may be formed on the support, but it is preferred that at least one layer of the non-photosensitive layer is formed on the image forming layer. For example, it is preferred that the protection layer is installed on the image forming layer for the purpose of protecting the image forming layer, and the back coat layer is installed at the opposite side of the support to prevent "sticking" between the photothermographic imaging materials or at the photothermographic imaging material roll.

As the binders used for these protection layer and back coat layer, selected are polymers where the glass transition temperature (Tg) is higher than that in the image forming layer and scratch and deformation unlikely occur, such as cellulose acetate and cellulose acetate butyrate from the binders.

For adjusting gradation, two or more of the image forming layers may be placed at one side of the support, or one or more may be placed at both side of the support.

[Dye]

In the materials of the embodiments, it is preferred that a filter layer is formed at the same side or the opposite side of the image forming layer, or dyes or pigments are contained in the image forming layer in order to control the amount or wavelength distribution of light transmitting the image forming layer.

As the used dyes, it is possible to use the compounds known in the art, which absorb light in various wavelength areas depending on color sensitivity of the materials. For example, in the case of making the materials, an image recording material by infrared light, it is preferable to use squalirium dye having thiopyrylium nuclei (herein called thiopyrylium squalirium dye) and squalirium dye having pyrylium nuclei (herein called pyrylium squalirium dye) as disclosed in JP-A-2001-83655, and thiopyrylium chroconium dye or pyrylium chroconium dye which are similar to squalirium dyes.

The compounds having squalirium nuclei are the compound having 1-cyclobutene-2-hydroxy-4-one in the molecular structure, and the compounds having chroconium nuclei are the compounds having 1-cyclopentene-2-hydroxy-4,5-dione in the molecular structure. Here, the hydroxy groups may be dissociated. Hereinafter, herein, these pigments are collectively called squalirium dyes for convenience. As the dye, the compounds of JP-A-8-201959 are also preferable.

[Coating of Component Layer]

It is preferred that the materials of the embodiments are formed by making the coating solutions where the materials of each component layer described above are dissolved or dispersed in the solvent, overlaying and coating these coating solutions in plurality simultaneously, and then performing the treatment with heat. Here, "overlaying and coating in plurality simultaneously" means that the coating solution of each component layer (photosensitive layer, protection layer and the like) is made, coating and drying are not repeated for each layer when coated on the support, and each component layer can be formed in the state where overlaying and coating is simultaneously performed and the drying step can be also simultaneously performed. That is, an upper layer is installed before a remaining amount of the total solvent in a lower layer becomes 70% or less by mass.

The method where respective layers are overlaid and coated in plurality simultaneously is not especially limited, and for example, it is possible to use the methods known in the art such as a bar coater method, curtain coat method, immersion method, air knife method, hopper coating method, and extrusion coating method. In these, preferred is the coating manner of previous measure type called the extrusion coating method. The extrusion coating method is suitable for precise coating and organic solvent coating because there is no volatilization on a slide face such as a slide coating method. This coating method was described for the side having the photosensitive layer, but it is the same in the case of coating along with the under coating layer when the back coat layer is installed. The simultaneous overlaying and coating method in the materials of the embodiments is described in JP-A-2000-15173 in detail.

In the present invention, it is preferable to select an appropriate amount depending on the purpose of the materials. In the case of making an image for medical use a target, the amount is preferably 0.3 to 1.5 g/m$^2$, and more preferably 0.5 to 1.5 g/m$^2$. It is preferred that in the coated silver amount, the amount derived from the silver halide is from 2 to 18% based on the total silver amount. More preferably it is from 5 to 15%.

Also, in the present invention, a coating density of the silver halide grains of 0.01 μm or more (converted particle size of a corresponding sphere) is preferably $1\times10^{14}$ to $1\times10^{18}$/m$^2$, and more preferably $1\times10^{15}$ to $1\times10^{17}$/m$^2$.

Furthermore, the coating density of the non-photosensitive long chain aliphatic carboxylate silver is $1\times10^{-17}$ to $1\times10^{-14}$ g, and more preferably $1\times10^{-16}$ to $1\times10^{-15}$ g per silver halide particle of 0.01 μm or more (converted particle size of a corresponding sphere).

When coated in the condition within the above range, the preferable effects are obtained in terms of optical maximum density of silver image per constant coated silver amount (covering power) and the color tone of the silver image.

In the present invention, it is preferred that the solvent at the range of 5 to 1,000 mg/m$^2$ is contained at the development. It is more preferable to adjust to be 100 to 500 mg/m$^2$. That makes the photothermographic imaging material with high sensitivity, low photographic fog and high maximum density.

The solvents include those described in [0030] of JP-A-2001-264930. But it is not limited thereto. Also these solvents can be used alone or in combination of several types.

The content of the above solvent in the materials can be adjusted by condition changes such as temperature condition and the like in the drying step after the coating step. Also, the content of the solvent can be measured by gas chromatography under the condition suitable for detecting the contained solvent.

[Wrapping Body]

When the materials of the embodiments are stored, it is preferable to store by housing in a wrapping body in order to prevent density change and occurrence of photographic fog with time. A void ratio in the wrapping body could be from 0.01 to 10%, and preferably from 0.02 to 5%. A nitrogen partial pressure in the wrapping body could be made 80% or more, and preferably 90% or more by performing nitrogen charging.

[Exposure of Photothermographic Imaging Material]

In the materials of the embodiments, it is common to use laser beam when recording the image. At exposure of the materials, it is desirable to use a proper light source for the color sensitivity imparted to the material. For example, when the materials are made one which can be sensitive to the infrared light, it can be applied for any light sources in the infrared light area, but infrared semiconductor laser 780 nm, 820 nm) is preferably used in terms of points where laser power is high and the material can be made transparent.

In the present invention, it is preferred that the exposure is carried out by laser scanning exposure, but various methods can be employed for the exposure methods. For example, the first preferable method includes the method using a laser scanning exposure machine where angles made by an exposure face of the imaging material and the scanning laser beam do not substantially become perpendicular.

Here, "do not substantially become perpendicular" is referred to the angels of preferably 55° to 88°, more preferably 60° to 86°, still preferably 65° to 84°, most preferably 70° to 82° as the angle most closed to the perpendicular during the laser scanning.

The diameter of a beam spot on the exposure face of the materials when the laser beam is scanned on the materials is preferably 200 μm or less, and more preferably 100 μm or less. This is preferable in that the smaller spot diameter can reduce a "shift angle" from the perpendicular of a laser beam entry angle. A lower limit of the beam spot diameter is 10 μm. By performing the laser scanning exposure in this way, it is possible to reduce image quality deterioration due to reflected light such as an occurrence of interference fringe like unevenness.

Also, as the second method, it is also preferred that the exposure in the invention is carried out using a laser scanning exposure machine which emits the scanning laser beam which is vertical multiple mode. Compared to the scanning laser beam in vertical single mode, it further reduces the image quality deterioration such as the occurrence of interference fringe like unevenness. To make the vertical multiple mode, the method by combining lights, the method by utilizing returned light and the method by loading high frequency superposition could be used. The vertical multiple mode means that the exposure wavelength is not a single, and typically the distribution of exposure wavelength could be 5 nm or more, and preferably 10 nm or more. An upper limit of the exposure wavelength is not especially limited, but typically is about 60 nm.

Furthermore, as the third method, it is preferable to form the image by scanning exposure using two or more laser beams. Such an image recording method by utilizing multiple laser beams is the technology used for image writing means of laser printers and digital copying machines where the image with multiple lines are written by one scanning on the requisition of high resolution and high speed, and for example is known by JP-A-60-166916. This is the method where the laser beam emitted from the light source unit is deflected and scanned by polygon mirror, and the imaging is performed on the photosensitive body via fθ lens, and this is principally the same laser scanning optical apparatus as a laser imager and the like.

In the imaging of the laser beam on the photosensitive body in the image writing means of the laser printer and the digital copying machine, next laser beam is imaged with shifting by one line from the imaging site of one laser beam, for the use where multiple lines of the image are written by one scanning. Specifically, two light beam come close with an interval of some 10 μm order on an image face in a sub-scanning direction one another, when print density is 400 dpi (dpi indicates a dot number per inch=2.54 cm), the pitch of two beams in the sub-scanning direction is 63.5 μm, and in the case of 600 dpi, it is 42.3 μm. Differently from the method which shifs by resolution segment to the sub-scanning direction in this way, in the invention, it is preferred that the image is formed by condensing two or more lasers with different entry angles on the exposure face at the same site. At that time, it is preferable to make the range of $0.9\times E \leqq En\times N \leqq 1.1\times E$ when an exposure energy on the exposure face is E when written by typical one laser beam (wavelength λ[nm]), and when N of laser beams used for the exposure heve the same wavelength (wavelength λ[nm]) and the same exposure energy (En). The energy is secured on the exposure face in this way, the reflection of each laser beam to the image forming layer is reduced because the exposure energy of the laser is low, and thus the occurrence of interference fringe is inhibited.

In the above, multiple laser beams with the same wavelength as λ were used, but those with different wavelength may be used. In this case, it is preferable to make the range $(\lambda-30)<\lambda_1, \lambda_2 \ldots \lambda_n \leqq (\lambda+30)$.

In the image recording methods of the above first, second and third aspects, as the laser used for the scanning exposure, it is possible to use by appropriately selecting solid lasers such as ruby laser, YAG laser and glass laser; gas lasers such as He—Ne laser, Ar ion laser, Kr ion laser, $CO_2$ laser, CO laser, He—Cd laser, $N_2$ laser and excimer laser; semiconductor laser such as InGap laser, AlGaAs laser, GaAsP laser, InGaAs laser, InAs laser, $CdSnP_2$ laser and GaSb laser; chemical lasers and pigment lasers generally well-known in conjugation with the use, but in these, it is preferable to use the laser beam by the semiconductor laser with wavelength of 600 to 1200 nm in terms of the maintenance and the size of light source. In the laser beam used for the laser imager and laser image setter, when scanned on the photothermographic imaging material, the beam spot diameter on the exposure face of the material is generally in the range of 5 to 75 μm as a minor axis diameter and 5 to 100 μm as a major axis diameter. For the laser beam scanning velocity, an optimal value by photothermographic imaging material can be set by sensitivity and laser power at a laser oscillation wavelength inherent for the photothermographic imaging material.

[Thermal Development Apparatus]

The thermal development apparatus in here is made up of a film supplying portion represented by a film tray, a laser image recording portion, a photothermographic portion where uniform and stable heat is supplied on whole area of the materials in the embodiments, and a transport portion from the film supplying portion, via the laser recording, to discharge of the materials of the embodiments where the image is formed by the thermal development out of the apparatus. A specific example of this aspect of the thermal development apparatus is shown in FIG. 1.

A photothermographic apparatus 100 has a feeding portion 110 where a sheet-shaped material, for example, the photothermographic imaging material of the first embodiment (photothermographic element or also referred to as film simply) is fed by one, an exposure portion 120 where the fed film F is exposed, a developing portion 130 where the exposed film is developed, a cooling portion 150 where the development is stopped, and an accumulating portion 160, and made up of multiple rollers such as a supplying roller pair 140 for supplying the film F from the feeding portion, a supplying roller pair 144 for delivering the film to the developing portion, and transport roller pairs 141, 142, 143 and 145 for smoothly transporting the film between the portions. The developing portion is made up of a heat drum 1 having multiple opposed rollers 2 capable of heating with retaining in adherence with a periphery as a heating means for the development of the film F, and a peeling tab 6 for peeling the developed film F and delivering to the cooling portion.

When using a thermal development apparatus, a transport velocity of the material at the development portion (thermal development portion) is from 10 to 200 mm/sec, a transport velocity of the material from the feeding portion 110 (imaging material supplying portion) to the laser exposure portion 121 (image exposure portion) is from 10 to 200 mm/sec, and a transport velocity of the material at the laser exposure portion 121 is from 10 to 200 mm/sec.

The developing condition of the photothermographic imaging material varies depending on instruments, apparatus and means used, but typically, the development is carried out by heating the photothermographic imaging material exposed to an image at suitable high temperature. A latent image obtained after the exposure is developed by heating the photothermographic imaging material at moderately high temperature (from about 80 to 200° C., preferably from about 100 to 200° C.) for a sufficient time period (generally from about one second to about two minutes).

When the heating temperature is lower than 80° C., sufficient image density is not obtained in a short time, and when it is higher than 200° C., the binders are melted and adverse effects are given not only to the image itself but also to transport ability and a developing machine such as transfer to the rollers. The silver image is produced by an oxidation reduction reaction between the organic silver salt (functions as the oxidizing agent) and the reducing agent due to heating. This reaction process progresses with supplying no process liquid such as water or the like from the outside.

As instruments, apparatus or means for heating, for example, a hot plate, iron, hot roller, typical heating means as a thermogenesis machine using carbon or white titanium may be used. More preferably, in the photothermographic imaging material with the protection layer, it is preferred that heating process is carried out by contacting the face at the side having the protection layer with the heating means in terms of performing uniform heating, heat efficiency and working property. It is preferred that the development is performed by transporting and heat processing with contacting the face at the side having the protection layer with the heat rollers.

Further, when thermal developing, it is preferred to perform in a state containing 40 to 4500 ppm of organic solvent.

EXAMPLES

Hereinafter, the present invention is described in detail by examples, but the embodiments of the invention is not limited thereto. In addition "%" in the Examples represents "% by mass" when there is no special notice.

Example A-1

<Manufacture of Support Given Under Coating for Photograph>

Corona discharge treatment at 8 W/m$^2$·min was given to both faces of a commercially available PET film with thickness of 175 μm and optical density of 0.170 (measured by a densitometer PDA-65 supplied from Konica Corporation) biaxially stretched and thermally fixed which was colored with the following blue dye, the following under coating solution a-1 was applied on one side face such that the thickness of dried film is 0.8 μm, and was dried to make an under coating layer A-1. Also, the following under coating solution b-1 was applied on an opposite side face such that the thickness of dried film is 0.8 μm, and was dried to make an under coating layer B-1.

BLUE DYE

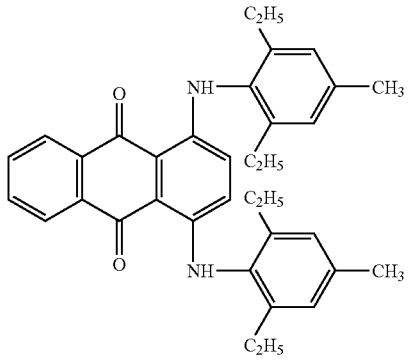

| | |
|---|---|
| (Under coat coating solution a-1) | |
| Copolymer latex solution of butyl acrylate/t-butyl acrylate/styrene/2-hydroxyethyl acrylate (30/20/25/25% ratio) (solid content 30%) | 270 g |
| (C-1) | 0.6 g |
| Hexamethylene-1,6-bis(ethylene urea) | 0.8 g |
| are filled up with water to 1 L. | |
| (Under coat coating solution b-1) | |
| Copolymer latex solution of butyl acrylate/styrene/glycidyl acrylate (40/20/40% ratio) (solid content 30%) | 270 g |
| (C-1) | 0.6 g |
| Hexamethylene-1,6-bis (ethylene urea) | 0.8 g |
| are filled up with water to 1 L. | |

Subsequently, the corona discharge treatment at 8 W/m$^2$·min was given to upper surfaces of the under coating layers A-1 and B-1 the following under coating upper layer coating solution a-2 was applied on the under coating layer A-1 such that the thickness of dried film is 0.1 μm as the under coating upper layer A-2, and the following under coating upper layer coating solution b-2 was applied on the under coating layer A-1 such that the thickness of dried film is 0.4 μm as the under coating upper layer B-2 which has antistatic function.

| | |
|---|---|
| (Under coating upper layer coating solution a-2) | |
| Gelatin amount corresponding to | 0.4 g/m$^2$, |
| (C-1) | 0.2 g |
| (C-2) | 0.2 g |
| (C-3) | 0.1 g |
| silica particles (mean particle size, 3 μm) | 0.1 g |
| are filled up with water to 1 L. | |
| (Under coating upper layer coating solution b-2) | |

-continued

| | |
|---|---|
| Sb doped $SnO_2$ (SNS10M supplied from Ishihara Sangyo Co. Ltd.) | 60 g |
| latex solution of which component is (C-4) (solid content 20%) | 80 g |
| ammonium sulfate | 0.5 g |
| (C-5) | 12 g |
| Polyethyleneglycol (mass average molecular weight) | 6 g |
| are filled up with water to 1 L. | |

(C-1)

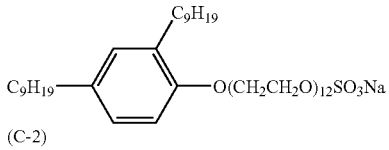

(C-2)

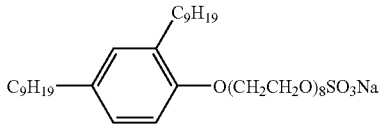

(C-3)

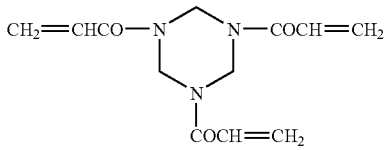

(C-4)

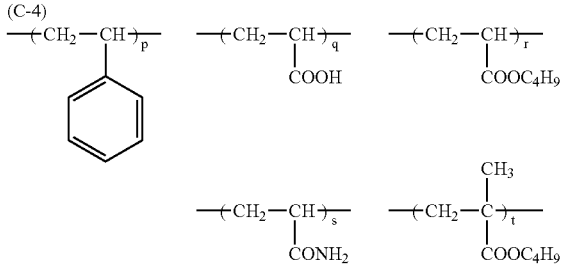

p:q:r:s:t = 40:5:10:5:40 (MASS RATIO)

(C-5)

THREE-IN-ONE MIXTURE OF

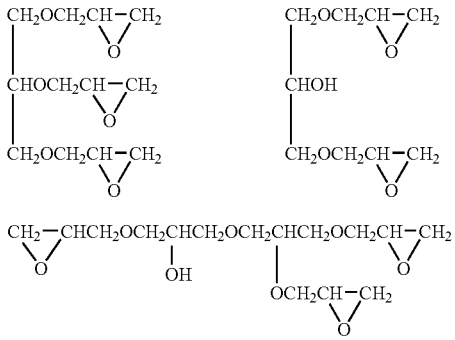

<Preparation of Back Coat Layer Coating Solution>

Cellulose acetate propionate (84.2 g)(Eastman Chemical Company, CAP 482-20) and polyester resin (4.5 g)(Bostic Inc., Vitel PE2200) were added and dissolved in methylethylketone (MEK) (830 g) with stirring. Next, 0.3 g of the following infrared dye 1 was added to the dissolved solution, further 4.5 g of Fluorinated type surfactant (Asahi Glass Co., Ltd., Surflon KH) and 2.3 g of Fluorinated type surfactant (Dainippon Ink And Chemicals, Incorporated, Megafag F 120K) dissolved in 43.2 g of methanol were added, and thoroughly stirred until dissolved. Next, 2.5 g of oleyloleate was added. Finally, 75 g of silica (W. R. Grace & Co., Inc., Syloid 64x6000) dispersed in MEK at a concentration of 1% by mass using a dissolver type homogenizer was added, and stirred to prepare the back coat layer coating solution.

INFRARED DYE 1

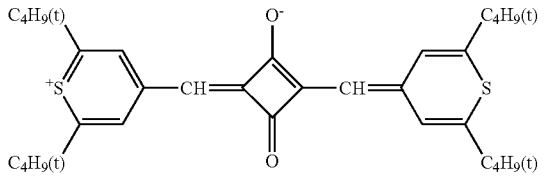

| | |
|---|---|
| <Preparation of back coat layer protection layer (surface protection layer) coating solution> | |
| Cellulose acetate butyrate (10% MEK solution) | 15 g |
| Monodisperse silica (mean particle size: 8 μm) with monodisperse degree of 15% (surface treated with aluminum at 1% by mass based on total weight of silica) | 0.03 g |
| $C_8F_{17}$ $(CH_2CH_2O)_{12}C_8F_{17}$ | 0.05 g |
| Fluorinated surfactant (SF-17) | 0.01 g |
| Stearic acid | 0.1 g |
| Oleyloleate | 0.1 g |
| α-alumina (Mohs hardness: 9) | 0.1 g |
| <Preparation of photosensitive silver halide emulsion A> | |
| (A1) | |
| Phenylcarbamoyled gelatin | 88.3 g |
| 10% methanol solution of compound (AO-1) | 10 ml |
| potassium bromide | 0.32 g |
| are filled up with water to 5429 ml. | |
| (B1) | |
| An aqueous solution of silver nitrate at 0.67 mol/L | 2635 ml |
| (C1) | |
| Potassium bromide | 51.55 g |
| potassium iodide | 1.47 g |
| are filled up with water to 660 ml | |
| (D1) | |
| Potassium bromide | 151.6 g |
| potassium iodide | 7.67 g |
| potassium hexachloroiridium (IV) acid (1% solution) $K_2$ $(IrCl_6)$ | 0.93 ml |
| potassium hexacyanoiron (II) acid | 0.004 g |
| potassium hexachloroosmium (IV) acid | 0.004 g |
| are filled up with water to 1982 ml. | |
| (E1) | |
| Aqueous solution of potassium bromide at 0.4 mol/L amount to control the following silver potential | |
| (F1) | |
| Potassium hydroxide | 0.71 g |
| is filled up with water to 20 ml. | |
| (G1) | |
| Aqueous solution of 56% acetic acid | 18.0 ml |
| (E1) | |
| Sodium carbonate anhydride | 1.72 g |
| is filled up with water to 151 ml | |
| AO-1:$HO(CH_2CH_2O)_n(CH(CH)_3CH_2O)_{17}(CH_2CH_2O)_mH$ (m + n = 5 to 7) | |

Using the mixing stirrer shown in JP-B-58-58288 and JP-B-58-58289, ¼ amount of the solution (B1) and total amount of the solution (C1) were added to the solution (A) with controlling the temperature at 20° C. and pAg at 8.09 by the simultaneous mixing method over 4 min 45 sec to perform the nuclear formation. After 1 min, the total amount of the solution (F1) was added. Using (E1), the pAg value was appropriately controlled in the meantime. After 6 min, ¾ amount of the solution (B1) and the total amount of the solution (D1) were added with controlling the temperature at 20° C. and pAg at 8.09 by the simultaneous mixing method over 14 min 15 sec. After stirring for 5 min, the temperature was lowered to 40° C. and the total amount of the solution (G1) was added to precipitate silver halide emulsion. Leaving 2000 ml of the precipitated portion, supernatant was eliminated, and 10 L of water was added to precipitate the silver halide emulsion again. Leaving 1500 ml of the precipitated portion, the supernatant was eliminated, 10 L of water was further added, then after stirring, the silver halide emulsion was precipitated again. Leaving 1500 ml of the precipitated portion, the supernatant was eliminated, subsequently, the solution (H1) was added, the temperature was elevated to 60° C., and the stirring was further performed for 120 min. Finally, pH was adjusted to 5.8 and water was added to become 1161 g per 1 mol of the silver amount to yield the photosensitive silver halide emulsion A.

This emulsion was made up of monodisperse cubic iodide bromide silver particles with mean particle size of 25 nm, variation coefficient of particle sizes of 12% and [100] face ratio of 92% (the content of AgI was 3.5 mol %).

<Preparation of Photosensitive Silver Halide Emulsion B>

The preparation was carried out as is the case with the preparation of photosensitive silver halide emulsion A, except that the temperature at addition by the simultaneous mixing method was changed to 40° C. This emulsion was made up of monodisperse cubic iodide bromide silver particles with mean particle size of 50 nm, variation coefficient of particle sizes of 12% and [100] face ratio of 92% (the content of AgI was 3.5 mol %).

<Preparation of Photosensitive Silver Halide Emulsion C>

The preparation was carried out as is the case with the preparation of the photosensitive silver halide emulsion A, except that the temperature at the addition by the simultaneous mixing method was changed to 10° C. This emulsion was made up of monodisperse cubic silver iodide bromide particles with mean particle size of 10 nm, variation coefficient of the particle sizes of 12% and [100] face ratio of 92% (the content of AgI was 3.5 mol %).

<Preparation of Photosensitive Silver Halide Emulsion D>

The preparation was carried out as is the case with the preparation of the photosensitive silver halide emulsion A, except that the temperature at the addition by the simultaneous mixing method was changed to 5° C. This emulsion was made up of monodisperse cubic silver iodide bromide particles with mean particle size of 8 nm, variation coefficient of the particle sizes of 12% and [100] face ratio of 92% (the content of AgI was 3.5 mol %).

<Preparation of Photosensitive Silver Halide Emulsion E>

The preparation was carried out as is the case with the preparation of the photosensitive silver halide emulsion A, except that the temperature at the addition by the simultaneous mixing method was changed to 45° C. This emulsion was made up of monodisperse cubic silver iodide bromide particles with mean particle size of 55 nm, variation coefficient of the particle sizes of 12% and [100] face ratio of 92% (the content of AgI was 3.5 mol %).

<Preparation of Powder Organic Silver Salt A>

Behenic acid (130.8 g), arachidic acid (67.7 g), stearic acid (43.6 g), and palmitic acid (2.3 g) were dissolved in 4720 ml of pure water at 80° C. Next, 540.2 ml of an aqueous solution of sodium hydroxide at 1.5 mol/L was added, and 6.9 ml of concentrated nitric acid was added, and subsequently the mixture was cooled to 55° C. to yield sodium fatty acid solution. With retaining the temperature of this sodium fatty acid solution at 55° C., the above photosensitive silver halide emulsion (type and amount described in Table 1-1), and 450 ml of pure water were added and stirred for 5 min.

Next, 468.4 ml of 1 mol/L silver nitrate solution was added over 2 min, and stirred for 10 min to yield an organic silver salt dispersion. Subsequently, the obtained organic silver salt dispersion was transferred to a water washing vessel, distilled water was added and stirred, then the organic silver salt dispersion was surfaced/separated by leaving at rest, and lower water-soluble salts were eliminated. Subsequently, water washing with distilled water and discharging water were repeated until the conductivity of the discharged water became 2 μS/cm, and centrifuge dehydration was carried out. The obtained cake-like organic silver salt was dried using a flash dryer, Flash Jet Dryer (supplied from Seishin Enterprise Co., Ltd.) by an operation condition of nitrogen gas atmosphere and hot wind temperature at a dryer inlet until the water content became 0.1% to yield the dried powder of organic silver salt A. From the result of analysis using the electron microscope for the photothermographic imaging material 1 (described below) made using this organic silver salt, the organic silver salt was made up of tabular particles with mean particle size (diameters of corresponding circles) of 0.08 μm, aspect ratio of 5 and monodisperse degree of 10%.

An infrared moisture meter was used for the measurement of the water content in the organic silver salt composition.

<Preparation of Predispersing Solution A>

As the image forming layer binder, a predispersing solution A was prepared by dissolving 14.57 g of —$SO_3K$ group-containing polyvinyl butyral (Tg: 75° C., 0.2 mmol/g of —$SO_3K$ is contained) in 1457 g of MEK, gradually adding 500 g of the powder organic silver salt A with stirring by a dissolver DISPERMAT CA-40M type supplied from VMA- GETZMANN, and thoroughly mixing.

<Preparation of Photosensitive Emulsion Dispersion 1>

A photosensitive emulsion dispersion 1 was prepared by supplying the predispersing solution A to a media type dispersion machine DISPERMAT SL-C12EX type (supplied from VMA- GETZMANN) in which zirconia beads (Toreselam, supplied from Toray Industries Inc.) with diameter of 0.5 mm were filled at 80% of inner volume such that a staying time in a mill is 1.5 min using a pump, and performing dispersion at a mill peripheral velocity of 8 m/s.

<Preparation of Stabilizer Solution>

A stabilizer solution was prepared by dissolving 1.0 g of a stabilizer 1 and 0.31 g of potassium acetate in 4.97 g of methanol.

<Preparation of Infrared Sensitizing Dye Solution A>

An infrared sensitizing dye solution A was prepared by dissolving 19.2 mg of the infrared sensitizing dye, 1.488 g of 2-chloro-benzoic acid, 2.779 g of the stabilizer 2 and 365 mg of 5-methyl-2-mercaptobenzimidazole in 31.3 ml of MEK in a dark place.

<Preparation of Addition Solution a>

An addition solution a was prepared by dissolving the reducing agent (the compound and amount described in Table 1-1), the compound (the compound and amount described in Tables 1 to 4) represented by the Formula (YA) or cyan coloring leuco dye (type and amount described in Table 1-1), 1.54 g of 4-methyl phthalate and 0.48 g of the infrared dye 1 in 110 g of MEK.

<Preparation of Additive Solution b>

The antifoggant 2 (1.56 g), 0.5 g of the antifoggant 3, 0.5 g of the antifoggant 4 and 3.43 g of phthalazine were dissolved in 40.9 g of MEK to prepare the additive solution b.

<Preparation of Addition Solution c>

An addition solution c was prepared by dissolving 0.5 g the silver saving agent (described in Table 1-2) as in 39.5 g of MEK.

<Preparation of Addition Solution d>

An addition solution d was prepared by dissolving 1.0 g of Supersensitizer 1 in 9.0 g of MEK.

<Preparation of Addition Solution e>

An addition solution e was made by dissolving 1.0 g of potassium p-toluene thiosulfonate in 9.0 g of MEK.

<Preparation of Additive Solution f>

The antifoggant containing 1.0 g of vinylsulfone [$CH_2{=}CH{-}SO_2CH_2)_2CHOH$] was dissolved in 9.0 g of MEK to prepare the additive solution f.

<Preparation of Image Forming Layer Coating Solution>

Under an inert gas atmosphere (nitrogen 97%), the photosensitive emulsion dispersion 1 (50 g) and 15.11 g of MEK were kept at 21° C. with stirring, 1000 μl of a chemical sensitizer S-5 (0.5% methanol solution) was added, after 2 min, 390 μl of the Antifoggant 1 (10% methanol solution) was added, and stirred for one hour. Further, 494 μl of calcium bromide (10% methanol solution) was added, stirred for 10 min, subsequently, a gold sensitizer Au-5 at the amount corresponding to 1/20 mol of the above organic chemical sensitizer was added, and further stirred for 20 min. Subsequently, 167 ml of the stabilizer solution was added, stirred for 10 min, then 1.32 g of the infrared sensitizing dye solution A was added, and stirred for one hour. Subsequently, the temperature was lowered to 13° C. and the stirring was performed for additional 30 min. With holding the temperature at 13° C., 6.4 g of the addition solution d, 0.5 g of the addition solution e, 0.5 g of the addition solution f, and 13.31 g of the binder used for the predispersing solution A were added, stirred for 30 min, then 1.084 g of tetrachlorophthalic acid (9.4% MEK solution) was added, and stirred for 15 min. The image forming layer coating solution was obtained by sequentially adding and stirring 12.43 of the addition solution a, 1.6 ml of Desmodur N3300/aliphatic isocyanate supplied from Mobey (10% MEK solution), 4.27 g of the addition solution b and 4.0 g of the addition solution c with further continuing to stir.

The structures of the additive agents used for the preparation of respective coating solutions including the stabilizer solution, and the image forming layer coating solution are shown below.

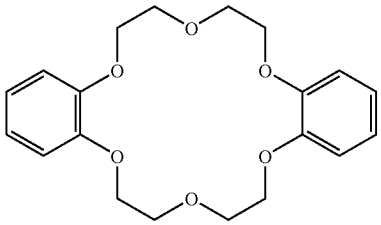

STABILIZER 1

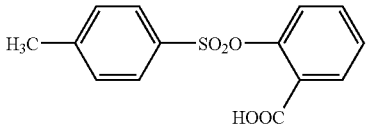

STABILIZER 2

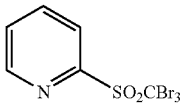

ANTIFOGGANT 2

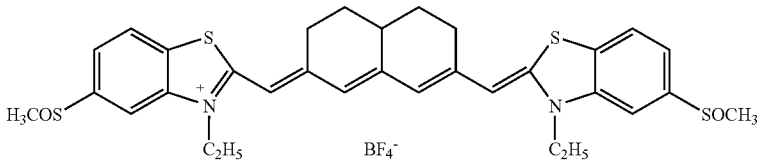

INFRARED SENSITING DYE

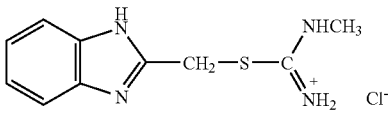

SUPERSENSITIZER 1

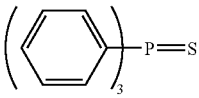

CHEMICAL SENSITIZER S-5

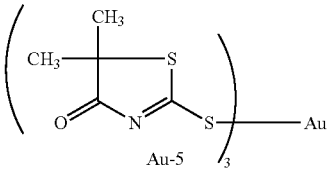

Au-5

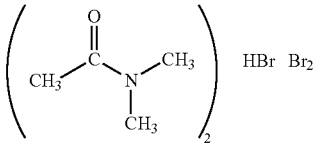

ANTIFOGGANT 1

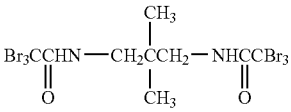

ANTIFOGGANT 3

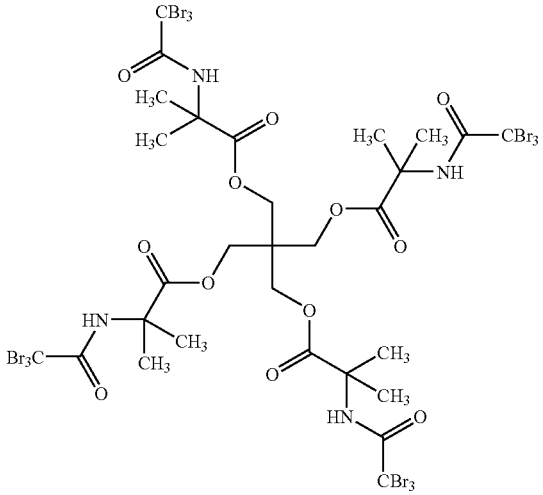

ANTIFOGGANT 4

<Preparation of Image Forming Layer Protection Layer Lower Layer (Surface Protection Layer Lower Layer)>

| | |
|---|---|
| Acetone | 5 g |
| MEK | 21 g |
| Cellulose acetate butyrate | 2.3 g |
| Methanol | 7 g |
| Phthalazine | 0.25 g |
| Monodisperse silica with monodisperse degree of 15% (mean particle size: 3 μm) (surface-treated with aluminium at 1% | 0.140 g |

-continued

| | |
|---|---|
| by mass based on total weight of silica) | |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17: mentioned before) | 0.01 g |
| Stearic acid | 0.1 g |
| Butyl stearate | 0.1 g |
| α-Alumina (Mohs hardness: 9) | 0.1 g |

<Preparation of Image Forming Layer Protection Layer Upper Layer (Surface Protection Layer Upper Layer)>

| | |
|---|---|
| Acetone | 5 g |
| Methylethylketone | 21 g |
| Cellulose acetate butyrate | 2.3 g |
| Methanol | 7 g |
| Phthalazine | 0.25 g |
| Monodisperse silica with monodisperse degree of 15% (mean particle size: 3 μm) (surface-treated with aluminium at 1% by mass based on total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorinated surfactant (SF-17: mentioned before) | 0.01 g |
| Stearic acid | 0.1 g |
| Butyl stearate | 0.1 g |
| α-Alumina (Mohs hardness: 9) | 0.1 g |

<Manufacture of Photothermographic Imaging Material>

The back coat layer coating solution and the back coat layer protection layer coating solution prepared above were coated on the under coating upper layer B-2 by an extrusion coater at a coating velocity of 50 m/min such that the thickness of each dried film was 3.5 μm. The drying was carried out over 5 min using dried wind with drying temperature at 100° C. and dew point at 10° C.

The photothermographic imaging materials No. 1 to No. 21 shown in Tables 1-1 and 1-2 were manufactured by simultaneously overlaying and coating the image forming layer coating solution and the image forming layer protection layer (surface protection layer) coating solution on the under coating upper layer A-2 using the extrusion coater at the coating velocity of 50 m/min. The coating was carried out such that a coated silver amount is 1.2 g/m$^2$ in the image forming layer and the thickness of dried film is 2.5 μm (surface protection layer upper layer: 1.3 μm, surface protection layer lower layer: 1.2 μm) in the image formation protection layer (surface protection layer). Subsequently, the drying was carried out for 10 min using the dried wind with drying temperature 75° C. and dew point at 10° C.

The sample No. 12 was prepared as is the case with the sample No. 11, except that the fluorinated surfactant in the back coat layer protection layer and the image forming layer protection layer (upper and lower layers) was changed from SF-17 to $C_8F_{17}SO_3Li$ in the sample 11.

The sample No. 13 was made as is the case with the sample No. 11, except that —$SO_3K$ group-containing polyvinyl butyral (Tg 65° C., 0.2 mmol/g of $SO_3K$ is contained) was used in place of —$SO_3K$ group-containing polyvinyl butyral (Tg 75° C., 0.2 mmol/g of $SO_3K$ is contained) as the image forming layer binder in the preparation of the predispersing solution A in the sample No. 11.

<Exposure and Development Processing>

The photothermographic imaging materials No. 1 to No. 21 manufactured above were cut into half-cut size (34.5 cm×43.0 cm), and then processed by the following procedure using the thermal development apparatus shown in FIG. 1.

The photothermographic imaging material F was taken out from the film tray C, transported to the laser exposure portion 121, and subsequently given exposure by laser scanning using an exposure machine where semiconductor laser (maximum output is made 70 mW by joining two of maximum output 35 mW per one) with vertical multiple mode of wavelength 810 nm at high frequency superposition is made an exposure source, from the side of the image formation layer face. At that time, the image was formed by making the angle of the exposure face of the photothermographic imaging material F and the exposure laser beam L 75°. Subsequently, the photothermographic imaging material F was transported to the developing portion 130, the heat drum 1 heated at 125° C. for 15 sec to perform thermal development such that the protection layer at the side of the image formation layer of the photothermographic imaging material F was in contact with the surface of the drum, and then photothermographic imaging material was taken out of the apparatus. At that time, the transport velocity from the feeding portion 110 to the exposure portion 121, the transport velocity at the exposure portion and the transport velocity at the developing portion were 20 mm/sec, respectively. The exposure and the development were carried out in the room adjusted at 23° C. and 50% RH. The exposure was performed gradually by reducing the amount of exposure energy of logE0.05 per one step from the maximum output.

<<Performance Evaluation>>

The following performances were evaluated for respective thermal developed images.

<<Image Density>>

The value at the maximum density part of the image obtained in the above condition is measured by a photographic densitometer and shown as the image density.

<<Average Gradation>>

The density of the obtained sensitometry sample was measured using PDM 65 transmission densitometer (supplied from Konica Corporation), and the characteristic curve was obtained by computer processing of the measurement result. The average gradation (Ga) value at the optical density of 0.25 to 2.5 was obtained from this characteristic curve.

<<Silver Color Tone>>

Silver color tone after the processing was visually evaluated by printing X-ray photographs of the chest in each photothermographic imaging material and using Schaukasten. As a standard sample, the film of wet processing for the laser imager supplied from Konica Corporation was used, and the relative color tone to the standard sample was visually evaluated with the following criteria by 0.5 increment.

5: Same tone as the standard sample
4: Preferable tone similar to the standard sample
3: Level with no practical problem although the tone is slightly different from the standard sample
2: Tone clearly different from the standard sample
1: Undesirable tone different from the standard sample <<Light Radiated Image Stability>>

The obtained imaging material was given the exposure and development processing as with the above, then attached on Schaukasten with luminance of 1000 Lux and left for 10 days, and subsequently the change of the image was evaluated with the following criteria by 0.5 increment.

5: Nearly no change
4: Slight tone change is observed
3: Tone change and increase of photographic fog are partially observed
2. Tone change and increase of photographic fog are considerably observed
1: Tone change and increase of photographic fog are noticeable, occurrence of strong density unevenness on whole area The results are shown together in Tables 1-1 and 1-2.

TABLE 1-1

| SAMPLE No. | PHOTOSENSITIVE AgX TYPE AND AMOUNT | LEUCO DYE OF FORMULA (YA) (g) | CYAN COLORING LEUCO DYE TYPE AND AMOUNT (g) | REDUCING AGENT OF FOMULA (A-3) TYPE AND AMOUNT (g) |
|---|---|---|---|---|
| 1(INV.) | A/E 36.2/9.1 | YA-1 0.159 | CA-10 0.159 | 1-95 27.98 |
| 2(INV.) | A/E 36.2/9.1 | YA-2 0.159 | CA-10 0.159 | 1-97 27.98 |
| 3(INV.) | A/E 36.2/9.1 | YA-9 0.159 | CA-10 0.159 | 1-94 27.98 |
| 4(INV.) | A/E 36.2/9.1 | YA-1 0.159 | CA-2 0.159 | 1-94 27.98 |
| 5(INV.) | A/E 36.2/9.1 | YA-1 0.159 | CA-5 0.159 | 1-94 27.98 |
| 6(INV.) | A/E 36.2/9.1 | YA-1 0.159 | CA-8 0.159 | 1-94 27.98 |
| 7(INV.) | A/E 36.2/9.1 | YA-1 0.159 | CA-9 0.159 | 1-94 27.98 |
| 8(INV.) | A/E 36.2/9.1 | YA-1 0.159 | CA-8 0.159 | 1-94 27.98 |
| 9(INV.) | A/E 36.2/9.1 | YA-1 0.159 | CA-8 0.159 | 1-94 27.98 |
| 10(INV.) | A 45.3 | YA-1 0.159 | CA-10 0.159 | 1-94 27.98 |
| 11(INV.) | A 45.3 | NIL | CA-10 0.159 | 1-94 27.98 |
| 12(INV.) | A 45.3 | NIL | CA-10 0.159 | 1-94 27.98 |
| 13(INV.) | A 45.3 | NIL | CA-10 0.159 | 1-94 27.98 |
| 14(INV.) | B 45.3 | NIL | CA-10 0.159 | 1-94 27.98 |
| 15(INV.) | C 45.3 | NIL | CA-10 0.159 | 1-94 27.98 |
| 16(COMP.) | D 45.3 | NIL | CA-10 0.159 | 1-94 27.98 |
| 17(COMP.) | E 45.3 | NIL | CA-10 0.159 | 1-94 27.98 |
| 18(COMP.) | A 45.3 | NIL | NIL | 1-94 27.98 |
| 19(COMP.) | A 45.3 | NIL | CA-10 0.159 | a 27.98 |
| 20(INV.) | A/E 36.2/9.1 | YA-1 0.159 | CA-10 0.159 | COMBINATION* |
| 21(INV.) | A/E 36.2/9.1 | YA-1 0.159 | CA-10 0.159 | COMBINATION** |

TABLE 1-2

| SAMPLE No. | SILVER SAVING AGENT | IMAGE DEN-SITY | AVERAGE GRADATION (Ga) | SILVER COLOR TONE | IMAGE STA-BILITY |
|---|---|---|---|---|---|
| 1(INV.) | G-1 | 4.3 | 2.7 | 5.0 | 5.0 |
| 2(INV.) | G-1 | 4.3 | 2.7 | 5.0 | 5.0 |
| 3(INV.) | G-1 | 4.5 | 2.7 | 5.0 | 5.0 |
| 4(INV.) | G-1 | 4.5 | 2.7 | 5.0 | 5.0 |
| 5(INV.) | G-1 | 4.5 | 2.7 | 5.0 | 5.0 |
| 6(INV.) | G-1 | 4.5 | 2.7 | 5.0 | 5.0 |
| 7(INV.) | H-6 | 4.5 | 2.8 | 5.0 | 5.0 |
| 8(INV.) | S-1 | 4.3 | 2.6 | 5.0 | 5.0 |
| 9(INV.) | TPT | 4.3 | 2.6 | 5.0 | 5.0 |
| 10(INV.) | G-1 | 4.2 | 2.7 | 5.0 | 5.0 |
| 11(INV.) | G-1 | 4.0 | 2.7 | 4.5 | 5.0 |
| 12(INV.) | G-1 | 4.0 | 2.7 | 4.5 | 5.0 |
| 13(INV.) | G-1 | 4.0 | 2.7 | 4.0 | 5.0 |
| 14(INV.) | G-1 | 3.9 | 2.7 | 4.0 | 5.0 |
| 15(INV.) | G-1 | 4.2 | 2.7 | 4.0 | 4.5 |
| 16(COMP.) | G-1 | 3.6 | 2.7 | 3.0 | 3.0 |
| 17(COMP.) | G-1 | 3.5 | 2.7 | 3.0 | 4.0 |
| 18(COMP.) | G-1 | 3.5 | 2.7 | 2.5 | 4.0 |
| 19(COMP.) | G-1 | 2.9 | 2.7 | 3.0 | 2.5 |
| 20(INV.) | G-1 | 4.2 | 2.5 | 5.0 | 5.0 |
| 21(INV.) | G-1 | 4.2 | 2.5 | 5.0 | 5.0 |

TPT: Triphenyltetrazolium

*: 1-94/b = 4.20/23.78

**: 1-94/1-1 = 4.20/23.78 a

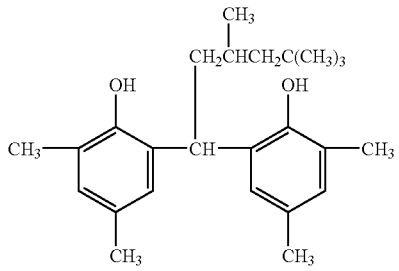

b

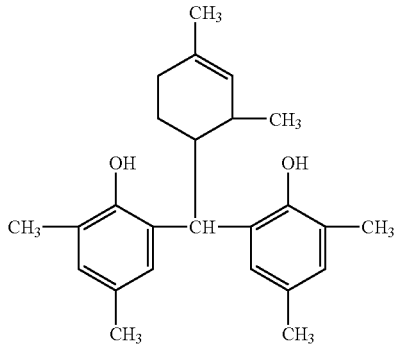

From Tables 1-1 and 1-2, it is obvious that the photothermographic imaging materials of the invention are high density and excellent in silver color tone and light radiated image stability, compared to the comparative photothermographic imaging materials.

Also, when the samples 11 and 12 were compared, it was shown that the sample 11 has more excellent properties for transportability and environmental suitability (accumulation in vivo). Also when the samples 11 and 13 were compared, it was shown that the sample 11 has more excellent property for the image storage stability in storage at high temperature. Furthermore, when the samples 20 and 1 were compared, it was shown that the sample 20 was more excellent in that the image with more stable density was obtained even when the temperature change occurred at the thermal development.

Example B-1

<<Manufacture of Support>>

Corona discharge treatment at 0.5 kV·A·min/$m^2$ was given to one side face of a polyethylene terephthalate film base (thickness 175 μm) blue-colored at a density of 0.170, and then using the following under coat coating solution A, an under coating layer a was applied on it such that the thickness of dried film became 0.2 μm. The corona discharge treatment at 0.5 kV·A·min/$m^2$ was similarly given to another face, and then using the following under coat coating solution B, an under coating layer b was applied on it such that the thickness of dried film became 0.1 μm. Subsequently, heat treatment was carried out at 130° C. for 15 min in a heat treating type oven having a film transport apparatus made up of multiple roller groups to make a support.

(Preparation of Under Coat Coating Solution A)

Copolymer latex solution (270 g) of 30% of n-Butyl acrylate, 20% of t-butyl acrylate, 25% of styrene and 25% of hydroxyethyl acrylate by mass (solid content 30% by mass), 0.6 g of surfactant (UL-1) and 0.5 g methylcellulose were mixed. Further, a dispersing solution obtained by adding 1.3 g of silica particles (Syloid 350, supplied from Fuji Silysia Chemical Ltd.) to 100 g of water and dispersing by a ultrasonic dispersing machine (Ultrasonic Generator, frequency 25 kHz, 600 W supplied from ALEX Corporation) for 30 min was added, and finally the mixture was filled up with water to 1000 ml to make the under coat coating solution A.

(Preparation of Under Coat Coating Solution B)

The colloidal tin oxide dispersing solution (37.5 g), 3.7 g of the copolymer latex solution (solid content 30%) of 20% of n-butyl acrylate, 30% of t-butyl acrylate, 27% of styrene and 28% of 2-hydroxyethyl acrylate by mass, 14.8 g of the copolymer latex solution (solid content 30%) of 40% of n-butyl acrylate, 20% of styrene and 40% of glycidyl methacrylate by mass, and 0.1 g of the surfactant (UL-1) were mixed, and filled up with water to 1000 ml to make the under coat coating solution B.

(Preparation of Colloidal Tin Oxide Dispersing Solution)

Tin chloride hydrate (65 g) was dissolved in 2000 ml of a water/ethanol mix solution to prepare a uniform solution. Then, this was boiled to yield coprecipitate. The produced precipitate was taken out by decantation, and washed with distilled water several times. Silver nitrate was dripped in the distilled water with which the precipitate was washed and it was confirmed that there was no chlorine ion reaction. Subsequently, distilled water was added to the washed precipitate and the total amount is made 2000 ml. Further, 40 ml of 30% aqueous ammonia was added, the aqueous solution was heated and concentrated until the volume became 470 ml to prepare the colloidal tin oxide dispersing solution.

UL-1

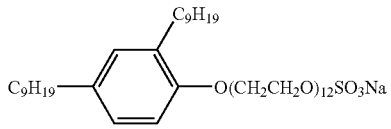

<<Coating of Back Face Side>>

Cellulose acetate butyrate (84.2 g) (Eastman Chemical Company, CAB381-20) and 4.5 g of polyester resin (Bostic Inc., Vitel PE2200B) was added to and dissolved in 830 g of methylethylketone (hereinafter abbreviated MEK) with stirring. Then, 0.30 g of the infrared dye 1 was added to the dissolved solution, and further 4.5 g of the fluorinated surfactant (supplied from Asahi Glass Co., Ltd., Surflon KH40) and 2.3 g of the fluorinated surfactant (supplied from Dainippon Ink And Chemicals, Incorporated, Megafag F120K) dissolved in 43.2 g of methanol were added and thoroughly stirred until being dissolved. Finally, 75 g of silica (supplied from W. R. Grace, Syloid 64x6000) dispersed in MEK at a concentration of 1% by mass by a dissolver type homogenizer was added and stirred to prepare the coating solution for the back face side.

INFRARED DYE 1

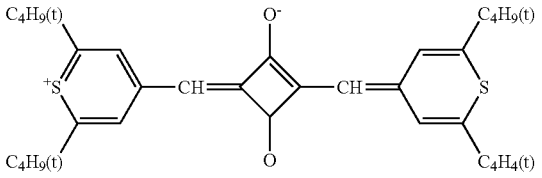

The back face coating solution prepared in this way was coated on the prepared under coating layer a of the support by an extruding coater such that the thickness of dried film became 3.5 μm, and dried. Drying was performed over 5 min using a drying wind with a drying temperature of 100° C. and a dew point of 10° C.

<<Manufacture of Photosensitive Silver Halide Emulsion>>

[Preparation of Photosensitive Silver Halide Emulsion 1]

| | |
|---|---|
| (Solution A1) | |
| Phenylcarbamoylated gelatin | 88.3 g |
| Compound A (10% methanol aqueous solution) | 10 ml |
| Potassium bromide | 0.32 g |
| are filled up with water to 5429 ml. | |
| (Solution B1) | |
| Aqueous solution of 0.67 mol/L silver nitrate | 2635 ml |
| (Solution C1) | |
| Potassium bromide | 52.73 g |
| is filled up with water to 660 ml. | |
| (Solution D1) | |
| Potassium bromide | 158.43 g |
| $K_3OsCl_6 + K_4[Fe(CN)_6]$ (dopant, corresponding to $2 \times 10^{-5}$ mol/Ag, respectively) | 50.0 ml |
| are filled up with water to 1982 ml. | |

-continued

| | |
|---|---|
| (Solution E1) | |
| Aqueous solution of 0.4 mol/L potassium bromide<br>Amount to control the following silver potential | |
| (Solution F1) | |
| Potassium hydroxide<br>is filled up with water to 20 ml. | 0.71 g |
| (Solution G1) | |
| Aqueous solution of 56% acetic acid | 18.0 ml |
| (Solution H1) | |
| Sodium carbonate anhydride<br>is filled up with water to 151 ml. | 1.72 g |
| Compound A:<br>$HO(CH_2CH_2O)_n(CH(CH_3)CH_2O)_{17}(CH_2CH_2O)_mH$<br>(m + n = 5 to 7) | |

Using the mixing agitator described in JP-B-58-58288, ¼ amount of the solution B1 and the whole amount of the solution C1 were added to the solution A1 over 4 min 45 sec with controlling the temperature at 30° C. and pAg at 8.09 by a simultaneous mixing method to perform nucleus formation. After one minute, the whole amount of the solution F1 was added. In the meantime, pAg was appropriately adjusted using the solution E1. After 6 min, the temperature was elevated to 40° C., the ¾ amount of the solution B1 and the whole amount of the solution D1 were added over 14 min 15 sec with controlling pAg at 8.09 by the simultaneous mixing method. After agitated for 5 min, the whole amount of the solution G1 was added to precipitate silver halide emulsion. A supernatant was eliminated with leaving 2000 ml of precipitated portion, 10 L of water was added, agitated and then precipitated the silver halide emulsion again. The supernatant was eliminated with leaving 1500 ml of the precipitated portion, further 10 L of water was added, agitated and then precipitated the silver halide emulsion. The supernatant was eliminated with leaving 1500 ml of the precipitated portion, subsequently the solution H1 was added, the temperature was elevated to 60° C., and further agitated for 120 min. Finally, pH was adjusted at 5.8 and water was added such that the amount is 1161 g per 1 mol of the silver to yield the emulsion.

This emulsion was monodisperse cubic iodide bromide silver particles with the mean particle size of 0.050 μm, the variation coefficient of particle sizes of 12% and [100] face ratio of 92%.

Then, 240 ml of a sulfur sensitizer S-5 (0.5% methanol solution) was added to the above emulsion, additionally a gold sensitizer Au-5 corresponding to 1/20 mol of this sensitizer was added, and chemical sensitization was given by agitating for additional 120 min at 55° to prepare the photosensitive silver halide emulsion 1.

S-5

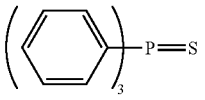

-continued

Au-5

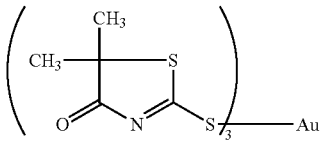

<<Preparation of Photosensitive Layer Coating Solution>>

(Preparation of Powder Aliphatic Silver Carboxylate 1)

Behenic acid (130.8 g), 67.7 g of arachidic acid, 43.6 g of stearic acid and 2.3 g of palmitic acid were dissolved in 4720 ml of pure water at 80° C. Next, 540.2 ml of an aqueous solution of 1.5 mol/L sodium hydroxide was added, 6.9 ml of concentrated nitric acid was added, and subsequently cooled to 55° C. to yield a solution of sodium fatty acid. The solution of sodium fatty acid was stirred for 20 min with retaining the temperature at 55° C., then 45.3 g (corresponding to 0.039 mol of the silver) of the above photosensitive silver halide emulsion 1 and 450 ml of pure water were added and stirred for 5 min.

Next, 702.6 ml of 1 mol/L silver nitrate solution was added over 2 min and stirred for 10 min to yield an aliphatic silver carboxylate dispersion. Subsequently, the obtained aliphatic silver carboxylate dispersion was transferred into a water-washing vessel, distilled water was added and stirred, then left to float and separate the aliphatic silver carboxylate dispersion, and lower water soluble salts were eliminated. Subsequently, water-washing with distilled water and discharging water were repeated until the electric conductivity of the discharged water became 50 μS/cm, and then centrifugation and dehydration were carried out. The resultant cake-shaped aliphatic silver carboxylate was dried using a flash dryer, Flash Jet Dryer (supplied from Seishin Enterprise Co., Ltd.) by an operation condition of nitrogen gas atmosphere and hot wind temperature at a dryer inlet until the water content became 0.1% to yield the powder aliphatic silver carboxylate 1. An infrared moisture meter was used for the water content measurement of the aliphatic silver carboxylate composition.

(Preparation of Predispersing Solution 1)

Polyvinyl butyral resin (14.57 g) was dissolved in 1457 g of MEK, 500 g of the above powder aliphatic silver carboxylate 1 was gradually added with stirring using a dissolver, DISPERMAT CA-40M type supplied from VMA-GETZMANN, and mixed thoroughly to prepare the predispersing solution A.

(Preparation of Photosensitive Emulsion Dispersing Solution 1)

The predispersing solution 1 prepared above was supplied to a media type dispersing machine, DISPERMAT SL-C12EX type (supplied from VMA- GETZMANN) where zirconia beads (supplied from Toray Industries, Inc., Toreselam) with a diameter of 0.5 mm were filled up to 80% of an inner volume such that a staying time in a mill is 1.5 min using a pump, the dispersion was carried out at a mill peripheral velocity of 8 m/s to prepare the photosensitive emulsion dispersing solution 1.

(Preparation of Stabilizer Solution)

The stabilizer 1 (1.0 g) and 0.31 g of potassium acetate were dissolved in 4.97 g of methanol to prepare the stabilizer solution.

(Preparation of Infrared Sensitizing Dyestuff Solution A)

The infrared sensitizing dyestuff 1 (19.2 mg), 1.488 g of 2-chloro-benzoic acid, 2.779 g of the stabilizer 2 and 365 mg of 5-methyl-2-mercaptobenzimidazole were dissolved in 31.3 ml of MEK in a dark place to prepare the infrared sensitizing dyestuff solution A.

(Preparation of Additive Solution A)

The following thiuronium salt 1 (50 mg) was dissolved in 5.0 g of methanol to prepare the additive solution A.

(Preparation of Additive Solution B)

Sodium benzenethiosulfonate (1.0 g) was dissolved in 9.0 g of MEK to prepare the additive solution B.

(Preparation of Additive Solution a)

The developer 1 (27.98 g), 0.7 g of the yellow coloring leuco dye YA-1 0.7 g of cyan leuco dye of the invention represented by CA-3, 1.54 g of 4-methyl phthalate and 0.48 g of the above infrared dye 1 were dissolved in 110 g of MEK to make the additive solution a.

(Preparation of Additive Solution b)

The Antifoggant 2 (1.56 g) and 3.43 g of phthalazine were dissolved in 40.9 of MEK to make the additive solution (Preparation of infrared sensitizing dyestuff solution A) The infrared sensitizing dyestuff 1 (19.2 mg), 1.488 g of 2-chloro-benzoic acid, 2.779 g of the stabilizer 2 and 365 mg of 5-methyl-2-mercaptobenzimidazole were dissolved in 31.3 ml of MEK in a dark place to prepare the infrared sensitizing dyestuff solution A.

(Preparation of Additive Solution A)

The following thiuronium salt 1 (50 mg) was dissolved in 5.0 g of methanol to prepare the additive solution A.

(Preparation of Additive Solution B)

Sodium benzenethiosulfonate (1.0 g) was dissolved in 9.0 g of MEK to prepare the additive solution B.

(Preparation of Additive Solution a)

The developer 1 (27.98 g), 0.7 g of the yellow coloring leuco dye YA-1 0.7 g of cyan leuco dye of the invention represented by CA-3, 1.54 g of 4-methyl phthalate and 0.48 g of the above infrared dye 1 were dissolved in 110 g of MEK to make the additive solution a.

(Preparation of Additive Solution b)

The Antifoggant 2 (1.56 g) and 3.43 g of phthalazine were dissolved in 40.9 of MEK to make the additive solution were sequentially added and stirred to obtain the photosensitive layer coating solution 1.

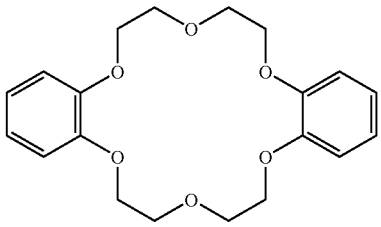

STABILIZER 1

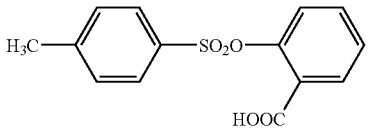

STABILIZER 2

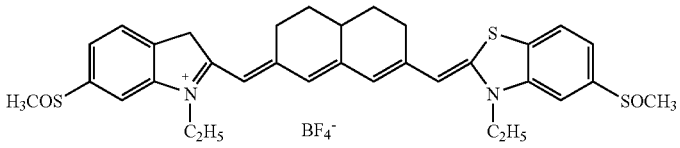

INFRARED SENSITING DYE 1

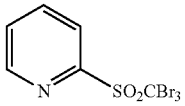

ANTIFOGGANT 2

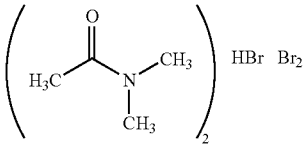

ANTIFOGGANT 1

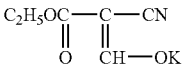

VINYL COMPOUND A

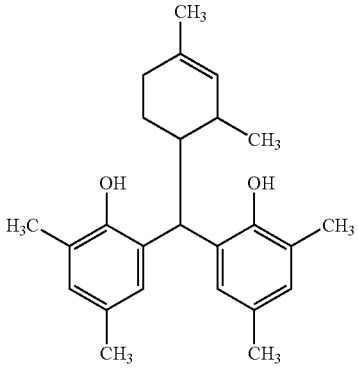

DEVELOPER 1

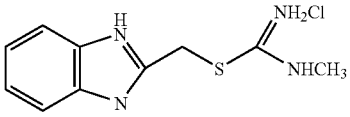

THIURONIUM SALT 1

<<Preparation of Surface Protection Layer Coating Solution>>

Cellulose acetate butyrate (96 g)(Eastman Chemical, CAB171-15), 4.5 g of polymethylmethacrylate (Rohm & Haas, Paraloid A-21), 1.5 g of vinylsulfone compound (1-1), 1.0 g of benzotriazole and 1.0 g of the fluorinated surfactant (Asahi Glass Co., Ltd., Surflon KH40) were added to and dissolved in 865 g of MEK with stirring. Next, 30 g of the following matting agent dispersion was added and stirred to prepare the surface protection layer coating solution.

(Preparation of Matting Agent Dispersion)

Cellulose acetate butyrate (7.5 g CAB171-15, supplied from Eastman Chemical) was dissolved in 42.5 g of MEK, 5 g of calcium carbonate (Speciality Minerals, Super-Pflex 200) was added thereto and dispersed by the dissolver type homogenizer at 8000 rpm for 30 min to prepare the matting agent dispersion.

<<Manufacture of Silver Salt Photothermal Photographic Dry Imaging Material>>

(Manufacture of Sample 101)

The sample 101 was prepared by simultaneously overlaying and coating the photosensitive layer coating solution 1 and the surface protection layer coating solution prepared above on the under coating layer b prepared above of the support using an extrusion type coater known in the art. The coating was carried out such that the coated silver amount of the photosensitive layer is 1.5 g/m$^2$ and the dried film thickness of the surface protection layer is 2.5 μm. Subsequently, drying was carried out for 10 min using the drying wind with the drying temperature at 75° C. and the dew temperature at 10° C.

(Preparation of the Photosensitive Silver Halide Emulsions 2 to 5 and the Photosensitive Emulsion Dispersions 2 to 5 of the Invention)

The photosensitive silver halide emulsions 2 to 5 and then the photosensitive emulsion dispersions 2 to 5 were prepared as is the case with the preparation of the photosensitive silver halide emulsion 1, except that the dissolution masses of potassium bromide and potassium iodide in the solution C1 and the solution D1 were changed such that the halide composition became the composition described in Table 2.

TABLE 2

| DISPERSION EMULSION No. | PERCENT OF IODINE IN SILVER HALIDE PARTICLES (mol %) | PERCENT OF SILVER BEHENATE mo (mol %) |
|---|---|---|
| 1 | 0 | 50 |
| 2 | 2 | 50 |
| 3 | 4 | 50 |
| 4 | 6 | 50 |
| 5 | 8 | 50 |

Each sample made above was stored at 25° C. and at 50% RH (condition A) for 10 days, and subsequently exposure by laser scanning was given from the photosensitive layer coated side of each sample using an exposing machine making semiconductor laser (maximum output of 70 mW by combining two waves with maximum output of 35 mW) with wavelength of 800 to 820 nm at high frequency superposition in vertical multiple mode an exposure source. At that time, the image was formed by making an angle of an exposure face of the sample and the exposure laser light 75 degree. In this method, compared to the case of making the angle 90 degree, good results such as less unevenness and unexpected sharpness were obtained.

Subsequently, using an automatic developing machine having a heat drum, the thermal development was carried out at 125° C. for 15 sec such that the surface protection layer of the sample was contacted with the surface of heat drum, and then the silver salt photothermographic dry imaging material was transport out of the apparatus. At that time, the transport velocity from the imaging material supplying portion to the image exposure portion, the transport velocity at the image exposure portion, and the transport velocity at the thermal development portion was 20 mm/sec, respectively. Also, the above exposure and development were carried out in a room adjusted at 23° C. and at 50% RH.

(Measurement of Sensitivity and Photographic Fog Density)

In the formed image obtained as the above, the density was measured using a photographic densitometer, and a property curve was made which is made up of a horizontal axis-sensitivity and a vertical axis-density. For a relative sensitivity, a reciprocal of an exposure amount which gives 1.0 higher density than that at an unexposed part was defined as the sensitivity, and the photographic fog density (minimum density) and the maximum density were measured. The relative density was represented by a relative value when the sensitivity of the sample 101 was made 100.

(Measurement of u* and v* in CIE 1976 Color Space)

($R^2$ Value Condition A)

From each sample stored at 25° C. and at 50% RH (condition A) for 10 days, a developed wedge sample with 4 stages comprising an unexposed part, and optical density at 0.5, 1.0 and 1.5 was made using the above automatic thermal development apparatus. Each wedge density part made in this way was measured by CM-3600d (supplied from Minolta Co., Ltd.), and u* and v* were calculated. At that time, under the measurement condition making F7 light source the light source and making an angle of field 10°, the measurement was carried out in a transmission measurement mode. Measured u* and v* were plotted on a graph where the horizontal and vertical axes were made u* and v*, respectively, a linear regression straight line was obtained and made a multiple determination $R^2$ value condition A. This value is the value indicating the degree of color tone change. The closer to 1.0 the value is, it indicates the lesser change of color tone at each density and to be preferable.

(Storage with Moisture)

Each sample was stored at 40° C. and at 80% RH (condition B) for 10 days, subsequently the exposure and the development were given as with the above, photographic fog at that time was obtained to acquire the percentage against the photographic fog at the condition A.

Percentage change of photographic fog=Photographic fog (condition *B*)/Photographic fog (condition *A*)×100 (%)

Percentage change of sensitivity=Sensitivity (condition *B*)/Sensitivity (condition *A*)×100 (%)

The obtained results were shown in Tables 3-1 and 3-2.

TABLE 3-1

| SAMPLE No. | CYAN LEUCO DYE | DISPERSION EMULSION No. | CROSSLINKERS VINYLSULFONE | ISOCYANATE | CARBODIIMIDE | PHOTOGRAPHIC FOG |
|---|---|---|---|---|---|---|
| 101 | CA-3 | 1 | 1-1 | 2-1 | 3-8 | 0.19 |
| 102 | — | 1 | 1-1 | 2-1 | 3-8 | 0.23 |
| 103 | CA-3 | 2 | 1-1 | 2-1 | 3-8 | 0.19 |
| 104 | CA-3 | 3 | 1-1 | — | — | 0.18 |
| 105 | CA-3 | 3 | — | 2-1 | — | 0.19 |
| 106 | CA-3 | 3 | — | N3300 | — | 0.19 |
| 107 | CA-3 | 3 | — | — | 3-8 | 0.18 |
| 108 | CA-3 | 3 | 1-1 | 2-1 | 3-8 | 0.18 |
| 109 | — | 3 | 1-1 | 2-1 | 3-8 | 0.21 |
| 110 | CA-5 | 3 | 1-1 | 2-1 | 3-8 | 0.19 |
| 111 | CA-8 | 3 | 1-1 | 2-1 | 3-8 | 0.18 |
| 112 | CA-3 | 4 | 1-1 | 2-1 | 3-8 | 0.19 |
| 113 | CA-3 | 5 | 1-1 | 2-1 | 3-8 | 0.20 |
| 114 | — | 5 | 1-1 | 2-1 | 3-8 | 0.22 |

N3300: Desmodur N3300/Aliphatic isocyanate supplied from Mobay Chemical Corporation

TABLE 3-2

| SAMPLE No. | SENSITIVITY | MAXIMUM DENSITY | COLOR TONE $R^2$ | SLOPE | STORAGE WITH MOISTURE CHANGE RATE OF PHOTOGRAPHIC FOG % | CHANGE RATE OF SENSITIVITY % |
|---|---|---|---|---|---|---|
| 101 | 100 | 3.15 | 0.998 | 0.78 | 116 | 89 |
| 102 | 85 | 2.95 | 0.800 | 0.50 | 150 | 75 |
| 103 | 110 | 3.20 | 0.999 | 0.90 | 110 | 105 |
| 104 | 111 | 3.20 | 0.998 | 0.91 | 109 | 106 |
| 105 | 110 | 3.22 | 0.998 | 0.90 | 110 | 105 |
| 106 | 110 | 3.21 | 0.998 | 0.90 | 110 | 105 |
| 107 | 112 | 3.20 | 0.998 | 0.89 | 111 | 104 |
| 108 | 125 | 3.30 | 1.000 | 1.00 | 105 | 95 |
| 109 | 90 | 3.00 | 0.850 | 0.65 | 125 | 120 |
| 110 | 110 | 3.20 | 0.999 | 0.92 | 110 | 105 |
| 111 | 112 | 3.22 | 0.999 | 0.90 | 108 | 104 |
| 112 | 110 | 3.20 | 0.999 | 0.90 | 110 | 105 |
| 113 | 105 | 3.15 | 0.998 | 0.85 | 115 | 110 |
| 114 | 85 | 2.90 | 0.750 | 0.55 | 140 | 130 |

In the samples 102, 109 and 114, preferable tendencies are observed when the iodine content of the silver halide is in the range of the invention, but improvement effects thereof are low because the cyan leuco dye of the invention is not combined. In the samples 101, 103, 112 and 113, remarkable improvement effects are observed when the cyan leuco dye of the invention is used and the iodine content of the silver halide is in the range of the invention. Further in the samples in which the cyan leuco dye of the invention is used, the iodine content of the silver halide is in the range of the invention and the crosslinkers are combined, it is shown that the sample has low photographic fog with high sensitivity and high maximum density, and when stored for a long time, changes of photographic fog density and sensitivity are low, and further it is excellent in image color tone.

Example B-2

(Preparation of the Photosensitive Silver Halide Emulsions 1A, 1B, 3B, 5B and the Photosensitive Emulsion Dispersions 1A, 1B, 3B, 5B of the Invention)

The photosensitive silver halide emulsions 1A, 1B, 3B, 5B and the photosensitive emulsion dispersions 1A, 1B, 3B, 5B of the invention were prepared as is the case with the photosensitive silver halide emulsion and photosensitive emulsion dispersion 1, except that the dissolution masses of potassium bromide and potassium iodide in the solution C1 and the solution D1 were changed such that the halide composition became the composition described in Table 4, and arachidic acid, stearic acid and palmitic acid were combined to become the combination described in Table 4 without changing molar ratio thereof at the preparation of powder aliphatic silver carboxylate.

TABLE 4

| DISPERSION EMULSION No. | PERCENT OF SILVER HALIDE PARTICLES (mol %) | PERCENT OF SILVER BEHENATE mo (mol %) |
|---|---|---|
| 1 | 0 | 50 |
| 1A | 0 | 80 |
| 1B | 0 | 95 |
| 3B | 4 | 95 |
| 5B | 8 | 95 |

(Preparation of the Crosslinker Solutions of the Invention)

The respective crosslinkers of the invention were added to become the combination described in Table 5-1. Besides, for the added layers, 0.16 g of the compound containing vinylsulfone groups was added to the photosensitive coating solution and 1.6 g of the compound containing isocyanate or carbodiimide groups was added to the surface protection solution.

(Preparation of the Cyan Leuco Dye Solution)

The same amount of the cyan leuco dye of the invention was dissolved in the additive solution a to become the combination described in Table 5-1 as is the case with the manufacture of the sample 101.

(Manufacture of Samples 201 to 219)

The samples 201 to 219 were prepared as is the case with the Example B-1 except that the types of the photosensitive silver halide emulsion, crosslinkers and cyan leuco dye in the photosensitive layer coating solution 1 were combined as described in Table 5-1.

The exposure, the development processing and the respective property evaluations were performed every bit as the Example B-1. The results were shown in Tables 5-1 and 5-2.

TABLE 5-1

| SAMPLE No. | CYAN LEUCO DYE | DISPERSION EMULSION No. | CROSSLINKERS VINYLSULFONE | ISOCYANATE | CARBODIIMIDE | PHOTOGRAPHIC FOG |
|---|---|---|---|---|---|---|
| 201 | — | 1 | 1-1 | 2-1 | 3-8 | 0.23 |
| 202 | CA-3 | 1 | 1-1 | 2-1 | 3-8 | 0.20 |
| 203 | — | 1A | 1-1 | 2-1 | 3-8 | 0.22 |
| 204 | CA-3 | 1A | 1-1 | 2-1 | 3-8 | 0.19 |
| 205 | — | 1B | 1-1 | 2-1 | 3-8 | 0.22 |
| 206 | CA-3 | 1B | 1-1 | 2-1 | 3-8 | 0.19 |
| 207 | — | 3B | 1-1 | 2-1 | 3-8 | 0.22 |
| 208 | CA-3 | 3B | 1-1 | 2-1 | 3-8 | 0.18 |
| 209 | CA-3 | 3B | 1-6 | 2-1 | 3-8 | 0.19 |
| 210 | CA-3 | 3B | 1-1 | N3300 | 3-8 | 0.18 |
| 211 | CA-3 | 3B | 1-1 | 2-1 | 3-15 | 0.18 |
| 212 | — | 5B | 1-1 | 2-1 | 3-8 | 0.22 |
| 213 | CA-3 | 5B | 1-1 | 2-1 | 3-8 | 0.19 |
| 214 | CA-5 | 3B | 1-1 | 2-1 | 3-8 | 0.18 |
| 215 | CA-8 | 3B | 1-1 | 2-1 | 3-8 | 0.18 |
| 216 | CA-3 | 3B | 1-1 | — | — | 0.19 |
| 217 | CA-3 | 3B | — | 2-1 | — | 0.18 |
| 218 | CA-3 | 3B | — | N3300 | — | 0.18 |
| 219 | CA-3 | 3B | — | — | 3-8 | 0.18 |

N3300: Desmodur N3300/Aliphatic isocyanate supplied from Mobay Chemical Corporation

TABLE 5-2

| SAMPLE No. | SENSITIVITY | MAXIMUM DENSITY | COLOR TONE $R^2$ | SLOPE | STORAGE WITH MOISTURE CHANGE RATE OF PHOTOGRAPHIC FOG % | CHANGE RATE OF SENSITIVITY % |
|---|---|---|---|---|---|---|
| 201 | 85 | 2.95 | 0.800 | 0.50 | 150 | 75 |
| 202 | 115 | 3.15 | 0.998 | 0.81 | 115 | 90 |
| 203 | 105 | 3.00 | 0.850 | 0.59 | 140 | 80 |
| 204 | 125 | 3.20 | 0.998 | 0.90 | 112 | 95 |
| 205 | 105 | 3.00 | 0.850 | 0.60 | 140 | 80 |
| 206 | 125 | 3.20 | 0.998 | 0.91 | 110 | 95 |
| 207 | 105 | 3.00 | 0.850 | 0.60 | 140 | 80 |
| 208 | 136 | 3.35 | 1.000 | 1.00 | 105 | 105 |
| 209 | 135 | 3.35 | 1.000 | 0.95 | 107 | 105 |
| 210 | 135 | 3.35 | 1.000 | 0.95 | 108 | 104 |
| 211 | 134 | 3.35 | 1.000 | 0.94 | 107 | 105 |
| 212 | 105 | 3.00 | 0.850 | 0.60 | 135 | 80 |
| 213 | 125 | 3.20 | 0.998 | 0.90 | 108 | 90 |
| 214 | 135 | 3.35 | 1.000 | 1.00 | 105 | 105 |
| 215 | 133 | 3.35 | 1.000 | 0.99 | 105 | 105 |
| 216 | 135 | 3.35 | 0.999 | 0.95 | 112 | 110 |
| 217 | 135 | 3.35 | 0.999 | 0.94 | 113 | 109 |
| 218 | 136 | 3.35 | 0.999 | 0.95 | 112 | 110 |
| 219 | 135 | 3.35 | 0.999 | 0.95 | 113 | 110 |

In the samples 201 to 206, improvement degrees are low even when the percentage of behenic acid in the aliphatic silver carboxylate is increased, but when the cyan leuco dye of the invention is combined, the improvement effects thereof are great. Also, in the samples 201 to 206 and the samples 207 to 219, it is shown to be especially preferable when the iodine content of silver halide is in the range of the invention. Further, it is shown that the samples which satisfy all of claims 12 and 13 have low photographic fog with high sensitivity and high maximum density, and when stored for a long time, changes of photographic fog density and sensitivity are low, and further it is excellent in image color tone.

In the above, the embodiments and Examples of the present invention is explained. However, it is needless to say that the present invention is not limited to such embodiments nor Examples, but various modifications are possible in a range within the scope of the present invention.

According to the invention, it is possible to provide a photothermographic imaging material with high density which is excellent in light radiated image stability and silver color tone. Also, it is possible to provide the photothermographic image materials which are excellent in image storage stability in storage at the high temperature, or excellent in transportability of films and environmental suitability if necessary.

According to the invention, it is possible to provide a silver salt photothermal photographic dry imaging material with low photographic fog, high sensitivity and high maximum density, where changes of the photographic fog density and the sensitivity are low when stored for a long time, and which is excellent in image color tone, as well as the image recording method and the image forming method using the same.

The entire disclosure of Japanese Patent Application Nos. 2002-356615 and 2003-5526 filed on Dec. 9, 2002 and Jan. 14, 2003, respectively, including specification, claims, drawings and summary are incorporated herein by reference in its entirety.

What is claimed is:

1. A silver salt photothermographic dry imaging material, comprising:

a photosensitive layer having an organic silver salt, a photosensitive silver halide, a silver ion reducing agent and a binder, the organic silver salt containing aliphatic silver carboxylate; and a cyan coloring leuco dye, wherein 70 mol % or more and less than 100 mol % of the aliphatic silver carboxylate in the organic silver salt is silver behenate.

2. The material of claim 1, further comprising:

at least one crosslinker selected from a group consisting of a vinylsulfone group, an isocyanate group and a carbodiimide group.

3. The material of claim 1, wherein coefficient of determination (multiple determination) $R^2$ of a linear regression straight line is 0.998 or more and 1.000 or less, the $R^2$ being made by measuring each density at optical density of 0.5, 1.0, 1.5 and minimum optical density on a silver image obtained after thermal development processing of the silver salt photothermographic dry imaging material and by disposing u* and v* at the above each optical density on two dimensional coordinates where a horizontal and vertical axes in CIE 1976 (L*u*v*) color space are made u* and v*, respectively; and v* value of an intersection point with the vertical axis of the linear regression straight line is −5 or more and 5 or less; and a slope (v*/u*) is 0.7 or more and 2.5 or less.

4. The method for recording an image on the material of claim 1, comprising:

performing image exposure according to a vertical multiple mode laser scanning exposure apparatus when recording the image on the material.

5. A method for forming an image after performing image recording on the material of claim 1, comprising:

thermal developing in a state containing 40 to 4500 ppm of organic solvent when forming the image on the material.

6. The material of claim 1, wherein 80 to 99.9 mol % of the aliphatic silver carboxylate in the organic silver salt is silver behenate.

7. The material of claim 1, wherein 90 to 99.9 mol % of the aliphatic silver carboxylate in the organic silver salt is silver behenate.

8. The material of claim 1, further comprising a compound represented by the following Formula (YB), (YB)

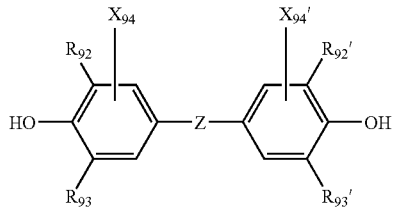

wherein Z represents —S— group or —C($R_{91}$') ($R_{91}$')-group, $R_{91}$, $R_{91}$', $X_{94}$ and $X_{94}$ each represent hydrogen atoms or substituents, and $R_{92}$, $R_{93}$, $R_{92}$' and $R_{93}$' each represent substituents.

9. The material of claim 8, wherein $R_{91}$ and $R_{91}$' each represent hydrogen atoms or alkyl groups, and $R_{92}$, $R_{93}$, $R_{92}$' and $R_{93}$' each represent alkyl groups.

* * * * *